US008660281B2

(12) United States Patent
Bouchard et al.

(10) Patent No.: US 8,660,281 B2
(45) Date of Patent: Feb. 25, 2014

(54) METHOD AND SYSTEM FOR A MULTI-MICROPHONE NOISE REDUCTION

(75) Inventors: Martin Bouchard, Cantley (CA); Homayoun Kamkar Parsi, Erlangen (DE)

(73) Assignee: University of Ottawa, Ottawa, Ontario (CA)

( * ) Notice: Subject to any disclaimer, the term of this patent is extended or adjusted under 35 U.S.C. 154(b) by 283 days.

(21) Appl. No.: 13/147,603

(22) PCT Filed: Feb. 3, 2010

(86) PCT No.: PCT/US2010/023041

§ 371 (c)(1),
(2), (4) Date: Aug. 30, 2011

(87) PCT Pub. No.: WO2010/091077

PCT Pub. Date: Aug. 12, 2010

(65) Prior Publication Data

US 2011/0305345 A1 Dec. 15, 2011

Related U.S. Application Data

(60) Provisional application No. 61/149,363, filed on Feb. 3, 2009.

(51) Int. Cl.
*H04R 25/00* (2006.01)
*H04R 5/00* (2006.01)

(52) U.S. Cl.
USPC ..... 381/312; 381/23.1; 381/83; 381/93; 381/95; 381/96; 381/316; 381/317; 381/318; 381/320; 381/71.1; 381/71.6; 381/71.11; 381/71.12; 704/226

(58) Field of Classification Search
USPC ..... 381/23.1, 312, 83, 93, 95, 96, 316–318, 381/320, 71.1, 71.6, 71.11, 71.12; 704/226
See application file for complete search history.

(56) References Cited

U.S. PATENT DOCUMENTS

2011/0307249 A1* 12/2011 Kellermann et al. ..... 704/226

OTHER PUBLICATIONS

Gabrea, "An Adaptive Kalman Filter for the Enhancement of Speech Signals in Colored Noise", IEEE Workshop on Applications of Signal Processing to Audio Acoustics, Oct. 16-19, 2005, pp. 45-48, New Paltz, NY, USA.

(Continued)

*Primary Examiner* — Vivian Chin
*Assistant Examiner* — Paul Kim
(74) *Attorney, Agent, or Firm* — Laurence A. Greenberg; Werner H. Stemer; Ralph E. Locher

(57) ABSTRACT

A method for a multi microphone noise reduction in a complex noisy environment is proposed. A left and a right noise power spectral density for a left and a right noise input frame is estimated for computing a diffuse noise gain. A target speech power spectral density is extracted from the noise input frame. A directional noise gain is calculated from the target speech power spectral density and the noise power spectral density. The noisy input frame is filtered by Kalman filtering method. A Kalman based gain is generated from the Kalman filtered noisy frame and the noise power spectral density. A spectral enhancement gain is computed by combining the diffuse noise gain, the directional noise gain, and the Kalman based gain. The method reduces different combinations of diverse background noise and increases speech intelligibility, while guaranteeing to preserve the interaural cues of the target speech and directional background noises.

13 Claims, 11 Drawing Sheets

(56) References Cited

OTHER PUBLICATIONS

Van Den Bogaert, et al., "Binaural cue preservation for hearing aids using an interaural transfer function multichannel Wiener filter", IEEE, 2007, pp. 565-568.
Klasen, et al., "Binaural Noise Reduction Algorithms for Hearing Aids that Preserve Interaural Time Delay Cues", IEEE Transactions on Signal Processing, Apr. 2007, pp. 1579-1585, vol. 55, No. 4.
Hohmann, et al., "Binaural Noise Reduction for Hearing Aids", IEEE, 2002, pp. 4000-4003, Medical Physics, University of Oldenburg, Germany.
Doerbecker, et al., "Combination of Two-Channel Spectral Subtraction and Adaptive Wiener Post-Filtering for Noise Reduction and Dereverberation", Proceedings of EUSIPCO 96, Sep. 10, 1996, Trieste, Italy.
Lotter, et al., "Dual-Channel Speech Enhancement by Superdirective Beamforming", EURASIP Journal on Applied Signal Processing, 2005, pp. 1-14, vol. 2006, Article ID 63297, Hindawi Publishing Corporation.
Ephraim, et al., "Speech Enhancement Using a Minimum Mean-Square Error Short-Time Spectral Amplitude Estimator", IEEE Transactions on Acoustics, Speech, and Signal Processing, Dec. 1984, pp. 1109-1121, vol. ASSP-32, No. 6.
Junfeng, et al., "The Improved TS-Base Approaches with Interference Compensation and Their Evaluations for Speech Enhancement", IEEE, 2008, pp. 1-4.

* cited by examiner

METHOD AND SYSTEM FOR A MULTI-MICROPHONE NOISE REDUCTION

BACKGROUND OF THE INVENTION

Field of the Invention

The present invention relates to a method and system for a multi-microphone noise reduction in a complex noisy environment.

The three papers "Advanced Binaural Noise Reduction Scheme For Binaural Hearing Aids Operating In Complex Noisy Environments", "Advanced Binaural Noise Reduction Scheme For Binaural Hearing Aids Operating In Complex Noisy Environments" and "Instantaneous Target Speech Power Spectrum Estimation for Binaural Hearing Aids and Reduction of Directional Non-Stationary Noise with Preservation of Interaural Cues" describe the invention and are part of the application.

The papers describe a preferred embodiment of multi-microphone noise reduction in hearing aids. However, the present application is not limited to hearing aids. The described methods and systems can rather be utilized in connection with other audio devices like headsets, headphones, wireless microphones, etc.

In the near future, new types of high-end hearing aids such as binaural hearing aids will be available. They will allow the use of information/signals received from both left and right hearing aid microphones (via a wireless link) to generate outputs for the left and right ear. Having access to binaural signals for processing can possibly allow overcoming a wider range of noise with highly fluctuating statistics encountered in real-life environments. This paper presents a novel advanced binaural noise reduction scheme for binaural hearing aids operating in complex noisy environments composed of time varying diffuse noise, multiple directional non-stationary noises and reverberant conditions. The proposed scheme can substantially reduce different combinations of diverse background noises and increase speech intelligibility, while guaranteeing to preserve the interaural cues of both the target speech and the directional background noises.

Index Terms—binaural hearing aids, interaural cues preservation, diffuse noise, directional non-stationary noise, transient noise, reduction of reverberation.

Two or three microphone array systems provide great benefits in today's advanced hearing aids. The microphones can be configured in a small endfire array on a single hearing device, which allows the implementation of typical beamforming schemes. Speech enhancement aided by beamforming takes advantage of the spatial diversity of the target speech or noise sources by altering and combining multiple noisy input microphone signals in a way that can significantly reduce background noise and increase speech intelligibility. Unfortunately, due to size constraints only certain hearing device models such as Behind-The-Ear (BTE) can accommodate two or occasionally three microphones. Smaller models such as In-The-Canal (ITC) or In-The-Ear (ITE) only permit the fitting of a single microphone. Consequently, beamforming cannot be applied for such cases and only monaural noise reduction schemes can then be used (i.e. using a single microphone per hearing device), but they are somewhat less effective since spatial information cannot be explored.

Nevertheless, in the near future, new types of high-end hearing aids such as binaural hearing aids will become available. In current bilateral hearing aids, a hearing-impaired person wears a monaural hearing aid on each ear and each monaural hearing aid processes only its own microphone input to generate an output for its corresponding ear. Unlike these current systems, the new binaural hearing aids will allow the sharing and exchange via a wireless link of information or signals received from both the left and right hearing aid microphones, and will also jointly generate outputs for the left and right ears [KAM'08]. As a result, working with a binaural system, new classes of noise reduction schemes as well as new noise power spectrum estimation techniques can be explored. However, the few previous attempts to include binaural processing in hearing aids noise reduction algorithms have not been able to fully achieve the potential for improvement to be granted by such processing. Most multi-microphone noise reduction systems are designed to reduce only a specific type of noise, or they have proved to be efficient against only certain types of noise encountered in an environment. As a result, under difficult practical situations their noise reduction performance will substantially decrease. For instance, in [BOG'07] (which complements the work in [KLA'06] and in several related publications such as [KLA'07],[DOC'05]), a binaural Wiener filtering technique with a modified cost function was developed to specifically reduce directional noise, and also to have some control over the distortion level of the binaural interaural cues for both the speech and noise components. However, the noise reduction performance results reported in [BOG'07] were performed in an environment with a single directional stationary noise in the background. All the statistics of the Wiener filter parameters were estimated offline and strongly relying on an ideal Voice Activity Detector (VAD). As a result, the directional background noise is restrained to be stationary or slowly fluctuating and the noise source should not relocate during speech activity since its characteristics are only computed during speech pauses. Furthermore, it was explained in [KAM'08T] that in order to estimate the statistics of the binaural Wiener filter parameters in [BOG'07] under non-stationary directional noise conditions (such as transient noise or an interfering talker), their technique also requires an ideal spatial classifier (i.e. capable of distinguishing between lateral interfering speech and target speech segments) complementing the ideal VAD. An off-line training period of non-negligible duration is also needed.

In this paper, a new advanced binaural noise reduction scheme is proposed where the binaural hearing aid user is situated in complex noisy environments. The binaural system is composed of one microphone per hearing aid on each side of the head and under the assumption of having a binaural link between the hearing aids. However, the proposed scheme could also be extended to hearing aids having multiple microphones on each side. The proposed scheme can overcome a wider range of noises with highly fluctuating statistics encountered in real-life environments such as a combination of time varying diffuse noise (i.e. babble-noise in a crowded cafeteria), multiple non-stationary directional noises (i.e. interfering speeches, dishes clattering etc.) and all under reverberant conditions.

The proposed binaural noise reduction scheme first relies on the integration of two binaural estimators that we recently developed in [KAM'08] and in [KAM'08T]. In [KAM'08], we introduced an instantaneous binaural diffuse noise PSD estimator designed for binaural hearing aids operating in a diffuse noise field environment such as babble-talk in a crowded cafeteria, with an arbitrary target source direction. This binaural noise Power Spectral Density (PSD) estimator was proven to provide a greater accuracy (and without noise tracking latency) compared to advanced noise spectrum estimation schemes such as in [MAR'01] and [DOE'96].

The second binaural estimator integrated in our proposed binaural noise reduction scheme is the work presented in [KAM'08T], where an instantaneous target speech PSD estimator was developed. This binaural estimator is able to recover a target speech PSD (with a known direction) from received binaural noisy signals corrupted by non-stationary directional interfering noise such as an interfering speech or transient noise (i.e. dishes clattering).

The overall proposed binaural noise reduction scheme is structured into five stages, where two of those stages directly involve the computation of the two binaural estimators previously mentioned. Our proposed scheme does not rely on any voice activity detection, and it does not require the knowledge of the direction of the noise sources. Moreover, our proposed scheme fully preserve the interaural cues of the target speech and any directional background noise. Indeed, it has been reported in the literature that hearing impaired individuals localize sounds better without their bilateral hearing aids (or by having the noise reduction program switched off) than with them. This is due to the fact that current noise reduction schemes implemented in bilateral hearing aids are not designed to preserve localizations cues. As a result, it creates an inconvenience for the hearing aid user. It should also be pointed out that in some cases such as in street traffic, incorrect sound localization may be endangering. Consequently, our proposed noise reduction scheme was designed to fully preserve the interaural cues of the target speech and any directional background noises, therefore the original spatial impression of the environment is maintained.

Our proposed binaural noise reduction scheme will be compared to another advanced binaural noise reduction scheme proposed in [LOT'06] and also to an advanced monaural scheme in [HU'08], in terms of noise reduction and speech intelligibility improvement, evaluated by various objective measures. In [LOT'06], a binaural noise reduction scheme partially based on a Minimum Variance Distortionless Response (MVDR) beamforming concept was developed, more explicitly referred to as a superdirective beamformer with dual-channel input and output, followed by an adaptive post-filter. This scheme can maintain all the interaural cues. In [HU'08], a monaural noise reduction scheme based on geometric spectral subtraction approach was designed. It produces no audible musical noise and possesses similar properties to the traditional Minimum Mean Square Error (MMSE) algorithm such as in [EPH'84].

The paper is organized as follows: Section II will provide the binaural system description, with signal definitions and the description of the complex acoustical environment where the binaural hearing aid user is found. Section III will summarize the five stages constituting the proposed binaural noise reduction scheme. Section IV will detail each stage with their respective algorithm. Section V will present simulation results comparing the work in [LOT'06] and in [HU'08] with our proposed binaural noise reduction scheme, in terms of noise reduction performance and speech intelligibility improvement in a complex noisy environment. Finally, section VI will conclude this work.

Binaural System Description and Complex Acoustical Environment Considered

A. Acoustical Environment

In the acoustical environment considered, the target speaker is in front of the binaural hearing aid user (the case of non-frontal target sources is discussed in a later section). In practice, a signal coming from the front is often considered to be the desired target signal direction, especially in the design of standard directional microphones implemented in hearing aids [HAM'05][PUD'06]. The acoustical environment also has a combination of diverse interfering noises in the background. The interfering noises can include several background directional talkers (i.e. with speech-like characteristics), which often occurs for example when chatting in a crowded cafeteria, with also the additional presence of transient noises such as dishes clattering, hammering sounds in the background, etc. Those types of directional (or localized) noise are characterized as being highly non-stationary and may occur at random instants around the target speaker in real-life environments. In the considered environment, those directional noises can originate anywhere around the binaural hearing aid user, implying that the directions of arrival of the noise sources are arbitrary, however they should differ from the frontal direction, to provide a spatial separation between the target speech and the directional noises.

On top of those various aggregated directional noises, another type of noise also occurring in the background is referred to as diffuse noise, such as an ambient babble-noise in a crowded cafeteria. In the context of binaural hearing aids and considering the situation of a person being in a diffuse noise field environment, the two ears would receive the noise signals propagating from all directions with equal amplitude and a random phase [ABU'04]. In the literature, a diffuse noise field has also been defined as uncorrelated noise sources of equal power propagating in all directions simultaneously [MCC'03]. It should be pointed out that diffuse noise is different from a localized noise source, where a dominant noise source is coming from a specific perceived direction. Most importantly, for a localized noise source or directional noise in contrast to diffuse noise, the noise signals received by the left and right microphones are often highly correlated over most of the frequency content of the noise signals.

B. Binaural System Description

Let l(i), r(i) be the noisy signals received at the left and right hearing aid microphones, defined here in the time domain as:

$$\begin{aligned} l(i) &= s(i) \otimes h_l(i) + n_l(i) \\ &= s_l(i) + n_l(i) \end{aligned} \tag{1}$$

$$\begin{aligned} r(i) &= s(i) \otimes h_r(i) + n_r(i) \\ &= s_r(i) + n_r(i) \end{aligned} \tag{2}$$

where s(i) is the target source, $\otimes$ represents the linear convolution sum operator and i is the sample index. It is assumed that the distance between the target speaker and the two microphones (one placed on each ear) is such that they receive essentially speech through a direct path from the target speaker. This implies that the received target speech left and right signals are highly correlated (i.e. the direct component dominates its reverberation components). Note that although the basic model above assumes the dominance of the direct path from the target source over its reverberant components, the overall system introduced later in this paper is applicable to reverberant environments, as it will be demonstrated. In the context of binaural hearing, $h_l(i)$ and $h_r(i)$ are the left and right head-related impulse responses (HRIRs) between the target speaker and the left and right hearing aid microphones. As a result, $s_l(i)$ is the received left target speech signal. Similarly, $s_r(i)$ is the received right target speech signal. $n_l(i)$ and $n_r(i)$ are the received left and right overall interfering noises signals, respectively (i.e. directional noises+diffuse noise). The left and right noise signals received can be seen as the sum of the left and right noise signals received from several directional noise sources located at different azimuths, implying a specific HRIRs for each directional noise source location, with the addition of diffuse background noise. Since it is assumed for now that the direction of arrival of the target source speech signal is approximately frontal (i.e. the binaural hearing aid user is facing the target speaker) we have:

$$h_l(i)=h_r(i)=h_{(i)} \tag{3}$$

From the above binaural system and signal definitions, the left and right received noisy signals can be represented in the frequency domain as follows:

$$Y_L(\lambda,\omega)=S_L(\lambda,\omega)+N_L(\lambda,\omega) \tag{4}$$

$$Y_R(\lambda,\omega)=S_R(\lambda,\omega)+N_R(\lambda,\omega) \tag{5}$$

It should be noted that each of these signals can be seen as the result of a Fourier transform (i.e. FFT) obtained from a single measured frame of the respective time signals, with $\lambda$ as the frame index and $\omega$ as the angular frequency.

The left and right auto power spectral densities, $\Gamma_{LL}(\lambda,\omega)$ and $\Gamma_{RR}(\lambda,\omega)$, can be expressed as follows:

$$\begin{aligned}\Gamma_{LL}(\lambda,\omega) &= F.T.\{\gamma_{ll}(\tau)\} \\ &= \Gamma_{SS}(\lambda,\omega)|H(\omega)|^2+\Gamma_{N_LN_L}(\lambda,\omega) \\ &= \Gamma_{S_LS_L}(\lambda,\omega)+\Gamma_{N_LN_L}(\lambda,\omega)\end{aligned} \tag{6}$$

$$\begin{aligned}\Gamma_{RR}(\lambda,\omega) &= F.T.\{\gamma_{rr}(\tau)\} \\ &= \Gamma_{SS}(\lambda,\omega)|H(\omega)|^2+\Gamma_{N_RN_R}(\lambda,\omega) \\ &= \Gamma_{S_RS_R}(\lambda,\omega)+\Gamma_{N_RN_R}(\lambda,\omega)\end{aligned} \tag{7}$$

where F.T.{.} is the Fourier Transform and $\gamma_{yx}(\tau)=E[y(i+\tau)\cdot x(i)]$ represents a statistical correlation function.

BRIEF DESCRIPTION OF THE SEVERAL VIEWS OF THE DRAWING

FIG. 1, in partial views

Proposed Binaural Noise Reduction Scheme

Figure 1A:
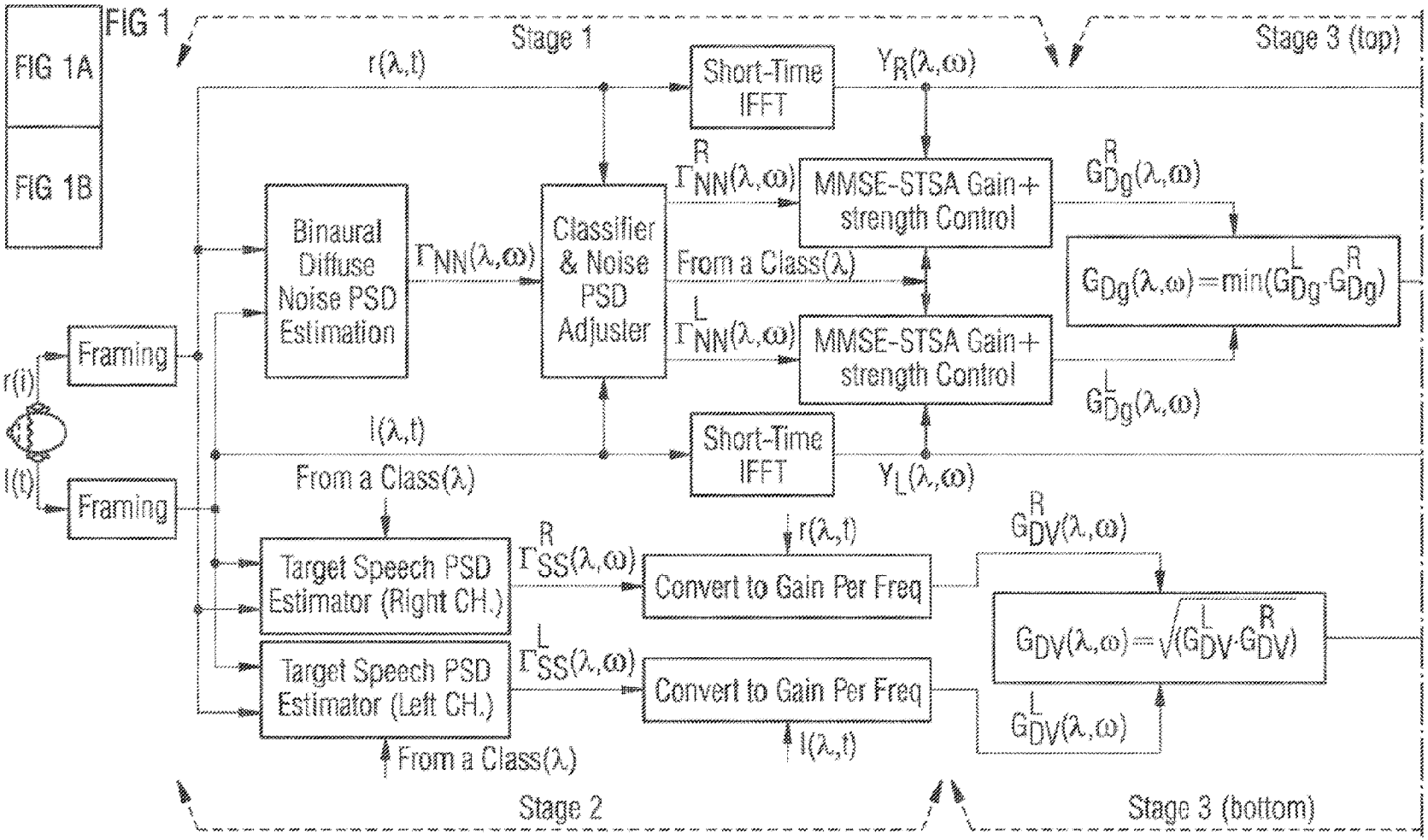
FIG. 1A and FIG. 1B, is a schematic diagram of the binaural noise reduction scheme according to the invention.
Figure 1B:
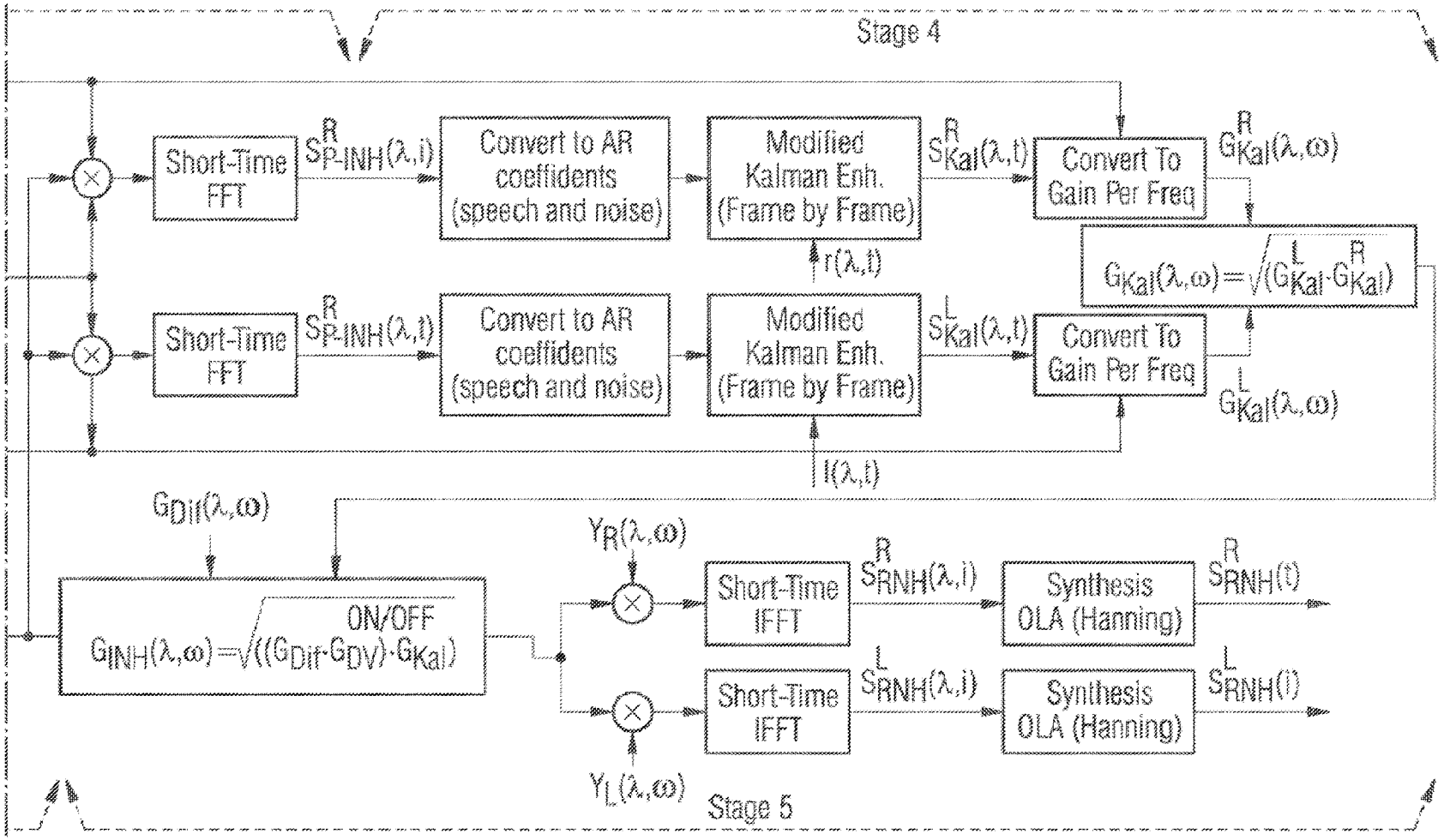

FIG. 1 illustrates the entire structure of the proposed binaural noise reduction scheme. The entire scheme is composed of five stages briefly described as follows.

In the first stage, the Binaural Diffuse Noise PSD Estimator developed in [KAM'08], a classification module and a noise PSD adjuster are used to estimate the left and right noise PSDs for each incoming left and right noisy frames. The noise PSD estimates are then incorporated into a pre-enhancement scheme such as the Minimum Mean Square Short-Time Spectral Amplitude Estimator (MMSE-STSA) developed in [EPH'84] [CAP'94] to produce spectral gains for each respective channel. Those gains are aimed to reduce the presence of diffuse noise and they are referred to as "diffuse noise gains".

In the second stage, the target speech PSD estimator developed in [KAM'08T] is used to extract the target speech PSD (assumed to be frontal for now). Next, the ratio between the target speech PSD estimate and the corresponding noisy input PSD is taken to generate corresponding spectral gains for each respective channel (i.e. left and right) aimed to reduce the directional noises. The resulting spectral gains are referred to as "directional noise gains".

In the third stage, the diffuse noise gains and the directional noise gains are combined (with a weighting rule) and applied to the FFTs of the current left and right noisy input frames. The latter products are then transformed back into the time-domain, resulting into pre-enhanced left and right side frames, which will be used in the fourth stage.

In the fourth stage, the binaural noisy input frames are passed through a modified version of Kalman filtering for colored noise, such as [GAB'05]. The pre-enhanced binaural frames obtained from the third stage are used to calculate the Auto-Regressive (AR) coefficients for the speech and noise models, which are required parameters in the selected Kalman filtering method. Then, similarly to the previous stage, by taking the ratio between the PSDs of the resulting left and right Kalman filtered frames and the original noisy signal PSDs, a new set of spectral gains referred to as "Kalman-based gains" are obtained.

In the fifth and final stage, the diffuse noise gains, the directional noise gains and the Kalman-based gains are combined with a weighting rule to produce the final set of spectral enhancement gains in the proposed binaural noise reduction scheme. Those gains are then applied to the FFTs of the original noisy left and right frames. The latter products are then transformed back into the time-domain, yielding the final enhanced left and right frames. Most importantly, the same set of spectral gains (which are also real-valued i.e. they do not introduce varying group delays between frequencies) are applied to both the left and right noisy input FFTs, to ensure the preservation of Interaural Time Differences (ITDs) and Interaural Level Differences (ILDs) in the enhanced signals, similarly to the approach taken in [LOT'06]. This will avoid spatial distortion (i.e. guarantees preservation of all interaural cues).

Description of Each Stage of the Proposed Scheme

In this section, the five stages constituting the proposed binaural noise reduction scheme will be explained in details.

The left and right signals are decomposed into frames of size D (referred to as binaural noisy input frames) with 50% overlap. The left noisy frames are denoted by $l(\lambda,i)$ and the right noisy frames are denoted by $r(\lambda,i)$, $l(\lambda,i)$ and $r(\lambda,i)$ are the inputs of each stage. The PSD estimates of $l(\lambda,i)$ and $r(\lambda,i)$ were calculated using Welch's method with a Hanning data window. However, except for the computation of these PSD estimates, no segmentation or windowing is performed on the input data.

A. Stage 1

First, the Binaural Diffuse Noise PSD Estimator proposed in [KAM'08] is then applied using the binaural noisy input frames (i.e. $l(\lambda,i)$ and $r(\lambda,i)$) to estimate the diffuse background noise PSD, $\Gamma_{NN}(\lambda,\omega)$, present in the environment. The Binaural Diffuse Noise PSD Estimator algorithm in [KAM'08] is summarized in Table 1. It should be noted that in Table 1, the algorithm requires to first estimate $h_w(\lambda,i)$, which is a Wiener filter that predicts the current left noisy input frame $l(\lambda,i)$ using the current right noisy input frame $r(\lambda,i)$ as a reference. The Wiener filter coefficients were estimated using a least-squares approach with 80 coefficients, with a causality delay of 40 samples.

Secondly, $l(\lambda,i)$, $r(\lambda,i)$ and $r_{NN}(\lambda,\omega)$ are fed to a block entitled "Classifier & Noise PSD Adjuster" as shown in FIG. 1. The function of this block is to further alter/update the previous diffuse noise PSD estimate $\Gamma_{NN}(\lambda,\omega)$, and to produce distinct left and right noise PSD estimates $\Gamma_{NN}^{L}(\lambda,\omega)$ and $\delta_{NN}^{R}(\lambda,\omega)$ respectively, as illustrated in FIG. 1. The Classifier & noise PSD adjuster block is described as follows:

It first computes the interaural coherence magnitude, $0 \le C_{LR}(\omega) \le 1$ between the left and right input noisy signals defined as:

$$C_{LR}(\omega) = \frac{|\Gamma_{LR}(\omega)|^2}{\Gamma_{LL}(\omega)\cdot\Gamma_{RR}(\omega)} \tag{8}$$

Then, the mean coherence over a selected bandwidth is computed and it is expressed as:

$$\overline{C_{LR}} = \frac{1}{BW}\int_{BW} C_{LR}(\omega)d\omega \tag{9}$$

where BW is the selected bandwidth. The bandwidth selected should at least cover a speech signal spectrum (e.g. 300 Hz to 6 kHz) since it is applied for a hearing aid application.

Furthermore, the noise PSD estimation of the current frame is initialized to the estimate returned by the binaural diffuse noise PSD estimator, that is $\Gamma_{NN}^{R}(\lambda,\omega)=\Gamma_{NN}(\lambda,\omega)$ for the right channel and $\Gamma_{NN}^{L}(\lambda,\omega)=\Gamma_{NN}(\lambda,\omega)$ for the left channel. The result obtained using (8) will be used to find the frequencies where the coherence magnitude is below a very low coherence threshold referred to as Th_Coh_vl. The noise PSD adjuster will increase the initial noise PSD estimate to the level of the noisy input PSD at those frequencies. This implies that only incoherent noise is present at those frequencies. Next, the Classifier will use the result of (9) to help classify the binaural noisy input frames received as diffuse noise-only frames or frames also carrying target speech content and/or directional noise. The two possible outcomes for the Classifier are evaluated as follows:

a) A frame is classified as carrying only diffuse noise if there is a low correlation between the left and right received signals over most of the frequency spectrum. In a speech application, only frequencies relevant to speech content are considered important. Therefore, only a low average correlation over those frequencies will classify the frame as diffuse noise. Analytically, the frame containing only diffuse noise is found by taking the average coherence over typical speech bandwidth using (9) and the result should be below a selected low threshold Th_Coh. If it is the case, then the value of the variable FrameClass is set to 0. In this case, the Noise PSD Adjuster takes the initial noise PSD estimate and increases it close to the input noisy PSD of the corresponding frame being processed. More precisely, the adjusted noise PSD estimation is set equal to the geometric mean between the initial noise PSD estimate and the input noisy PSD. The input noisy PSD could also be weighted.

b) A frame is classified as not-diffuse noise if there is a significant correlation between the left and right received signals. This implies that the frame may also contain (on top of some diffuse noise) some target speech content and/or directional background noise such as interfering talker/transient noise. FrameClass is then set to 1 if the average coherence over the speech bandwidth using (9) is above Th_Coh. In this case, the Noise PSD Adjuster will not make any further adjustments in order to be on the conservative side, even though this frame might only contain directional interfering noise. But this will be taken into account in Stage 2.

It is often beneficial to extend a classification period over several frames. For instance, if a frame has been classified as not-diffuse noise, it might then contain target speech content. Therefore, in that case it is safer to force the forthcoming frames to be also classified as not-diffuse noise frames, overruling the actual instantaneous classification result. Table 2 summarizes the "Classifier & Noise PSD Adjuster" block.

Finally, the last step of stage 1 is to integrate the left and right noise PSDs (i.e. outputs of the "Classifier & Noise PSD Adjuster" block) into a Minimum Mean Square Short-Time Spectral Amplitude Estimator (MMSE-STSA). Table 3 summarizes the MMSE-STSA algorithm proposed in [EPH'84]. The latter is a SNR-type amplitude estimator speech enhancement scheme (monaural), which is known to produce low musical noise distortion [CAP'94]. Applying the MMSE-STSA scheme to each channel with its corresponding noise PSD estimate obtained from the output of the Noise PSD Adjuster (i.e. $\Gamma_{NN}^{L}(\lambda,\omega)$ for left channel and $\Gamma_{NN}^{R}(\lambda,\omega)$ for the right channel), real-valued spectral enhancement gains are then obtained. They are denoted by $G_{Diff}^{L}(\lambda,\omega)$ for the left channel and by $G_{Diff}^{R}(\lambda,\omega)$ for the right channel. Those gains are aimed to reduce diffuse noise if it is present (and for reverberant environments they also help reducing the tail of reverberation causing diffuseness). $G_{Diff}^{L}(\lambda,\omega)$ and $G_{Diff}^{R}(\lambda,\omega)$ are referred to as "diffuse noise gains". A strength control is also applied to control the level of noise reduction by not letting the spectral gains drop below a minimum gain, $g_{MIN_ST1}(\lambda)$. This noise reduction strength control is incorporated as follows:

$$G_{Diff}^{j}(\lambda,\omega)=\max(G_{Diff}^{j}(\lambda,\omega),g_{MIN_ST1}(\lambda)),j=L \text{ or } R \tag{10}$$

where j corresponds to either the left channel (i.e. j=L) or the right channel (i.e. j=R).

B. Stage 2

The goal of Stage 2 is to find spectral enhancement gains which will remove lateral noises. Similar to the first stage, the Instantaneous Target Speech PSD Estimator proposed in [KAM'08T] is applied according to the frame classification output FrameClass(λ). The Instantaneous Target Speech PSD Estimator algorithm is summarized in Table 4. This estimator is designed to extract on a frame-by-frame basis the target speech PSD corrupted by lateral interfering noise with possibly highly non-stationary characteristics. The Instantaneous Target Speech PSD Estimator is applied to each channel (i.e. to the left and right noisy input frames). The target speech PSD estimate obtained from the left noisy input frame is referred to as $\Gamma_{SS}^{L}(\lambda,\omega)$ and the estimate from the right noisy input frame is referred to as $\Gamma_{SS}^{R}(\lambda,\omega)$. It should be noted that in Table 3, the algorithm requires to first estimate $h_w^L(\lambda,i)$ and $h_w^R(\lambda,i)\cdot h_w^L(\lambda,i)$ is a Wiener filter that predicts the current right noisy input frame $r(\lambda,i)$ using the left current input noisy frame $l(\lambda, i)$ as a reference. Reciprocally, $h_w^R(\lambda,i)$ is a Wiener filter that predicts the current left noisy input frame $l(\lambda,i)$ using the right current input noisy frame $r(\lambda,i)$ as a reference. The Wiener filter coefficients were estimated using a least-squares approach with 150 coefficients, with a causality delay of 60 samples, since directional noise can emerge from either side of the binaural hearing aids user.

The next step is to convert the target speech PSD estimates computed above into real-valued spectral gains aimed for directional noise reduction, illustrated by the block entitled "Convert To Gain Per Freq" depicted in FIG. 1. The conversion into spectral gains is performed in order to ease the control of the noise reduction strength by allowing spectral flooring, as done in stage 1 for the diffuse noise gains. In addition, it will permit to easily combine all the gains from the different stages, which will be done in stage 5. In this stage, the corresponding left and right spectral gains referred to as "directional noise gains" are defined as follows:

$$G_{Dir}^{L}(\lambda,\omega)=\min\left(\sqrt{\frac{\Gamma_{SS}^{L}(\lambda,\omega)}{\Gamma_{LL}(\lambda,\omega)}},1\right) \tag{11}$$

$$G_{Dir}^{R}(\lambda,\omega)=\min\left(\sqrt{\frac{\Gamma_{SS}^{R}(\lambda,\omega)}{\Gamma_{RR}(\lambda,\omega)}},1\right) \tag{12}$$

It should be noted that the spectral gains in (11) and (12) are upper-limited to one to prevent amplification due to the division operator.

C. Stage 3

The objective of the third stage is to provide pre-enhanced binaural output frames with interaural cues preservation to Stage 4 (i.e. preserving the ILDs and ITDs for the both the target speech and directional noises). First, the left and right spectral gains $G_{Diff}^{L}(\lambda,\omega)$ and $G_{Diff}^{R}(\lambda,\omega)$ obtained from the output of Stage 1 are combined into a single real-valued gain per frequency as follows:

$$G_{Diffuse}(\lambda,\omega)=\min(G_{Diff}^{L}(\lambda,\omega),G_{Diff}^{R}(\lambda,\omega)) \tag{13}$$

Secondly, the left and right directional gains obtained from the Stage 2 are also combined into a single real-valued gain per frequency as follows:

$$G_{Dir}(\lambda,\omega)=\sqrt{G_{Dir}^{L}(\lambda,\omega)\cdot G_{Dir}^{R}(\lambda,\omega)} \tag{14}$$

Finally, the gains from Stages 1 and 2 are then combined as follows:

$$G_{Diffuse}(\lambda,\omega)=\max(G_{Diffuse}(\lambda,\omega)\cdot G_{Dir}(\lambda,\omega),g_{MIN_ST3}(\lambda)) \tag{15}$$

where a strength control is applied again to control the level of noise reduction, by not allowing the spectral gains to drop below a minimum selected gain referred to as $g_{MIN\ ST3}(\lambda)$.

This real-valued spectral gain above will be applied to both the left and right noisy input frames to produce the corresponding pre-enhanced binaural output frames as follows:

$$s_{P\text{-}ENH}^{j}(\lambda,i)=IFFT(G_{Diffuse_Dir}(\lambda,\omega)\cdot Y_j(\lambda,\omega)),j=R \text{ or } L \tag{16}$$

where j=L corresponds to the left frame and j=R corresponds to the right frame. As previously mentioned, applying a unique real-valued gain to both channels will ensure the preservation of ITDs and ILDs for both the target speech and the remaining directional noises in the enhanced signals (i.e. no spatial cues distortion).

D. Stage 4

In Stage 4, another category of monaural speech enhancement algorithm known as Kalman filtering is performed. In contrast to the MMSE-STSA algorithm performed in Stage 1, Kalman filtering based methods are model-based oriented, starting from the state-space formulation of a linear dynamical system, and they offer a recursive solution to linear optimal filtering problems [HAY'01]. Kalman filtering based methods operate usually in two parts: first, the driving process statistics (i.e. the noise and the speech model parameters) are estimated, then secondly, the speech estimation is performed by using Kalman filtering. These approaches vary essentially by the choice of the method used to estimate and to update the different model parameters for the speech and the additive noise [GAB'04].

In this paper, the Kalman filtering algorithm examined is a modified version of the Kalman Filtering for colored noise proposed in [GAB'05]. In [GAB'05], the Kalman filter uses an Auto-Regressive (AR) model for the target speech signal but also for the noise signal. The speech signal and the colored additive noise (for each channel) are individually modeled as two Auto-Regressive (AR) processes with orders p and q respectively:

$$s_j(i)=\sum_{k=1}^{p}a_k^j\cdot s_j(i-k)+u_j(i) \tag{17}$$

$$n_j(i)=\sum_{k=1}^{q}b_k^j\cdot n_j(i-k)+w_j(i) \tag{18}$$

where $\alpha_k^j$ is the $k^{th}$ AR speech model coefficient and $g_k^j$ is the $k^{th}$ AR noise model coefficient, and j corresponds to either the left frame (i.e. j=L) or the right frame (i.e. j=R). $u_j(i)$ and $w_j(i)$ are uncorrelated Gaussian white noise sequences with zeros means and variances $(\sigma_u^j)^2$ and $(\sigma_w^j)^2$ respectively. More specifically, $u_j(e)$ and $w_j(i)$ are referred to as the model driving noise processes (not to be confused with the colored additive acoustic noise i.e. $n_j(i)$ as in equations (1) and (2)).

In this work, the Kalman filtering scheme in [GAB'05] was modified to operate on a frame-by-frame basis. All the parameters are frame index dependent (i.e. $\lambda$) and the AR models and driving noise processes are updated on a frame-by-frame basis as well (i.e. $\alpha_k^j(\lambda)$ and $b_k^j(\lambda)$). Since in practice the clean speech and noise signals of each channel are not separately available (i.e. only the sum of those two signals are available for the left and right frames i.e. $l(\lambda,i)$ and $r(\lambda,i)$), the AR coefficients for the left and right target clean speech models in equation (17) are found by applying Linear Predictive Coding (LPC) to the left and right pre-enhanced frames obtained from the outputs of the Stage 3 referred to as $s_{P\text{-}ENH}^{L}$ and $s_{P\text{-}ENH}^{R}$ respectively. The AR coefficients for the noise models in equation (18) are evaluated by applying LPC on the estimated noise signals extracted from the left and right input noisy frames. The noise signals for each channel are extracted using the pre-enhanced frames as follows:

$$n_{P\text{-}ENH}^{L}(\lambda,i)=l(\lambda,i)-s_{P\text{-}ENH}^{L}(\lambda,i) \tag{19}$$

$$n_{P\ ENH}^{R}(\lambda,i)=r(\lambda,i)-s_{P\ ENH}^{R}(\lambda,i) \tag{20}$$

The AR coefficients are then used to find the driving noise processes in (17) and (18) by computing the LPC residuals (also known as the prediction errors) defined as follows:

$$\hat{u}_j(\lambda, i) = s^j_{P-ENH}(i) - \sum_{k=1}^{p} a^j_k(\lambda) \cdot s^j_{P-ENH}(k-i), \quad i = 0, 1, \ldots, D-1 \tag{21}$$

$$\hat{w}_j(\lambda, i) = n^j_{P-ENH}(i) - \sum_{k=1}^{q} b^j_k(\lambda) \cdot n^j_{P-ENH}(k-i), \quad i = 0, 1, \ldots, D-1 \tag{22}$$

After having obtained the required AR coefficients and correlation statistics from the corresponding driving noise sequences for the speech and noise models for each channel, Kalman filtering is then applied to the left and right noisy input frames, producing the left and right enhanced output frames (i.e. Kalman filtered frames) referred to as $s_{kal}^L(\lambda,i)$ and $s_{Kal}^R(\lambda,i)$ respectively. Table 5 summarizes the modified Kalman filtering algorithm for colored noise proposed in [GAB'05], where $A^j$ represents the augmented state matrix structured as:

$$A^j(\lambda) = \begin{bmatrix} A^j_s(\lambda) & 0_{p\times p} \\ 0_{q\times q} & A^j_n(\lambda) \end{bmatrix}, \tag{23}$$

$A_s^j$ corresponds to the clean speech transition matrix expressed as:

$$A^j_s(\lambda) = \begin{bmatrix} 0 & 1 & 0 & \ldots & 0 \\ 0 & 0 & 1 & \ldots & 0 \\ \vdots & \vdots & \vdots & \ddots & \vdots \\ 0 & 0 & 0 & \ldots & 1 \\ a^j_p & a^j_{p-1} & a^j_{p-2} & \ldots & a^j_1 \end{bmatrix}, \tag{24}$$

$A_n^j$ corresponds to the noise transition matrix expressed as:

$$A^j_n(\lambda) = \begin{bmatrix} 0 & 1 & 0 & \ldots & 0 \\ 0 & 0 & 1 & \ldots & 0 \\ \vdots & \vdots & \vdots & \ddots & \vdots \\ 0 & 0 & 0 & \ldots & 1 \\ b^j_q & b^j_{q-1} & b^j_{q-2} & \ldots & b^j_1 \end{bmatrix}, \tag{25}$$

$Q_j(\lambda)$ corresponds to the driving process correlation matrix computed as:

$$Q_j(\lambda) = \begin{bmatrix} 0 & \ldots & 0 & 0 & 0 & \ldots & 0 & 0 \\ \vdots & & \vdots & \vdots & & & \vdots & \vdots \\ 0_{p,1} & \ldots & 0_{p,p-1} & E(u_j(i)\cdot u_j(i)) & 0_{p,p+1} & \ldots & 0_{p,p+q-1} & E(u_j(i)\cdot w_j(i)) \\ \vdots & & \vdots & \vdots & & & \vdots & \vdots \\ 0_{p+q,1} & \ldots & 0_{p+q,p-1} & E(w_j(i)\cdot u_j(i)) & 0_{p+q,p+1} & \ldots & 0_{p+q,p+q-1} & E(w_j(i)\cdot w_j(i)) \end{bmatrix} \tag{26}$$

Theoretically, since the target speech signal and the interfering noise signal are statically uncorrelated, the driving noise processes from the speech and noise models in (17) and (18) should be uncorrelated. This implies that the cross terms in (26) (i.e. $E(u_j(i)\cdot w_j(i))$ and $E(w_j(i)\cdot u_j(i))$) could be assumed to be zero. However, those assumptions do not generally hold true. In a speech application, only short-time estimations are used due to the non-stationary nature of a speech signal. Also, to compute the AR coefficients of the target speech and noise, only estimates of target speech and noise signals are accessible in practice (i.e. herein the estimates were obtained using (16) and (19)-(20)). Therefore, $s_{P-ENH}^j(\lambda,i)$ still contains some residual noise and reciprocally, $n_{P-ENH}^j(\lambda,i)$ still contains some residual target speech signal. Consequently, those residuals will be also reflected in the computation of the driving noise processes (i.e. obtained from prediction errors using (21) and (22)), causing non-negligible cross terms due to their correlation. In this work, the cross terms were estimated using (21) and (22) (assuming short-time stationary and ergotic processes) as follows:

$$E(u_j(i)\cdot w_j(i)) \approx \frac{1}{D}\sum_{i=0}^{D-1} \hat{u}_j(\lambda, i)\cdot \hat{w}_j(\lambda, i) \tag{27}$$

$E(u_j(i)\cdot u_j(i))$ and $E(w_j(i)\cdot w_j(i))$ are also approximated in a similar way as above.

Still in Table 5, $\hat{z}_j(\lambda,i/i)$ is the filtered estimate of $z_j(\lambda,i)$, and they are (p+g) by 1 augmented state vectors formulated as:

$$z_j(\lambda,i)=[s_j(\lambda,i-p+1), \ldots, s_j(\lambda,i), n_j(\lambda,i-q+1), \ldots, n_j(\lambda,i)]^T \tag{28}$$

$$\hat{z}_j(\lambda,i)=[\hat{s}_j(\lambda,i-p+1), \ldots, \hat{s}_j(\lambda,i), \hat{n}_j(\lambda,i-q+1), \ldots, \hat{n}_j(\lambda,i)]^T \tag{29}$$

$\hat{z}_j(\lambda,i/i-1)$ is the minimum mean-square estimate of the state vector $z_j(\lambda,i)$ given the past observations y(1), . . . , y(i−1). $P(\lambda,i/i-1)$ is the predicted (a priori) state-error covariance matrix, $P(\lambda,i/i)$ is the filtered state-error covariance matrix, $e(\lambda,i)$ is the innovation sequence and finally, $K(\lambda,i)$ is the Kalman gain.

The enhanced speech signal at frame index λ and at time index i (i.e. $s_{Kal}^j(\lambda,i)=\hat{s}_j(\lambda,i)$) can be obtained from the $p^{th}$ component of the state-vector estimator, i.e. $\hat{z}(\lambda i/i)$, which can be considered as the output of the Kalman filter. However, in [PAL'87] it was observed that at time instant i, the first component of $\hat{z}(i/i)$ (i.e. $\hat{s}(i-p+1)$) yields a better estimate of the speech signal for a previous time index i−p+1, since this estimate is based on p−1 additional observations (i.e. y(i−p+2), . . . , y(i)). Consequently, the best estimate of $s_j(i)$ is obtained at time index 1+p−1. This approach delays the retrieval of $\hat{s}_j(i)$ until the time index i+p−1 is reached (i.e. a lag of p−1 samples). In [PAL'87], this approach is referred to as the delayed Kalman filter, which was also used in our work.

Furthermore, as previously mentioned, we designed our Kalman filter to operate on a frame-by-frame basis with 50% overlap, and by also having the AR coefficients updated on a frame-by-frame basis. Therefore, for each noisy input frame received, the state space vector $z_j(\lambda,i)$ and the predicted state-error covariance matrix $P(\lambda i/i-1)$ were initialized (i.e. at sample index i=0) with their respective values obtained at sample index i=D/2−1 from frame index λ−1.

Similar to Stage 2, the next step is to convert the Kalman filtering results into corresponding real-valued spectral gains. The spectral gains in this stage are referred to as Kalman-based gains and are obtained by taking the ratio between the Kalman filtered frames PSDs and the corresponding input noisy PSDs. The left and right Kalman-based gains are defined as follows:

$$G_{Kal}^{L}(\lambda,\omega)=\min\left(\sqrt{\frac{\Gamma_{S_{Kal}S_{Kal}}^{L}(\lambda,\omega)}{\Gamma_{LL}(\lambda,\omega)}},1\right) \tag{30}$$

$$G_{Kal}^{R}(\lambda,\omega)=\min\left(\sqrt{\frac{\Gamma_{S_{Kal}S_{Kal}}^{R}(\lambda,\omega)}{\Gamma_{RR}(\lambda,\omega)}},1\right) \tag{31}$$

where $\Gamma_{S_{Kal}S_{Kal}}^{L}(\lambda,\omega)$ and $\Gamma_{S_{Kal}S_{Kal}}^{R}(\lambda,\omega)$ are the PSDs of the left and right Kalman filtered frames $s_{Kal}^{L}(\lambda,i)$ and $s_{Kal}^{R}(\lambda,i)$ respectively.

E. Stage 5

In the fifth and final stage, the spectral gains designed in all the stages (i.e. the diffuse noise gains, the directional noise gains and the Kalman-based gains) are weighted and combined to produce the final set of spectral enhancement gains for the proposed binaural enhancement structure. The final enhancement real-valued spectral gains are computed as follows:

$$G_{ENH}(\lambda,\omega)=\max\left(\sqrt{\left(\begin{matrix}(G_{Diff}(\lambda,\omega)\cdot G_{Dir}(\lambda,\omega))\cdot\\ G_{Kal}(\lambda,\omega)\end{matrix}\right)},g_{MIN_STS}(\lambda)\right) \tag{32}$$

where $G_{Kal}(\lambda,\omega)$ is obtained from the left and right Kalman-based gains at the output of Stage 4 combined into a single real-valued gain per frequency as follows:

$$G_{Kal}(\lambda,\omega)=\sqrt{G_{Kal}^{L}(\lambda,\omega)\cdot G_{Kal}^{R}(\lambda,\omega)} \tag{33}$$

and $g_{min\ ST5}(\lambda)$ is a minimum spectral gain floor.

Finally, the enhancement gains are then applied to the short-time FFTs of the original noisy left and right frames. The latter products are then transformed back into the time-domain (i.e. inverse FFT) yielding the left and right enhanced output frames of the proposed binaural noise reduction scheme as follows:

$$x_{ENH}^{j}(\lambda,i)=IFFT(G_{ENH}(\lambda,\omega)\cdot Y_j(\lambda,\omega)),j=R \text{ or } L \tag{34}$$

In this final stage, having a common real-valued enhancement spectral gain as computed in (32) and applied to both channels will ensure that no frequency dependent phase shift (group delay) is introduced, and that the interaural cues of all directional sources are preserved.

F. Case of Non-Frontal Target Source

So far a frontal target source has been assumed in the developments of the proposed method, which as previously mentioned is a realistic and commonly used assumption for hearing aids. In the case of a non-frontal target source, the only step in our proposed scheme that that would require a modification is at Stage 2. Stage 2 is designed to remove lateral interfering noises using the target speech PSD estimator proposed in [KAM'08T] under the assumption of a frontal target. In [KAM'08T], it was explained that it is possible to slightly modify the algorithm in Table 4 to take into account a non-frontal target source. Essentially, the algorithm in Table 4 would remain the same except that the left and right input frames (i.e. $l(\lambda,i)$ and $r(\lambda,i)$) would be pre-adjusted before applying the algorithm. The algorithm would then essentially require to know the direction of arrival of the non-frontal target source, or more specifically the ratio between the left and right HRTFs for the non-frontal target (perhaps from a model and based on the direction of arrival). More details can be found in [KAM'08T].

Simulation Results

In the first subsection, a complex hearing scenario will be described followed by the simulation setup for each noise reduction scheme. The second subsection will briefly explain the various performance measures used in this section. Finally, the last subsection will present the results for our proposed binaural noise reduction scheme detailed in Section III, compared with the binaural noise reduction scheme in [LOT'06] and the monaural noise reduction scheme in [HU'08] (combined with the monaural noise PSD estimation in [MAR'01]).

A. Simulation Setup and Selected Complex Hearing Situation

The following is the description of the simulated complex hearing scenario. It should be noted that all data used in the simulations such as the binaural speech signals and the binaural noise signals were provided by a hearing aid manufacturer and obtained from "Behind The Ear" (BTE) hearing aids microphone recordings, with hearing aids installed at the left and the right ears of a KEMAR dummy head. For instance, the dummy head was rotated at different positions to receive speech signals at diverse azimuths, and the source speech signal was produced by a loudspeaker at 0.75-1.50 meters from the KEMAR. The KEMAR had been installed in different noisy environments to collect real life noise-only data. All the signals used were recorded in a reverberant environment with an average reverberation time of 1.76 sec. Speech and noise sources were recorded separately. The signals fed to the noise reduction schemes were 8.5 seconds in length.

Scenario:

a female target speaker is in front of the binaural hearing aid user (at 0.75 m from the hearing aid user), with two male lateral interfering talkers at 270° and 120° azimuths respectively (both at 1.5 m from the hearing aid user), with transient noises (i.e. dishes clattering) at 330° azimuth and time-varying diffuse-like babble noise from crowded cafeteria recordings added in the background. It should be noted that all the speech signals are occurring simultaneously and the dishes are clattering several times in the background during the speech conversation. Moreover, the power level of the original babble-noise coming from a cafeteria recording was purposely abruptly increased by 12 dB at 4.25 secs to simulate even more non-stationary noise conditions, which could be encountered for example if the hearing aid user is entering a noisy cafeteria.

The performance of each considered enhancement or denoising scheme will be evaluated using this acoustic scenario at three different overall input SNRs varying from about −13.5 dB to 4.6 dB. For simplicity, the Proposed Binaural Noise Reduction scheme will be given the acronym PBNR. The Binaural Superdirective Beamformer with and without Post-filtering noise reduction scheme in [LOT'06] will be given the acronyms BSBp and BSB respectively. The monaural noise reduction scheme proposed in [HU'08] based on geometric approach spectral subtraction will be given the acronym GeoSP.

For all the simulations, the results were obtained on a frame-by-frame basis with D=25.6 ms of frame length and 50% overlap. A FFT-size of N=512 and a sampling frequency of fs=20 kHz were used. For the BSBp, BSB and GeoSP schemes, a Hanning window was applied to each binaural input frames. After processing each frame, the left and right enhanced signals were reconstructed using the Overlap-and-Add (OLA) method. For the PBNR scheme, the left and right enhancement frames obtained from the output of Stage 5 were windowed using Hanning coefficients and then synthesized using the OLA method. The reason for not applying windowing to the binaural input frames for the PBNR scheme is because the implementation of Welch's method that the PBNR scheme uses for PSD computations already involves a windowing operation. The spectral gain floors were set to 0.35 (i.e. $g_{MIN_{ST1}}(\lambda)=0.35$) for Stage 1 and 0.1 for Stages 2 to 5. Moreover, the GeoSP scheme requires a noise PSD estimation prior to enhancement, and the monaural noise PSD estimation based on minimum statistics in [MAR'01] was used to update the noise spectrum estimate. The GeoSP algorithm was slightly modified by applying to the enhancement spectral gain a spectral floor gain set to 0.35, to reduce the noise reduction strength. Both results (i.e. with and without spectral flooring) will be presented. The result with spectral flooring will be referred to as GeoSPo.35.

B. Objective Performance Measures

Various types of objective measures such as the Signal-to-Noise Ratio (SNR), the Segmental SNR (segSNR), the Perceptual Similarity Measure (PSM) and the Coherence Speech Intelligibility Index (CSII) were used to evaluate the noise reduction performance of each considered scheme. In addition, three objective measures referred to as composite objective measures were also used to evaluate and compare the noise reduction schemes. They are referred to as the predicted rating of speech distortion (Csig), the predicted rating of background noise intrusiveness (Cbak) and the predicted rating of overall quality (Covl) as proposed in [HU'06].

PSM was proposed in [HUB'06] to estimate the perceptual similarity between the processed signal and the clean speech signal, in a way similar to the Perceptual Evaluation of Speech Quality (PESQ) [ITU'01]. PESQ was optimized for speech quality however, while PSM is also applicable to processed music and transients, thus also providing a prediction of perceived quality degradation for wideband audio signals [HUB'06], [ROH'05]. PSM has demonstrated high correlations between objective and subjective data and it has been used for quality assessment of noise reductions algorithms in [ROH'07],[ROH'05]. In terms of noise reduction evaluation, PSM is first obtained by using the unprocessed noisy signal and the target speech signal, and then by using the processed "enhanced" signal with the target speech signal. The difference between the two PSM results (referred to as ΔPSM) provides a noise reduction performance measure. A positive ΔPSM value indicates a higher quality obtained from the processed signal compared to the unprocessed one, whereas a negative value implies signal deterioration.

CSII was proposed in [KAT'05] as the extension of the speech intelligibility index (SII), which estimates speech intelligibility under conditions of additive stationary noise or bandwidth reduction. CSII further extends the SII concept to also estimate intelligibility in the occurrence of non-linear distortions such as broadband peak-clipping and center-clipping. To relate to our work, the non-linear distortion can also be caused by the result of de-noising or speech enhancement algorithms. The method first partitions the speech input signal into three amplitude regions (low-, mid- and high-level regions). The CSII calculation is performed on each region (referred to as the three-level CSII) as follows: Each region is divided into short overlapping time segments of 16 ms to better consider fluctuating noise conditions. Then the signal-to-distortion ratio (SDR) of each segment is estimated, as opposed to the standard SNR estimate in the SII computation. The SDR is obtained using the mean-squared coherence function. The CSII result for each region is based on the weighed sum of the SDRs across the frequencies, similar to the frequency weighted SNR in the SII computation. Finally, the intelligibility is estimated from a linear weighted combination of the CSII results gathered from each region. It is stated in [KAT'05] that applying the three-level CSII approach and the fact that the SNR is replaced by the SDR provide much more information about the effects of the distortion on the speech signal. CSII provides a score between 0 and 1. A score of "1" represents a perfect intelligibility and a score of "0" represents a completely unintelligible signal.

The composite measures Csig, Cbak and Covl proposed in [HU'06] were obtained by combining numerous existing objective measures using nonlinear and nonparametric regression models, which provided much higher correlations with subjective judgments of speech quality and speech/noise distortions than conventional objective measures. For instance, the composite measure Csig is obtained by weighting and combining the Weighted-Slope Spectral (WSS) distance, the Log Likelihood Ratio (LLR) [HAN'08] and the PESQ. Csig is represented by a five-point scale as follows: 5—very natural, no degradation, 4—fairly natural, little degradation, 3—somewhat natural, somewhat degraded, 2—fairly unnatural, fairly degraded, 1—very unnatural, very degraded. Cbak combines segSNR, PESQ and WSS. Cbak is represented by a five-point scale of background intrusiveness as follows: 5—Not noticeable, 4—Somewhat noticeable, 3—Noticeable but not intrusive, 2—Fairly conspicuous, somewhat intrusive, 1—Very conspicuous, very intrusive. Finally, Covl combines PESQ, LLR and WSS. It uses the scale of the mean opinion score (MOS) as follows: 5—Excellent, 4—Good, 3—Fair, 2—Poor, 1—Bad.

It should be noted that recent updated composite measures were proposed in [HU'082nd], further extending the results in [HU'06] in terms of objective measure selections and weighting rules. However, they were not employed in this work since the updated composite measures were selected and optimized in environments with higher SNR/PESQ levels than the SNR/PESQ levels in this work. Therefore, the composite measures from [HU'06] were still used. Moreover, the correlation of composite measures with subjective results were also optimized for signals sampled at 8 kHz. Therefore, in our work, the simulation signals (after processing) were downsampled from 20 kHz to 8 kHz to properly get the assessments from those Csig, Cbak and Covl composite measures. However, the remaining objective measures can be applied for wideband speech signals at a sampling frequency of 20 kHz, except for the CSII where all the signals were downsampled to 16 kHz.

To sum up, the Covl and PSM measures will provide feedback regarding the overall quality of the signal after processing, Cbak will provide feedback about the distortions that affect the background noise (i.e. noise distortion/noise intrusiveness), Csig will give information about the distortions that impinges on the target speech signal itself (i.e. signal distortion), whereas the CSII measure will indicate the potential speech intelligibility improvement of the processed speech versus the noisy unprocessed speech signal.

C. Results and Discussion

Figure 2:
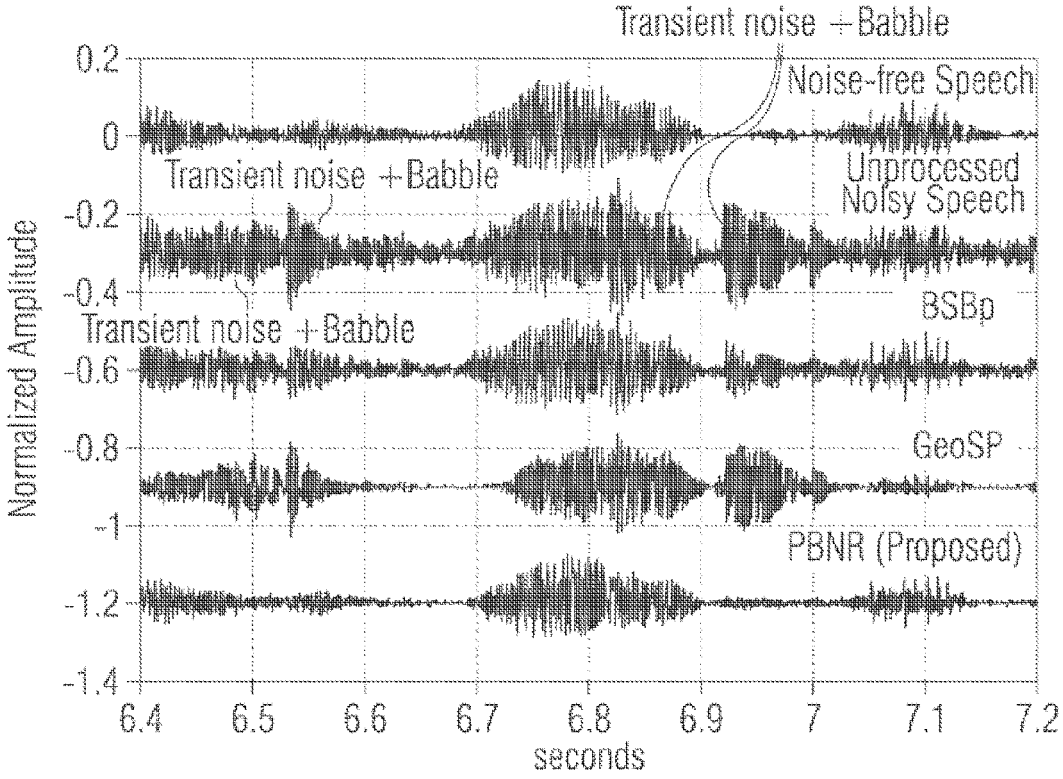
FIG. 2 is a graph plotting enhanced signals resulting from different algorithms.

Table 6 shows the noise reduction performance results for the complex hearing scenario described in section Va). Table 6 corresponds to the scenario with left and right input SNR levels of 2.1 dB and 4.6 dB respectively. The performance results were tabulated with processed signals of 8.5 seconds. FIG. 2 illustrates the corresponding enhanced signals (i.e. processed signals) resulting from the BSPp, GeoSP and PBNR algorithms. Only the results for the left channels are shown, and only for a short segment to visually facilitate the comparisons between the schemes. The unprocessed noisy speech segment shown in FIG. 2 contains contamination from transient noise (dishes clattering), interfering speeches and background babble noise. The original noise-free speech segment is also depicted in FIG. 2 for comparison.

Looking at the objective performance results shown in Table 6, it can be seen that our proposed PBNR scheme strongly reduces the overall noise, with left and right SNR gains of about 7.7 dB and 5.5 dB respectively. Most importantly, while the noise is greatly reduced, the overall quality of the binaural signals after processing was also improved, as represented by a gain in the Covl measure and a positive ΔPSM. The target speech distortion is reduced as represented by the increase of the Csig measure on both channels. The overall residual noise in the binaural enhanced signals is less intrusive as denoted by the increase of the Cbak measure on both channels again. Finally, since there is a gain in the CSII measure (on both channels), the binaural enhanced signals from our proposed PBNR scheme have a potential speech intelligibility improvement. Overall it can be seen in Table 6 that the PBNR scheme clearly outperforms the results obtained by the BSPp, BSP, GeoSP and GeoSP0.35 schemes in all the various objective measures. To further analyze the results, it is noticed from FIG. 2 that our proposed binaural PBNR scheme visibly attenuated all the combinations of noises around the hearing aid user (transient noise from the dishes clattering, interfering speech and babble noise). The BSPp scheme also reduced those various noises (i.e. directional or diffuse) but the overall noise remaining in the enhanced signal is still significantly higher than PBNR. It should be noted that the enhancement signals obtained by BSP and BSPp contain musical noise as easily perceived through listening. The next paragraph will provide more insights regarding the BSP and BSPp schemes. As for the GeoSP scheme, it can be visualized that it greatly reduced the background babble-noise, but the transient noise and the interfering speech were not attenuated, as expected and explained below.

The following two paragraphs will provide some analysis regarding the BSP/BSPp and GeoSP approaches, which explains the results obtained in FIG. 2 and the musical noise perceived in the BSP/BSPp enhanced signals. In [LOT'06], the binaural noise scheme BSBp uses a pre-beamforming stage based on the MVDR approach. One of the parameters implemented for the design of the MVDR-type beamformer is a predetermined matrix of cross-power spectral densities (cross-PSD) of the noise under the assumption of a diffuse field. In [LOT'06], this matrix is always maintained fixed (i.e. non-adaptive). Consequently, the BSBp scheme is not optimized to reduce directional interfering noise originating from a specific location. To be more precise, since the noise cross-PSD is designed for a diffuse field, the BSBp scheme will aim to attenuate simultaneously noise originating from all spatial locations except the desired target direction. The main advantage of this scheme is that it does not require the estimation of the interfering directional noise sources locations. On the other hand, the level of noise attenuation achievable is then reduced since a beamforming notch is not adaptively steered towards the main direction of arrival for the noise. Nevertheless, all the objective measures were improved in our setup with the BSPp and BSP schemes. As briefly mentioned in section Va), the BSP corresponds to the approach without post-processing. The post-processing consists of a Wiener post-filter to further increase the performance, which was the case as shown in Table 6 by looking at the results obtained using the BSBp. However, it was noticed that the BSP or BSPp approach causes the appearance of musical noise in the enhanced signals. This is not easily intuitive since in general beamforming approaches should not suffer from musical noise. But as mentioned earlier, the scheme in [LOT'06] uses a beamforming stage which initially produces a single output. By definition, beamforming operates by combining and weighting an array of spatially separated sensor signals (here using the left and right hearing aid microphone signals) and it typically produces a single (monaural) enhanced output signal. This output is free of musical noise. Unfortunately, in binaural hearing, having a monaural output represents a complete loss of interaural cues of all the sources. In [LOT'06], to circumvent this problem, the output of the beamformer was converted into a common real-valued spectral gain, which was then applied to both binaural input channels. This produces binaural enhanced signals with cues preservation as mentioned earlier, but it also introduces musical noise in the enhanced signals produced from complex acoustic environments. The conversion to a single gain can no longer be considered as a "true" beamforming operation, since the left or the right enhanced output is obtained by altering/modifying its own respective single channel input, and not by combining input signals from a combination of array sensors. The BSP or BSPp approach thus become closer to other classic speech enhancement methods with Wiener-type enhancement gains, which are often prone to musical noise.

In contrast, the GeoSP scheme in [HU'08] does not introduce much musical noise. The approach possesses properties similar to the traditional MMSE-STSA algorithm in [EPH'84], in terms of enhancement gains composed of a priory and a posteriori SNRs smoothing helping in the elimination of musical noise [CAP'94]. However, the GeoSP scheme is based on a monaural system where only a single channel is available for processing. Therefore, the use of spatial information is not feasible, and only spectral and temporal characteristics of the noisy input signal can be examined. Consequently, it is very difficult for instance for the scheme to distinguish between the speech coming from a target speaker or from interferers, unless the characteristics of the lateral noise/interferers are fixed and known in advance, which is not realistic in real life situations. Also, most monaural noise estimation schemes such as the noise PSD estimation using minimum statistics in [MAR'01] assume that the noise characteristics vary at a much slower pace than the target speech signal, and therefore these noise estimation schemes will not detect for instance lateral transient noise such as dishes clattering, hammering sounds, etc. [KAM'08T]. As a result, the monaural noise reduction scheme GeoSP from [HU'08], which implements the noise estimation scheme in [MAR'01] to update its noise power spectrum, will only be able to attenuate diffuse babble noise as depicted in FIG. 2. Also, it was noticed that reducing the noise reduction strength of the original version of the monaural noise reduction scheme proposed in [Hu'08] helped improving its performance (the scheme referred to as GeoSPo.35). The spectral gain floor was set to 0.35, which is the same level that was used in Stage 1 of the PBNR scheme. This modification caused more residual babble noise to be left in the binaural output signals (i.e. decrease of SNR and seg-SNR gains), however the output signals were less distorted, which is very important in a hearing aid application. As shown in Table 6, all the objective measures (except SNR and SegSNR) were improved using GeoSPo.35, compared to the results obtained with the original scheme GeoSP. It should be mentioned that the results obtained with GeoSPo.35 still produced a slight increase of speech distortion (i.e. a lower Csig value) with respect to the original unprocessed noisy signals. Therefore it seems that perhaps the spectral gain floor could be further raised.

The performance of all the noise reduction schemes were also evaluated under lower SNR levels. For the same hearing scenario, Table 7 shows the results for input left and right SNR levels of about −3.9 dB and −1.5 dB, representing an overall noise of 6 dB higher than the settings used in Table 6. Table 8 shows the results with a noise level further increased by 9 dB, corresponding to left and right SNRs of −13.5 dB and −11 dB respectively (simulating a very noisy environment).

It can be assessed that the PBNR scheme confirmed to be efficient even under very low SNR levels as shown in tables 7 and 8. All the objective measures were improved on both channels with respect to the unprocessed results and the other noise reduction schemes. This performance is due to the fact the PBNR approach is divided into different stages addressing various problems and using minimal assumptions. The first two stages are designed to resolve the contamination from various types of noises without the use of a voice activity detector. For instance, Stage 1 designs enhancement gains to reduce diffuse noise only, while the purpose of Stage 2 is to reduce directional noise only. Stage 3 and 4 produce new sets of spectral gains using a Kalman filtering approach from the pre-enhanced binaural signals obtained by combining and applying the gains from stages 1 and 2. It was found through informal listening tests that combining the gains from the two types of enhancement schemes (MMSE-STSA and Kalman filtering, combined in Stage 5) provides a more "natural-sounding" speech after processing, with negligible musical noise. As previously mentioned, the proposed PBNR also guaranties the preservation of the interaural cues of the directional background noises and of the target speaker, just like the BSPp and BSP schemes. As a result, the spatial impression of the environment will remain unchanged. Informal listening can easily show the improved performance of the proposed scheme, and the resulting binaural original and enhanced speech files corresponding to the results in tables 6, 7 and 8 for the different schemes are available for download at the address: http://www.site.uottawa.ca/~akamkar/TASLP_complete_binaural_enhancement_system.zip

Conclusion

A new binaural noise reduction scheme was proposed, based on recently developed binaural PSD estimators and a combinations of speech enhancement techniques. From the simulation results and an evaluation using several objective measures, the proposed scheme confirmed to be effective for complex real-life acoustic environments composed of multiple time-varying directional noises sources, time-varying diffuse noise, and reverberant conditions. Also, the proposed scheme produces enhanced binaural output signals for the left and right ears with full preservation of the original interaural cues of the target speech and directional background noises. Consequently, the spatial impression of the environment remains unchanged after processing. The proposed binaural noise reduction scheme is thus a good candidate for the noise reduction stage of upcoming binaural hearing aids. Future work includes the performance assessment and the tuning of the proposed scheme in the case of binaural hearing aids with multiple sensors on each car.

Acknowledgment

This work was partly supported by a NSERC student scholarship and by a NSERC-CRD research grant.

REFERENCES

[ABU'04] H. Abutalebi, H. Sheikhzadeh, L. Brennan, "A Hybrid Subband Adaptive System for Speech Enhancement in Diffuse Noise Fields", *IEEE Signal Processing Letters*, vol. 11, no. 1, pp. 44-47, January 2004

[BOG'07] T. Bogaert, S. Doclo, M. Moonen, "Binaural cue preservation for hearing aids using an interaural transfer function multichannel Wiener filter," in *Proc. IEEE ICASSP*, vol. 4, pp. 565-568, April 2007

[CAP'94] 0. Cappé, "Elimination of the musical noise phenomenon with the Ephraim and Malah noise suppressor," *IEEE Trans. Speech, and Audio Processing*, vol. 2, no. 2, pp. 345-349, 1994.

[DOC'05] S. Doclo, T. Klasen, J. Wouters, S. Haykin, M. Moonen, "Extension of the Multi-Channel Wiener Filter with ITD cues for Noise Reduction in Binaural Hearing Aids," in *Proc. IEEE WASPAA*, pp. 70-73, October 2005

[DOE'96] M. Doerbecker, and S. Ernst, "Combination of Two-Channel Spectral Subtraction and Adaptive Wiener Post-filtering for Noise Reduction and Dereverberation", *Proc. of 8th European Signal Processing Conference (EUSIPCO '96)*, Trieste, Italy, pp. 995-998, September 1996

[EPH'84] Y. Ephraim, "Speech Enhancement Using a Minimum Mean-Square Error Short-Time Spectral Amplitude Estimator", *IEEE Transactions on Acoustics, Speech, and signal Processing*, Vol. ASSP-32, No. 6, pp. 1109-1121, December 1984

[GAB'04] M. Gabrea, "Robust Adaptive Kalman Filtering-Based Speech Enhancement Algorithm", *IEEE Transactions of Acoustics, Speech and Signal Processing*, Vol. 1, pp. I-301-4, 2004

[GAB'05] M. Gabrea, "An Adaptive Kalman Filter for the Enhancement of Speech Signals in Colored Noise", 2005 *IEEE Workshop on Applications of Signal Processing to Audio and Acoustics*, New Palz, N.Y., pp. 45-48, October, 2005.

[HAM'05] V. Hamacher, J. Chalupper, J. Eggers, E. Fisher, U. Kornagel, H. Puder, and U. Rass, "Signal Processing in High-End Hearing Aids: State of the Art, Challenges, and Future Trends", *EURASIP Journal on Applied Signal Processing*, vol. 2005, no. 18, pp. 2915-2929, 2005

[HAY'01] S. Haykin, *Kalman Filtering and Neural Networks*, John Wiley and Sons, Inc., 2001

[HU'06] Y. Hu and P. Loizou, "Subjective comparison of speech enhancement algorithms," in *Proc. IEEE Int. Conf. Acoust., Speech, Signal Process.*, vol. 1, pp. 153-156, 2006

[HU'08]Y. Hu and P. C. Loizou, "A geometric approach to spectral subtraction", *Speech Communication*, vol. 50, pp. 453-466, January 2008

[HU'082nd] Y. Hu and P. C. Loizou, "Evaluation of Objective Quality Measures for Speech Enhancement", *IEEE Trans. Audio Speech Language Processing*, vol. 16, no. 1, pp. 229-238, January 2008

[HUB'06] R. Huber and B. Kollmcier, "PEMO-Q—A New Method for Objective Audio quality Assessment using a Model of Auditory Perception." *IEEE Trans. on Audio, Speech and Language Processing*, vol. 14, no. 6, pp. 1902-1911, November 2006

[ITU'01] ITU-T, "Perceptual evaluation of speech quality (PESQ), an objective method for end-to-end speech quality assessment of narrowband telephone networks and speech codecs", *Series P: Telephone Transmission Quality Recommendation P.862, International Telecommunications Union*, February 2001

[KAM'08] A. H. Kamkar-Parsi, and M. Bouchard, "Improved Noise Power Spectrum Density Estimation For Binaural Hearing Aids Operating in a Diffuse Noise Field Environment", accepted for publication in *IEEE Transactions on Audio, Speech and Language Processing*

[KAM'08T] A. H. Kamkar-Parsi, and M. Bouchard, "Instantaneous Target Speech Power Spectrum Estimation for Binaural Hearing Aids and Reduction of Directional Interference with Preservation of Interaural Cues", submitted for publication in *IEEE Trans. on Audio, Speech and Language Processing*

[KAT'05] J. M. Kates and K. H. Arehart, "Coherence and the Speech Intelligibility Index", *J. Acoust. Soc. Am.*, vol. 117, no. 4, pp. 2224-2237, April 2005

[KLA'06] T. J. Klasen, S. Doclo, T. Bogaert, M. Moonen, J. Wouters, "Binaural multi-channel Wiener filtering for Hearing Aids: Preserving Interaural Time and Level Differences," in *Proc. IEEE ICASSP*, vol. 5, pp. 145-148, May 2006

[KLA'07] T. J. Klasen, T. Bogaert, M. Moonen, "Binaural noise reduction algorithms for hearing aids that preserve interaural time delay cues," *IEEE Trans. Signal Processing*, vol. 55, no. 4, pp. 1579-1585, April 2007

[LOT'06] T. Lotter and P. Vary, "Dual-channel Speech Enhancement by Superdirective Beamforming," *EURASIP Journal on Applied Signal Processing*, vol. 2006, pp. 1-14, 2006

[MAR'01] R. Martin, "Noise Power Spectral Density Estimation Based on Optimal Smoothing and Minimum Statistics", *IEEE Transactions on Speech and Audio Processing*, vol. 9, no. 5, pp. 504-512, July 2001

[MCC'03] I. McCowan, and H. Bourland, "Microphone Array Post-Filter Based on Diffuse Noise Field", *IEEE Transactions on Speech and Audio Processing*, vol. 11, no. 6, pp. 709-716, November 2003

[PAL'87] K. Paliwal and A. Basu, "A speech enhancement method based on Kalman filtering," Proceedings of the *IEEE International Conference on Acoustics, Speech and Signal Processing*, vol. 12, pp. 297-300, April 1987

[PUD'06] H. Puder, "Adaptive Signal Processing for Interference Cancellation in Hearing Aids", *Signal Processing*, vol. 86, no. 6, pp. 1239-1253, June 2006

[ROH'05] T. Rohdenburg, V. Hohmann, and B. Kollmeier, "Objective Perceptual Quality measures for the Evaluation of Noise Reduction Schemes", in 9th *International Workshop on Acoustic Echo and Noise Control*, Eindhoven, pp. 169-172, 2005

[ROH'07] T. Rohenburg, V. Hohmann, B. Kollmeir, "Robustness Analysis of Binaural Hearing Aid Beamformer Algorithms By Means of Objective Perceptual Quality Measures", *IEEE Workshop on Applications of Signal Processing to Audio and Acoustics*, pp. 315-318, NY, Oct. 21, 2007

TABLE 1

Diffuse Noise PSD Estimator

Initialization:

$d_{LR} = 0.175$ m; $c = 344$ m/s; $\alpha = 0.99999$;

$$\psi_{LR}(\omega) = \alpha \cdot \mathrm{sinc}\left(\frac{\omega \cdot d_{LR} \cdot 2}{c}\right) \text{ (Note: } \omega \text{ is in radians/sec)}$$

$\lambda = 0$

START: for each binaural input frames received compute:

1- $h_w(\lambda, i)$ (refer to section IVa))

2- $e(i) = l(\lambda, i) - r(\lambda, i) \otimes h_w(\lambda, i)$

3- $\Gamma_{EE}(\lambda, \omega) = \mathrm{F.T.}(\gamma_{ee}(\tau)) = \mathrm{F.T.}\{E(e(i+\tau) \cdot e(i))\}$ 4- $$\Gamma_{root}(\lambda, \omega) = \sqrt{\begin{pmatrix} -(\Gamma_{LL}(\lambda, \omega) + \Gamma_{RR}(\lambda, \omega)) + \\ 2 \cdot \psi(\omega) \cdot \mathrm{Re}\{\Gamma_{LR}(\lambda, \omega)\} \end{pmatrix}^2 - 4 \cdot (1 - \psi^2(\omega)) \cdot \Gamma_{EE}(\omega)\Gamma_{RR}(\lambda, \omega)}$$

5- $$\Gamma_{NN}(\lambda, \omega) = \frac{1}{2 \cdot (1 - \psi^2(\omega))}\begin{pmatrix} \Gamma_{LL}(\lambda, \omega) + \Gamma_{RR}(\lambda, \omega) - 2 \cdot \psi(\omega) \cdot \\ \mathrm{Re}\{\Gamma_{LR}(\lambda, \omega)\} - \Gamma_{root}(\lambda, \omega) \end{pmatrix}$$

6- $\lambda = \lambda + 1$

END

Note:

for $\Gamma_{EE}(\lambda, \omega)$ computation, a segmentation of 2 with 50% overlap was used. Similarly, for $\Gamma_{LR}(\lambda, \omega)$, a segmentation of 4 was used instead, with 50% overlap.

TABLE 2

Classifier and Noise PSD Adjuster

Initialization:
$\alpha = 0.5$;
Th_Coh_vl=0.1; Th_Coh=0.2;
ForcedClassFlag = 0; NumberOfForcedFrames=5;
$\lambda = 0$
START: for each incoming frame received compute:
1- $C_{LR}(\lambda,\omega)$; $\overline{C_{LR}}(\lambda)$;
Note: for the PSD computations in $\overline{C_{LR}}(\lambda)$, a segmentation of 8 with 50% overlap was used.
2- $\Gamma_{NN}^{j}(\lambda,\omega) = \Gamma_{NN}(\lambda,\omega)$, $\forall\omega$
3- Find $\omega_N$ subject to $C_{LR}(\lambda,\omega_N) < \text{Th_Coh_vl}$
  if $\overline{C_{LR}}(\lambda) < \text{Th_Coh}$ & ForcedClassFlag = 0
    ⇒ FrameClass($\lambda$) = 0
    ⇒ $\Gamma_{NN}^{j}(\lambda,\omega) = \sqrt{\max(\alpha \cdot \Gamma_{jj}(\lambda,\omega), \Gamma_{NN}^{j}(\lambda,\omega)) \cdot \Gamma_{NN}^{j}(\lambda,\omega)}$
  else
    ⇒ FrameClass($\lambda$) = 1
4- $\Gamma_{NN}^{j}(\lambda,\omega_N) = \Gamma_{jj}(\lambda,\omega_N)$ 5-
    ⇒ $\Gamma_{NN}^{j}(\lambda,\omega) = \Gamma_{NN}^{j}(\lambda,\omega)$, $\forall\omega$
    ⇒ ForcedClassFlag = 1
    ⇒ ForcedFrameCount = 0
  end
  ⇒ ForcedFrameCount = ForcedFrameCount+1
  if ForcedFrameCount > NumberOfForcedFrames
    ⇒ ForcedClassFlag = 0
  end
6- $\lambda = \lambda + 1$
END
Note: Steps 1 to 6 is performed with: j = L and j =R

TABLE 3

MMSE-STSA

Initialization:
$\beta = 0.8$; $q = 0.2$; $\sigma = 0.98$; $W_{DFT} = 512$;
$\lambda = 0$; $N_j(-1, \omega) = N_j(0, \omega)$; $Y_j(-1, \omega) = Y_j(0, \omega)$;
START with j = L, for each incoming frame received compute:

1- $N_j(\lambda, \omega) = \sqrt{\Gamma_{NN}^j(\lambda,\omega) \cdot W_{DFT}}$

2- $N_j(\lambda, \omega) = \beta \cdot N_j(\lambda, \omega) + (1 - \beta) \cdot N_j(\lambda - 1, \omega)$ 3- $\xi_j(\lambda, \omega) = \frac{|Y_j(\lambda, \omega)|^2}{|N_j(\lambda, \omega)|^2} - 1$ 4- $\gamma_j(\lambda, \omega) = (1 - \sigma) \cdot \max(\xi_j(\lambda, \omega), 0) + \sigma \frac{|G^j(\lambda - 1, \omega) \cdot Y_j(\lambda - 1, \omega)|^2}{|N_j(\lambda, \omega)|^2}$ 5- $\hat{\gamma}_j(\lambda, \omega) = (1 - q) \cdot \gamma_j(\lambda, \omega)$ 6- $\vartheta = (1 + \xi_j(\lambda, \omega)) \cdot \left( \frac{\hat{\gamma}_j(\lambda, \omega)}{1 + \hat{\gamma}_j(\lambda, \omega)} \right)$ 7- $M[\vartheta] = e^{\left(\frac{\vartheta}{2}\right)} \cdot \left[ (1 + \vartheta) \cdot I_0 \cdot \left(\frac{\vartheta}{2}\right) + \vartheta \cdot I_1 \cdot \left(\frac{\vartheta}{2}\right) \right]$ 8- $G^j(\lambda, \omega) = \frac{\sqrt{\pi}}{2} \sqrt{\left(\frac{1}{1 + \xi_j(\lambda, \omega)}\right) \cdot \left(\frac{\hat{\gamma}_j(\lambda, \omega)}{1 + \hat{\gamma}_j(\lambda, \omega)}\right)} \cdot M[\vartheta]$ 9- $\Lambda = \frac{1 - q}{q} \cdot \frac{1}{1 + \hat{\gamma}_j(\lambda, \omega)} e^{\left[\frac{\hat{\gamma}_j(\lambda,\omega)}{1+\hat{\gamma}_j(\lambda,\omega)}\right] \cdot (1+\xi_j(\lambda,\omega))}$ 10- $G_{Diff}^j(\lambda, \omega) = \frac{\Lambda}{1 + \Lambda} \cdot G^j(\lambda, \omega)$ 11- $\lambda = \lambda + 1$
END
Repeat steps 1 to 11 with j = R Note:
$I_0(.)$ and $I_1(.)$ denote the modified Bessel functions of zero and first order respectively.

TABLE 4

Target Speech PSD Estimator

Initialization:
$\alpha = 0.8$; th_offset = 3;
$\lambda = 0$;
START: with j = L, for each incoming frame received compute:

1- $h_w^j(\lambda, i)$ (refer to section IVb))

2- if (j == R), $e(i) = l(\lambda, i) - r(\lambda, i) \otimes h_w^R(i)$ $\Gamma_{EE_I}^R(\lambda, \omega) = \Gamma_{LL}(\lambda, \omega) - \Gamma_{RR}(\lambda, \omega) \cdot |H_W^R(\lambda, \omega)|^2$ else $e(i) = r(\lambda, i) - l(\lambda, i) \otimes h_w^L(i)$ $\Gamma_{EE_I}^L(\lambda, \omega) = \Gamma_{RR}(\lambda, \omega) - \Gamma_{LL}(\lambda, \omega) \cdot |H_W^L(\lambda, \omega)|^2$ end 3- $\Gamma_{EE}^j(\lambda, \omega) = F.T.(\gamma_{ee}(\tau)) = F.T.\{E(e(i + \tau) \cdot e(i))\}$
4- $Offset_dB(\omega) = |10 \cdot \log(\Gamma_{LL}(\lambda, \omega)) - 10 \cdot \log(\Gamma_{RR}(\lambda, \omega))|$
5- Find ω_int subject to: Offset_dB(ω_int) > th_offset 6- if (FrameClass(λ) == 0), $\Gamma_{EE_FF}^j(\lambda, \omega) = 0.5 \cdot \Gamma_{EE_I}^j(\lambda, \omega) + 0.5 \cdot \Gamma_{JJ}(\lambda, \omega)$ else $$\Gamma_{EE_FF}^j(\lambda, \omega) = \begin{cases} \Gamma_{EE_I}^j(\lambda, \omega), & \text{for } \omega \neq \omega_int \\ \alpha \cdot \Gamma_{EE}^j(\lambda, \omega) + (1 - \alpha) \cdot \Gamma_{EE_I}^j(\lambda, \omega), & \text{for } \omega = \omega_int \end{cases}$$

end

7- $\Gamma_{SS}^j(\lambda, \omega) = \frac{\Gamma_{jj}(\lambda, \omega) \cdot \Gamma_{EE_FF}^j(\lambda, \omega)}{(\Gamma_{LL}(\lambda, \omega) + \Gamma_{RR}(\lambda, \omega)) - (\Gamma_{LR}(\lambda, \omega) + \Gamma_{LR}^*(\lambda, \omega))}$ 8- $\lambda = \lambda + 1$
Repeat steps 1 to 8 with j = R

TABLE 5

Kalman Filtering

ALGORITHM:
Initialization:
p=20; q=20; $C=[0_1,...,0_{p-1},1,0_1,...,0_{q-1},1_q]_{1\times(p+q)}$
$\lambda = 0$:

$\hat{z}_j(\lambda,0/-1)$=draw vector of (p+q) random numbers □ N(0,1)

$P_j(\lambda,0/-1)=1_{(p+q)\times(p+q)}$;

START with j = L, for each incoming frame received compute:

1- if (j == L), $y(i) = l(\lambda,i)$ $\Gamma_{YY}(\lambda,\omega) = \Gamma_{LL}(\lambda,\omega)$ else $y(i) = r(\lambda,i)$ $\Gamma_{YY}(\lambda,\omega) = \Gamma_{RR}(\lambda,\omega)$ end 2- Update $A_s^j$ and $A_n^j$ into $A^j(\lambda)$ 3- Update $Q_j(\lambda)$ 4- START iteration from i = 0 to D − 1, $e(\lambda,i) = y(\lambda,i) - C \cdot \hat{z}(\lambda,i/i-1)$ $\kappa(\lambda,i) = P_j(\lambda,i/i-1) \cdot C \times [C \cdot P_j(\lambda,i/i-1) \cdot C^T]^{-1}$ $\hat{z}_j(\lambda,i/i) = \hat{z}_j(\lambda,i/i-1) + \kappa(\lambda,i) \cdot e(\lambda,i)$ $P_j(\lambda,i/i) = [I - \kappa(\lambda,i) \cdot C] \cdot P_j(\lambda,i/i-1)$ $\hat{z}_j(\lambda,i+1/i) = A_j(\lambda) \cdot \hat{z}_j(\lambda,i/i)$ $P_j(\lambda,i+1/i) = A_j(\lambda) \cdot P_j(\lambda,i/i) \cdot A_j^T(\lambda) + Q_j(\lambda)$ if (i ≥ p−1)

$s_{Ka}^j(\lambda,i-p+1)=1^{st}$ component of $\hat{z}_j(\lambda,i/i)$ end if (i == D/2−1), $\hat{z}_j^{temp} = \hat{z}_j(\lambda,i/i-1)$ $P_j^{temp} = P_j(\lambda,i/i-1)$ end

END

5- $\lambda = \lambda + 1$

6- $\hat{z}_j(\lambda,0/-1) = \hat{z}_j^{temp}$

7- $P_j(\lambda,0/-1) = P_j^{temp}$

END

Repeat steps 1 to 7 with j = R

TABLE 6

Objective Performance Results for left and right input SNRs at 2.1 dB and 4.6 dB respectively.

| | SNR | | SegSNR | | Csig | | Cbak | | Covl | | ΔPSM | | CSII | |
|---|---|---|---|---|---|---|---|---|---|---|---|---|---|---|
| | Left | Right | Left | Right | Left | Right | Left | Right | Left | Right | Left | Right | Left | Right |
| Noisy | 2.09 | 4.59 | −1.72 | −0.76 | 3.28 | 3.48 | 2.11 | 2.24 | 2.59 | 2.78 | | | 0.61 | 0.72 |
| BSB | 4.07 | 6.83 | 0.63 | 0.46 | 3.44 | 3.63 | 2.27 | 2.40 | 2.75 | 2.94 | 0.031 | 0.026 | 0.73 | 0.84 |
| BSBp | 7.08 | 8.92 | 0.82 | 1.76 | 3.62 | 3.73 | 2.46 | 2.56 | 2.94 | 3.05 | 0.077 | 0.054 | 0.85 | 0.92 |
| GeoSP | 3.79 | 6.64 | −0.23 | 0.85 | 2.65 | 2.93 | 2.02 | 2.19 | 2.17 | 2.44 | 0.021 | 0.012 | 0.59 | 0.71 |
| GeoSPo.35 | 3.67 | 6.94 | −0.30 | 0.78 | 3.20 | 3.47 | 2.20 | 2.38 | 2.57 | 2.83 | 0.027 | 0.020 | 0.69 | 0.76 |
| PBNR | 9.76 | 10.11 | 2.92 | 3.23 | 3.75 | 3.80 | 2.65 | 2.69 | 3.09 | 3.15 | 0.123 | 0.082 | 0.94 | 0.96 |

TABLE 7

Objective Performance Results for left and right input SNRs at −3.9 dB and −1.4 dB respectively.

| | SNR | | SegSNR | | Csig | | Cbak | | Covl | | ΔPSM | | CSII | |
|---|---|---|---|---|---|---|---|---|---|---|---|---|---|---|
| | Left | Right | Left | Right | Left | Right | Left | Right | Left | Right | Left | Right | Left | Right |
| Noisy | −3.93 | 1.43 | −5.25 | −4.50 | 2.68 | 2.89 | 1.55 | 1.69 | 2.04 | 2.24 | | | 0.28 | 0.35 |
| BSB | −1.83 | 1.01 | −4.25 | −3.41 | 2.82 | 3.03 | 1.69 | 1.83 | 2.18 | 2.38 | 0.029 | 0.027 | 0.34 | 0.48 |
| BSBp | 1.71 | 3.80 | −2.75 | −1.92 | 2.99 | 3.12 | 1.88 | 1.97 | 2.36 | 2.48 | 0.072 | 0.055 | 0.56 | 0.61 |
| GeoSP | −1.56 | 2.04 | −3.20 | −2.26 | 1.94 | 2.32 | 1.44 | 1.62 | 1.51 | 1.86 | 0.021 | 0.007 | 0.30 | 0.36 |
| GeoSPo.35 | −2.14 | 1.34 | −3.61 | −2.70 | 2.55 | 2.84 | 1.65 | 1.82 | 1.98 | 2.25 | 0.025 | 0.020 | 0.40 | 0.38 |
| PBNR | 5.76 | 6.01 | −0.48 | −0.12 | 3.14 | 3.23 | 2.10 | 2.15 | 2.51 | 2.59 | 0.112 | 0.079 | 0.61 | 0.72 |

TABLE 8

Objective Performance Results for left and right input SNRs at −13.5 dB and −11.0 dB respectively.

| | SNR | | SegSNR | | Csig | | Cbak | | Covl | | ΔPSM | | CSII | |
|---|---|---|---|---|---|---|---|---|---|---|---|---|---|---|
| | Left | Right | Left | Right | Left | Right | Left | Right | Left | Right | Left | Right | Left | Right |
| Noisy | −13.47 | −10.97 | −8.65 | −8.32 | 1.86 | 2.20 | 0.92 | 1.14 | 1.28 | 1.67 | | | 0.08 | 0.12 |
| BSB | −11.28 | −8.37 | −8.17 | −7.72 | 1.98 | 2.17 | 1.01 | 1.11 | 1.42 | 1.59 | 0.022 | 0.021 | 0.12 | 0.14 |
| BSBp | −7.40 | −5.16 | −7.23 | −6.74 | 2.03 | 2.17 | 1.08 | 1.17 | 1.48 | 1.61 | 0.053 | 0.041 | 0.14 | 0.17 |
| GeoSP | −10.90 | −6.90 | −6.76 | −6.01 | 1.64 | 1.50 | 1.23 | 1.01 | 1.53 | 1.14 | 0.016 | 0.003 | 0.07 | 0.13 |
| GeoSPo.35 | −11.66 | −8.12 | −7.48 | −6.92 | 1.77 | 1.90 | 1.02 | 1.06 | 1.32 | 1.36 | 0.018 | 0.014 | 0.08 | 0.15 |
| PBNR | −1.55 | −1.35 | −5.09 | −4.79 | 2.07 | 2.30 | 1.20 | 1.35 | 1.45 | 1.71 | 0.075 | 0.055 | 0.15 | 0.23 |

The current generation of digital hearing aids allows the implementation of advanced noise reduction schemes. However, most current noise reduction algorithms are monaural and are therefore intended for only bilateral hearing aids. Recently, binaural in contrast to monaural noise reduction schemes have been proposed, targeting future high-end binaural hearing aids. Those new types of hearing aids would allow the sharing of information/signals received from both left and right hearing aid microphones (via a wireless link) to generate an output for the left and right ear. This paper presents a novel noise power spectral density estimator for binaural hearing aids operating in a diffuse noise field environment, by taking advantage of the left and right reference signals that will be accessible, as opposed to the single reference signal currently available in bilateral hearing aids. In contrast with some previously published noise estimation methods for hearing aids or speech enhancement, the proposed noise estimator does not assume stationary noise, it can work for colored noise in a diffuse noise field, it does not require a voice activity detection, the noise power spectrum can be estimated during speech activity or not, it does not experience noise tracking latency and most importantly, it is not essential for the target speaker to be in front of the binaural hearing aid user to estimate the noise power spectrum, i.e. the direction of arrival of the source speech signal can be arbitrary. Finally, the proposed noise estimator can be combined with any hearing aid noise reduction technique, where the accuracy of the noise estimation can be critical to achieve a satisfactory de-noising performance.

Index Terms—noise power spectrum estimation, binaural hearing aids, diffuse noise field.

IN MOST speech de-noising techniques, it is necessary to estimate a priori the characteristics of the noise corrupting the desired speech signal. Usually, most noise power spectrum estimation techniques require the need of voice activity detection, to estimate the corrupting noise power spectrum during speech pauses. However, these estimation techniques will mostly be efficient for highly stationary noise, which is not found in many daily activities, and they often fail under situations with low signal to noise ratios. Some advanced noise power spectrum estimation techniques, which do not require a voice activity detector (VAD) have been published, for example as in [1]. But these techniques are mostly based on a monaural microphone system, where only a single noisy signal is available for processing. In contrast, multiple microphones systems can take into account the spatial distribution of noise and speech sources, using techniques such as beamforming [4] to enhance the noisy speech signal.

Nevertheless, in the near future, a new generation of binaural hearing aids will be available. Those intelligent hearing aids will use and combine the simultaneous information available from the hearing aid microphones in each ear (i.e. left and right channels). Such a system is called a binaural system, as in the binaural hearing of humans, taking advantage of the two ears and the relative differences found in the signals received by the two ears. Binaural hearing plays a significant role for understanding speech when speech and noise are spatially separated. Those new binaural hearing aids would allow the sharing and exchange of information or signals received from both left and right hearing aid microphones via a wireless link, and would also generate an output for the left and right ear, as opposed to current bilateral hearing aids (i.e. a hearing-impaired person wearing a monaural hearing aid on each ear), where each monaural hearing aid processes only its own microphone inputs to generate an output for its corresponding ear. Hence, with bilateral hearing aids, the two monaural hearing aids are acting independently of one another.

Our objective is to develop a new approach for binaural noise power spectrum estimation in a binaural noise reduction system under a diffuse noise field environment, which would be implemented in up-coming binaural hearing aids. In simple terms, a diffuse noise field is when the resulting noise at the two ears comes from all directions, with no particular dominant source. Such noise characterizes several practical situations (e.g. background babble noise in cafeteria, car noise etc.), and even in non-diffuse noise conditions, there is often a significant diffuse noise component due to room reverberation. In addition, in a diffuse noise field, the noise components received at both ears are not correlated (i.e. one noise cannot be predicted from the other noise) except at low frequencies, and they also have roughly the same frequency content (spectral shape). On the other hand, the speech signal coming from a dominant speaker produces highly correlated components at the left and right ear, especially under low reverberation environments. Consequently, using these conditions and translating them into a set of equations, it is possible to derive an exact formula to identify the spectral shape of the noise components at the left and right ear. More specifically, it will be shown that the noise auto-power spectral density is found by applying first a Wiener filter to perform a prediction of the left noisy speech signal from the right noisy speech signal, followed by taking the auto-power spectral density of the difference between the left noisy signal and the prediction. As a second step, a quadratic equation is formed by combining the auto-power spectral density of the previous difference signal with the auto-power spectral densities of the left and right noisy speech signals. As a result, the solution of the quadratic equation represents the auto-power spectral density of the noise.

This estimation of the spectral shape of the noise components is often the key factor affecting the performance of most existing noise reduction or speech enhancement algorithms. Therefore, providing a new method that can instantaneously provide a good estimate of this spectral shape, without any assumption about speaker location (i.e. no specific direction of arrival required for the target speech signal) or speech activity, is a useful result. Also, this method is suitable for highly non-stationary colored noise under the diffuse noise field constraint, and the noise power spectral density (PSD) is estimated on a frame-by-frame basis during speech activity or not and it does not rely on any voice activity detector.

The proposed method is compared with the work of two current advanced noise power estimation techniques in [1] and [2]. In [1], the author proposed a new approach to estimate the noise power density from a noisy speech signal based on minimum statistics. The technique relies on two main observations: at first, the speech and the corrupting noise are usually considered statistically independent, and secondly, the power of the noisy speech signal often decays to the power spectrum level of the corrupting noise. It has been suggested that based on those two observations, it is possible to derive an accurate noise power spectral density estimate by tracking the spectral minima of a smoothed power spectrum of the noisy speech signal, and then by applying a bias compensation to it. This technique requires a large number of parameters, which have a direct effect on the noise estimation accuracy and tracking latency in case of sudden noise jumps or drops. A previously published technique that uses the left and right signals of a binaural hearing aid is the binaural noise estimator in [2], where a combination of auto- and cross-power spectral densities of the noisy binaural signals are used to extract the PSD of the noise under a diffuse noise field environment. However, this previous work neglects the correlation between the noise on each channels, which then corresponds to an ideal incoherent noise field. In practice, this incoherent noise field is rarely encountered, and there exists a high correlation of the noise between the channels at low frequencies in a diffuse noise field. As a result, this previous technique yields an underestimation of the noise power spectral density for the low frequencies [3]. Also, another critical assumption in [2] is that the speech components in the left and right signals received from each microphone have followed equal attenuation paths, which implies that the target speaker should only be in front (or behind) of the hearing aid user in order to perform the noise PSD estimation. The paper is organized as follows: Section II will provide the binaural system description, with signal definitions and the selected acoustical environment where the noise power spectrum density is estimated for binaural hearing aids. Section III will demonstrate the proposed binaural noise estimator in detail. Section IV will present simulation results of the proposed noise estimator in terms of accuracy and tracking speed for highly non-stationary colored noise, comparing with the binaural estimator of [2] and with the advanced monaural noise estimation of [1]. Finally, section V will conclude this work.

Binaural System Description and Selected Acoustical Environment

A. Acoustical Environment: Diffuse Noise Field

For a hearing aid user, listening to a nearby target speaker in a diffuse noise field is a common environment encountered in many typical noisy situations i.e. the babble noise in an office or a cafeteria, the engine noise and the wind blowing in a car, etc. [4] [5] [3] [2] In the context of binaural hearing and considering the situation of a person being in a diffuse noise field environment, the two ears would receive the noise signals propagating from all directions with equal amplitude and a random phase [10]. In the literature, a diffuse noise field has also been defined as uncorrelated noise signals of equal power propagating in all directions simultaneously [4]. A diffuse noise field assumption has been proven to be a suitable model for a number of practical reverberant noise environments often encountered in speech enhancement applications [6] [7] [3] [4] [8] and it has often been applied in array processing such as in superdirective beamformers [9]. It has been observed through empirical results that a diffuse noise field exhibits a high-correlation (i.e. high coherence) at low frequencies and a very low coherence over the remaining frequency spectrum. However, it is different from a localized noise source where a dominant noise source is coming from a specific direction. Most importantly, with the occurrence of a localized noise source or directional noise, the noise signals received by the left and right microphones are highly correlated over most of the frequency content of the noise signals.

B. Binaural System Description

Let l(i), r(i) be the noisy signals received at the left and right hearing aid microphones, defined here in the temporal domain as:

$$l(i)=s(i)\hat{x}h_l(i)+n_l(i) \quad (1)$$

$$r(i)=s(i)\hat{x}h_r(i)+n_r(i) \quad (2)$$

where s(i) is the target source speech signal and $\hat{x}$ represents a linear convolution sum operation.

It is assumed that the distance between the speaker and the two microphones (one placed on each car) is such that they receive essentially speech through a direct path from the nearby speaker, implying that the received left and right signals are highly correlated (i.e. the direct component dominates its reverberation components). Hence, the left and right received signals can be modeled by left and right impulse responses, $h_l$ and $h_r(i)$, convolved with the target source speech signal. In the context of binaural hearing, those impulse responses are often referred to as the left and right head-related impulse responses (HRIRs) between the target speaker and the left and right hearing aids microphones. $n_l(i)$ and $n_r(i)$ are respectively the left and right received additive noise signals.

Prior to estimating the noise power spectrum, the following assumptions are made (comparable to [2]):

i) the target speech and noise signals are uncorrelated, and the hearing aid user is in a diffuse noise field environment as described earlier.

ii) $n_l(i)$ and $n_r(i)$ are also mutually uncorrelated, which is a well-known characteristic of a diffuse noise field, except at very low frequencies [2][8]. In fact, neglecting this high correlation at low frequencies will lead to an underestimation of the noise power spectrum density at low frequencies. The noise power estimator in [2] suffers from this [3]. This very low frequency correlation will be taken into consideration in section IIIc), by adjusting the proposed noise estimator with a compensation method for the low frequencies. But in this section, uncorrelated left and right noise are assumed over the entire frequency spectrum.

iii) the left and right noise power spectral densities are considered approximatively equal, that is: $\Gamma_{N_LN_L}(\omega)\approx\Gamma_{N_RN_R}(\omega)\sim\Gamma_{NN}$. This approximation is again a realistic characteristic of diffuse noise fields [2] [4], and it has been verified from experimental recordings.

Additionally, as opposed to [2], the target speaker can be anywhere around the hearing user, that is the direction of arrival of the target speech signal does not need to be frontal (azimuthal angle ≠0°.

Using the assumptions above along with (1) and (2), the left and right auto power spectral densities, $\Gamma_{LL}(\omega)$ and $\Gamma_{RR}(\omega)$, can be expressed as the following:

$$\Gamma_{LL}(\omega)=F.T.\{\gamma_{ll}(\tau)\}=\Gamma_{SS}(\omega)|H_L(\omega)|^2+\Gamma_{NN}(\omega) \quad (3)$$

$$\Gamma_{RR}(\omega)=F.T.\{\gamma_{rr}(\tau)\}=\Gamma_{SS}(\omega)|H_R(\omega)|^2+\Gamma_{NN}(\omega) \quad (4)$$

where F.T.{.} is the Fourier Transform and $\gamma_{yx}(\tau)=E[y(i+\tau)\cdot x(i)]$ represents a statistical correlation function in this paper.

Proposed Binaural Noise Power Spectrum Estimation

In this section, the proposed new binaural noise power spectrum estimation method will be developed. Section IIIa) will present the overall diagram of the proposed noise power spectrum estimation. It will be shown that the noise power spectrum estimate is found by applying first a Wiener filter to perform a prediction of the left noisy speech signal from the right noisy speech signal, followed by taking the auto-power spectral density of the difference between the left noisy signal and the prediction. As a second step, a quadratic equation is formed by combining auto-power spectral density of the previous difference signal with the auto-power spectral densities of the left and right noisy speech signals. As a result, the solution of the quadratic equation represents the auto-power spectral density of the noise. In practice, the estimation error on one of the variables used in the quadratic system causes the noise power spectrum estimation to be less accurate. This is because the estimated value of this variable is computed indirectly i.e. it is obtained from a combination of several other variables. However, section IIIb) will show that there is an alternative and direct way to compute the value of this variable, which is less intuitive but provides a better accuracy. Therefore, solving the quadratic equation by using the direct computation of this variable will give a better noise power spectrum estimation. Finally, section Mc) will show how to adjust the noise power spectrum estimator at low frequencies for a diffuse noise field environment.

A. Noise PSD Estimation

FIG. 1 shows a diagram of the overall proposed estimation method. It includes a Wiener prediction filter and the final quadratic equation estimating the noise power spectral density. In a first step, a filter, $h_w(i)$, is used to perform a linear prediction of the left noisy speech signal from the right noisy speech signal. Using a minimum mean square error criterion (MMSE), the optimum solution is the Wiener solution, defined here in the frequency domain as:

$$H_w(\omega)=\Gamma_{LR}(\omega)/\Gamma_{RR}(\omega) \quad (5)$$

where $\Gamma_{LR}(\omega)$ is the cross-power spectral density between the left and the right noisy signals. $\Gamma_{LR}(\omega)$ is obtained as follows:

$$\Gamma_{LR}(\omega)=F.T.\{\gamma_{lr}(\tau)\}=F.T.\{E[l(i+\tau)\cdot r(i)]\} \quad (6)$$

with:

$$\gamma_{lr}(\tau)=E\left(\begin{bmatrix} s(i+\tau)\otimes h_l(i)+ \\ n_l(i+\tau)\end{bmatrix}\cdot\begin{bmatrix} s(i)\otimes h_r(i)+ \\ n_r(i)\end{bmatrix}\right)=\gamma_{ss}(\tau)\otimes h_l(\tau)\otimes h_r(-\tau)+\gamma_{sn_r}(\tau)\otimes h_l(\tau)+\gamma_{n_ls}(\tau)\otimes h_r(-\tau)+\gamma_{n_ln_r}(\tau) \quad (7)$$

Using the previously defined assumptions in section IIb), (7) can then be simplified to:

$$\gamma_{lr}(\tau)=\gamma_{ss}(\tau)\hat{x}h_l(\tau)\hat{x}h_r(-\tau) \quad (8)$$

The cross-power spectral density expression then becomes:

$$\Gamma_{LR}(\omega)=\Gamma_{SS}(\omega)\cdot H_L(\omega)\cdot H_R^*(\omega) \quad (9)$$

Therefore, substituting (9) into (5) yields:

$$H_w(\omega)=\Gamma_{SS}(\omega)\cdot H_L(\omega)\cdot H_R^*(\omega)/\Gamma_{RR}(\omega) \quad (10)$$

Furthermore, using (3) and (4), the squared magnitude response of the Wiener filter in (10) can also be expressed as:

$$|H_W(\omega)|^2=\frac{(\Gamma_{LL}(\omega)-\Gamma_{NN}(\omega))\cdot(\Gamma_{RR}(\omega)-\Gamma_{NN}(\omega))}{\Gamma_{RR}^2(\omega)} \quad (11)$$

For the second step of the noise estimation algorithm, (11) is rearranged into a quadratic equation as the following:

$$\Gamma_{NN}^2(\omega)-\Gamma_{NN}(\omega)\cdot(\Gamma_{LL}(\omega)+\Gamma_{RR}(\omega))+\Gamma_{EE_1}(\omega)\cdot\Gamma_{RR}(\omega)=0 \tag{12}$$

$$\text{where } \Gamma_{EE_1}(\omega)=\Gamma_{LL}(\omega)-\Gamma_{RR}(\omega)\cdot|H_W(\omega)|^2 \tag{13}$$

Consequently, the noise power spectral density, $\Gamma_{NN}(\omega)$ can be estimated by solving the quadratic equation in (12), which will produce two solutions:

$$\Gamma_{NN}(\omega)=\frac{1}{2}(\Gamma_{LL}(\omega)+\Gamma_{RR}(\omega))\pm\Gamma_{LRavg}(\omega) \text{ where} \tag{14}$$

$$\Gamma_{LRavg}(\omega)=\frac{1}{2}\sqrt{(\Gamma_{LL}(\omega)+\Gamma_{RR}(\omega))^2-4\cdot\Gamma_{EE1}(\omega)\cdot\Gamma_{RR}(\omega)} \tag{15}$$

Below we demonstrate that $\Gamma_{LRavg}(\omega)$ in (15) is equivalent to the average of the left and right noise-free speech power spectral densities. Consequently, the "negative root" in (14) is the one leading to the correct estimation for $\Gamma_{NN}(\omega)$. Substituting (13) into (15) yields:

$$\begin{aligned}\Gamma_{LRavg}(\omega)&=\frac{1}{2}\sqrt{(\Gamma_{LL}(\omega)+\Gamma_{RR}(\omega))^2-4\cdot(\Gamma_{LL}(\omega)-\Gamma_{RR}(\omega)\cdot|H_W(\omega)|^2)\cdot\Gamma_{RR}(\omega)}\\&=\frac{1}{2}\sqrt{(\Gamma_{LL}(\omega)+\Gamma_{RR}(\omega))^2-4\cdot(\Gamma_{LL}(\omega)\cdot\Gamma_{RR}(\omega)-\Gamma_{RR}^2(\omega)\cdot|H_W(\omega)|^2)}\end{aligned} \tag{16}$$

Substituting (11) into (16) yields:

$$\Gamma_{LRavg}(\omega)=\frac{1}{2}\sqrt{(\Gamma_{LL}(\omega)+\Gamma_{RR}(\omega))^2-4\cdot\left(\begin{array}{c}\Gamma_{LL}(\omega)\cdot\Gamma_{RR}(\omega)-\\((\Gamma_{LL}(\omega)-\Gamma_{NN}(\omega))\cdot(\Gamma_{RR}(\omega)-\Gamma_{NN}(\omega)))\end{array}\right)} \tag{17}$$

After a few simplifications, the following is obtained:

$$\begin{aligned}\Gamma_{LRavg}(\omega)&=\frac{1}{2}\sqrt{((\Gamma_{LL}(\omega)+\Gamma_{RR}(\omega))-2\cdot\Gamma_{NN}(\omega))^2}\\&=\frac{1}{2}(\Gamma_{LL}(\omega)+\Gamma_{RR}(\omega)-2\cdot\Gamma_{NN}(\omega))\end{aligned} \tag{18}$$

As expected, looking at (18), $\Gamma_{LRavg}(\omega)$ is equal to the average of the left and right noise-free speech power spectral densities. Consequently, substituting (18) into (14), it can easily be noticed that only the "negative root" leads to the correct solution for $\Gamma_{NN}(\omega)$ as the following:

$$\begin{aligned}\Gamma_{NN}(\omega)&=\frac{1}{2}(\Gamma_{LL}(\omega)+\Gamma_{RR}(\omega))-\Gamma_{LRavg}(\omega)\\&=\frac{1}{2}(\Gamma_{LL}(\omega)+\Gamma_{RR}(\omega))-\frac{1}{2}(\Gamma_{LL}(\omega)+\Gamma_{RR}(\omega)-2\cdot\Gamma_{NN}(\omega))\\&=\Gamma_{NN}(\omega)\end{aligned} \tag{19}$$

Consequently, the noise power spectral density estimator can be described at this moment using (13), (14) with the negative root and (15). However, using $\Gamma_{EE_1}(\omega)$ as in (13) does not yield an accurate estimate of $\Gamma_{NN}(\omega)$ in practice, as briefly introduced at the beginning of section III. The explanation is as follows: it will be shown in the next section that $\Gamma_{EE_1}(\omega)$ is in fact the auto-power spectral density of the prediction residual (or error), e(i), shown in FIG. 1. The direct computation of this auto-power spectral density from the samples of e(i) is referred to as $\Gamma_{EE}(\omega)$ here, while the indirect computation using (13) is referred to as $\Gamma_{EE_1}(\omega)$. $\Gamma_{EE_1}(\omega)$ and $\Gamma_{EE}(\omega)$ are theoretically equivalent, however only estimates of the different power spectral densities are available in practice to compute (5), (14), (15) and (13), and the resulting estimation of $\Gamma_{NN}(\omega)$ in (14) is not as accurate if $\Gamma_{EE_1}(\omega)$ is used. This is because the difference between the true and the estimated Wiener solutions for (5) can lead to large fluctuations in $\Gamma_{EE_1}(\omega)$, when evaluated using (13). As opposed to $\Gamma_{EE_1}(\omega)$, the direct estimation of $\Gamma_{EE}(\omega)$ is not subject to those large fluctuations. The direct and indirect computations of this variable have been compared analytically and experimentally, by taking into consideration a non-ideal (i.e. estimated) Wiener solution. It was found that using the direct computation yields a much greater accuracy in terms of the noise PSD estimation. Due to space constraints, this will not be demonstrated in the paper.

B. Direct Computation of the Error Auto-Power Spectrum

This section will demonstrate that $\Gamma_{EE_1}(\omega)$ is also the auto-power spectral density of the prediction residual (or error), e(i), represented in FIG. 1. It will also finalize the proposed algorithm designed for estimating the noise PSD in a diffuse noise field environment.

The prediction residual error is defined as:

$$e(i)=l(i)-\tilde{l}(i) \tag{20}$$

$$=l(i)-r(i)\otimes h_w(i) \tag{21}$$

As previously mentioned in section IIIa), the direct computation of this auto-power spectral density from the samples of e(i) is referred to as $\Gamma_{EE}(\omega)$ and the indirect computation using (13) is referred to as $\Gamma_{EE_1}(\omega)$. From FIG. 1 and the definition of e(i), we have:

$$\Gamma_{EE}(\omega)=F.T.(\gamma_{ee}(\tau)) \tag{22}$$

where $$\begin{aligned}\gamma_{ee}(\tau)&=E(e(i+\tau)\cdot e(i))=E\left(\left[l(i+\tau)-\tilde{l}(i+\tau)\right]\cdot\left[l(i)-\tilde{l}(i)\right]\right)=\\&E[l(i+\tau)l(i)]-E\left[l(i+\tau)\tilde{l}(i)\right]-E\left[\tilde{l}(i+\tau)l(i)\right]+E\left[\tilde{l}(i+\tau)\tilde{l}(i)\right]=\\&\gamma_{ll}(\tau)-\gamma_{l\tilde{l}}(\tau)-\gamma_{\tilde{l}l}(\tau)+\gamma_{\tilde{l}\tilde{l}}(\tau)\end{aligned} \tag{23}$$

As seen in (23), $\gamma_{ee}(\tau)$ is thus the sum of 4 terms, where the following temporal and frequency domain definitions for each term are:

$$\gamma_{ll}(\tau)=E\left(\begin{array}{c}[s(i+\tau)\otimes h_l(i)+n_l(i+\tau)]\cdot\\[s(i)\otimes h_l(i)+n_l(i)]\end{array}\right)=\gamma_{ss}(\tau)\otimes h_l(\tau)\otimes h_l(-\tau)+\gamma_{nn}(\tau) \tag{24}$$

$$\Gamma_{LL}(\omega)=\Gamma_{SS}(\omega)|H_L(\omega)|^2+\Gamma_{NN}(\omega) \tag{25}$$

-continued $$\gamma_{\bar{l}\bar{l}}(\tau) = E\left(\begin{matrix}[s(i+\tau)\otimes h_l(i)+n_l(i+\tau)]\cdot \\ [[s(i)\otimes h_r(i)+n_r(i)]\otimes h_w(i)]\end{matrix}\right) = \gamma_{ss}(\tau)\otimes h_l(\tau)\otimes h_r(-\tau)\otimes h_W(-\tau) \tag{26}$$

$$\Gamma_{\bar{L}\bar{L}}(\omega) = \Gamma_{SS}(\omega)H_L(\omega)H_R^*(\omega)H_W^*(\omega) \tag{27}$$

$$\gamma_{\bar{l}\bar{l}}(\tau) = E\left(\begin{matrix}[[s(i+\tau)\otimes h_r(i)+n_r(i+\tau)]\otimes h_w(i)]\cdot \\ [s(i)\otimes h_l(i)+n_l(i)]\end{matrix}\right) = \gamma_{ss}(\tau)\otimes h_l(-\tau)\otimes h_r(\tau)\otimes h_W(\tau) \tag{28}$$

$$\Gamma_{\bar{L}\bar{L}}(\omega) = \Gamma_{SS}(\omega)H_L^*(\omega)H_R(\omega)H_W(\omega) \tag{29}$$

$$\gamma_{\bar{l}\bar{l}}(\tau) = E\left(\begin{matrix}[[s(i+\tau)\otimes h_r(i)+n_r(i+\tau)]\otimes h_w(i)]\cdot \\ [[s(i)\otimes h_r(i)+n_r(i)]\otimes h_w(i)]\end{matrix}\right) = \gamma_{ss}(\tau)\otimes h_r(\tau)\otimes h_r(-\tau)\otimes h_W(\tau)\otimes h_W(-\tau) + \gamma_{nn}(\tau)\otimes h_W(\tau)\otimes h_W(-\tau) \tag{30}$$

$$\Gamma_{\bar{L}\bar{L}}(\omega) = \Gamma_{SS}(\omega)|H_R(\omega)|^2|H_W(\omega)|^2 + \Gamma_{NN}(\omega)|H_W(\omega)|^2 = \Gamma_{RR}(\omega)|H_W(\omega)|^2 \tag{31}$$

From (23), we can write:

$$\Gamma_{EE}(\omega)=\Gamma_{LL}(\omega)-\Gamma_{L\bar{L}}(\omega)-\Gamma_{\bar{L}L}(\omega)+\Gamma_{\bar{L}\bar{L}}(\omega) \tag{32}$$

and substituting all the terms in their respective frequency domain forms, i.e. (27), (29) and (31) into (32), yields:

$$\Gamma_{EE}(\omega)=\Gamma_{LL}(\omega)+\Gamma_{RR}(\omega)\cdot|H_w(\omega)|^2-2\cdot\Gamma_{SS}(\omega)\cdot Re)H_L(\omega)\cdot H_R^*(\omega)\cdot H_w^*(\omega)) \tag{33}$$

Multiplying both sides of (10) by $H_W^*(\omega)$ and substituting for $Re(H_L(\omega)\cdot H_R^*(\omega)\cdot H_W^*(\omega))$ in (33), (33) is simplified to:

$$\Gamma_{EE}(\omega)=\Gamma_{LL}(\omega)-\Gamma_{RR}(\omega)\cdot|H_W(\omega)|^2 \tag{34}$$

As demonstrated, (34) is identical to (13), and thus $\Gamma_{EE_1}(\omega)$ in (13) represents the auto-PSD of e(i).

To sum up, an estimate for $\Gamma_{EE}(\omega)$ computed directly from the signal e(i) as depicted in FIG. 1 is to be used in practice instead of estimating $\Gamma_{EE_1}(\omega)$ indirectly through (13). Consequently, replacing $\Gamma_{EE\ 1}(\omega)$ by $\Gamma_{EE}(\omega)$ in (15), the proposed noise estimation algorithm is obtained, described by (14) with the negative root, (15) with $\Gamma_{EE}(\omega)$ replacing $\Gamma_{EE_1}(\omega)$ and computed as in (22).

C. Low Frequency Compensation

Analogous to the noise estimation approach in [2], the technique proposed in the previous sub-sections will produce an underestimation of the noise PSD at low frequencies. This is due to fact that a diffuse noise field exhibits a high coherence between the left and right channels at low frequencies, which is a known characteristic as explained in section IIa). The left and right noise channels are then uncorrelated over most of the frequency spectrum except at low frequencies. The technique proposed in the previous sub-sections assumes uncorrelated noise components, thus it considers the correlated noise components to belong to the target speech signal, and consequently, an underestimation of the noise PSD occurs at low frequencies. The following will show how to circumvent this underestimation:

For a speech enhancement platform where the noise signals are picked up by two or more microphones such as in beam-forming systems or any type of multi-channel noise reduction schemes, a common measure to characterize noise fields is the complex coherence function [4][10]. The latter can be seen as a tool that provides the correlation of two received noise signals based on the cross- and auto-power spectral densities. This coherence function can also be referred to as the spatial coherence function and is evaluated as follows:

$$\psi_{LR}(\omega) = \frac{\Gamma_{LR}(\omega)}{\sqrt{\Gamma_{LL}(\omega)\cdot\Gamma_{RR}(\omega)}} \tag{35}$$

We assume here to have a 2-channel system with the microphones/sensors labeled as the left and right microphones and that the distance between them is d. Then, $\Gamma_{LR}(\omega)$ is the cross-power spectral density between the left and right received noise signals, and $\Gamma_{LL}(\omega)$ and $\Gamma_{RR}(\omega)$ are the auto-power spectral densities of left and right signals respectively. The coherence has a range of $|\psi_{LR}(\omega)|\leq 1$ and is primarily a normalized measure of correlation between the signals at two points (i.e. positions) in a noise field. Moreover, it was found that the coherence function of a diffuse noise field is in fact real-valued and an analytical model has been developed for it. The model is given by [4][11]:

$$\psi_{LR}(f) = sinc\left(\frac{2\cdot\pi\cdot f\cdot d_{LR}}{c}\right) \tag{36}$$

where $d_{LR}$ is distance between the left and right microphones and c is the speed of sound.

However, this model was derived for two omni-directional microphones in free space. But in terms of binaural hearing, the directionality and diffraction/reflection due to the pinna and the head will have some influence, and the analytical model assuming microphones in free space represented in (36) should be re-adjusted to take into account the presence of the head (i.e. the microphones are no longer in free space). In [3], it is stated that below a certain frequency ($f_c$), the correlation of the microphone signals in a free diffuse sound field cannot be considered negligible, since the correlation continuously increases below that frequency. In a free diffuse sound field, this frequency only depends on the distance of the microphones, and it is shifted downwards if a head is in between. In their paper, using dummy head recordings with 16 cm spacing of binaural microphone pairs, $f_c$ was found to be about 400 Hz. Similar results have been reported in [8]. In our work, the adjustment of the analytical diffuse noise model of (36) has been undertaken as follows: the coherence function of (35) was evaluated using real diffuse cafeteria noise signals. The left and right noise signals used in the simulation were provided by a hearing aids manufacturer and were collected from hearing aids microphone recordings mounted on a KEMAR mannequin (i.e. Knowles Electronic Manikin for Acoustic Research). The distance parameter was then equal to the distance between the dummy head ears. The KEMAR was placed in a crowded university cafeteria environment. It was found that the effect brought by having the microphones placed on human ears as opposed to the free space reduces the bandwidth of the low frequency range where the high correlation part of a diffuse noise field is present (agreeing with the results in [3][8]), and that it also slightly decreases the correlation magnitudes.

Consequently, it was established by simulation that by simply increasing the distance parameter of the analytical diffuse noise model of (36) (i.e. with microphones in free space) and applying a factor less than one to the latter, it was possible to have a modified analytical model matching (i.e. curve fitting) the experimental coherence function evaluated using the real binaural cafeteria noise, as it will shown in the simulation results of section IV.

Now, in order to use the notions gathered above and modify the noise PSD estimation equations found for uncorrelated noise signals, some of the key equations previously derived need to be re-written by taking into account the noise correlation at low frequencies. The cross-power spectral density between the left and right noisy channels in (9) becomes at low frequencies:

$$\Gamma_{LR}^{C}(\omega)=\Gamma_{SS}(\omega)\cdot H_L(\omega)\cdot H_R^*(\omega)+\Gamma_{N_LN_R}(\omega) \tag{37}$$

where $\Gamma_{N_LN_R}(\omega)$ is the noise cross-power spectral density between the left and right channel. The upper script "C" is to differentiate between the previous equation (9) and the new one taking into account the low frequency noise correlation. Therefore, the Wiener solution becomes:

$$H_W^C(\omega)=\frac{\Gamma_{LR}(\omega)}{\Gamma_{RR}(\omega)}=\frac{\Gamma_{SS}(\omega)\cdot H_L(\omega)\cdot H_R^*(\omega)+\Gamma_{N_LN_R}(\omega)}{\Gamma_{RR}(\omega)} \tag{38}$$

Using the definition in (35), the coherence function of any noise field can be expressed as:

$$\psi(\omega)=\frac{\Gamma_{N_LN_R}(\omega)}{\sqrt{\Gamma_{N_LN_L}(\omega)\Gamma_{N_RN_R}(\omega)}}=\frac{\Gamma_{N_LN_R}(\omega)}{\Gamma_{NN}(\omega)}. \tag{39}$$

Consequently, the noise cross-power spectral density, $\Gamma_{N_LN_R}(\omega)$, can be expressed by:

$$\Gamma_{N_LN_R}(\omega)=\psi(\omega)\cdot\Gamma_{NN}(\omega) \tag{40}$$

For the remaining of this section, the noise cross-power spectral density, $\Gamma_{N_LN_R}(\omega)$, will be replaced by $\omega(\omega)\cdot\Gamma_{NN}(\omega)$ in any equation. Following the procedure employed to find the noise PSD estimator derived in section IIIa), and starting again from the squared magnitude response of the Wiener filter, we get:

$$|H_W(\omega)|^2=\frac{(\Gamma_{LL}(\omega)-\Gamma_{NN}(\omega))\cdot(\Gamma_{RR}(\omega)-\Gamma_{NN}(\omega))+\psi^2(\omega)\cdot\Gamma_{NN}^2(\omega)+\Gamma_A(\omega)}{\Gamma_{RR}^2(\omega)} \tag{41}$$

where:

$$\Gamma_A(\omega)=2\cdot\psi(\omega)\cdot\Gamma_{NN}(\omega)\cdot\Gamma_{SS}(\omega)\cdot\mathrm{Re}\{H_L(\omega)\cdot H_R^*(\omega)\} \tag{42}$$

and using (38) and (40), $\Gamma_A(\omega)$ can be rewritten as:

$$\begin{aligned}\Gamma_A(\omega)&=2\cdot\psi(\omega)\cdot\Gamma_{NN}(\omega)\cdot\mathrm{Re}\{H_W^C(\omega)\Gamma_{RR}(\omega)-\psi(\omega)\cdot\Gamma_{NN}(\omega)\}\\&=2\cdot\psi(\omega)\cdot\Gamma_{NN}(\omega)\cdot\Gamma_{RR}(\omega)\cdot\mathrm{Re}\{H_W^C(\omega)\}-\\&\quad 2\cdot\psi^2(\omega)\cdot\Gamma_{NN}^2(\omega)\end{aligned} \tag{43}$$

Substituting (43) into (41) and after a few simplifications, the noise PSD estimation is found by solving the following quadratic equation:

$$(1-\psi^2(\omega))\cdot\Gamma_{NN}^2(\omega)+\Gamma_{NN}(\omega)\cdot\begin{pmatrix}-(\Gamma_{LL}(\omega)+\Gamma_{RR}(\omega))+\\2\cdot\psi(\omega)\cdot\mathrm{Re}\{H_W^C(\omega)\}\end{pmatrix}+\Gamma_{\varepsilon\varepsilon_1}(\omega)\cdot\Gamma_{RR}(\omega))=0 \tag{44}$$

where again $\Gamma_{EE_1}^{C}(\omega)=\Gamma_{LL}(\omega)-\Gamma_{RR}(\omega)\cdot|H_W^C(\omega)|^2$, which was referred to as the indirect computation approach explained in section IIIa).

Similar to section IIIb), it will be demonstrated here again that $\Gamma_{EE_1}^{C}(\omega)$ is still equal to the auto-power spectral density of the prediction error e(i) (i.e. $\Gamma_{EE}^{C}(\omega)$=F.T.($\gamma_{ee}(\tau)$)), and $\Gamma_{EE}^{C}(\omega)$ is referred to as the direct computation approach as explained in section IIIb). We had established in section IIIb), that the auto power spectral density of the residual error was the sum of four terms as shown by (32). By taking into account the low frequency noise correlation, two of the terms in (32), namely $\Gamma_{L\bar{L}}(\omega)$ and $\Gamma_{\bar{L}L}(\omega)$, will be modified as follows:

$$\Gamma_{EE}^{C}(\omega)=\Gamma_{LL}(\omega)-\Gamma_{L\bar{L}}^{C}(\omega)-\Gamma_{\bar{L}L}^{C}(\omega)+\Gamma_{\bar{L}\bar{L}}(\omega) \tag{45}$$

where:

$$\begin{aligned}\Gamma_{L\bar{L}}^{C}(\omega)&=\Gamma_{L\bar{L}}(\omega)+\psi(\omega)\cdot\Gamma_{NN}(\omega)\cdot(H_W^C(\omega))^*\\&=\Gamma_{SS}(\omega)\cdot H_L(\omega)\cdot H_R^*(\omega)\cdot(H_W^C(\omega))^*+\\&\quad\psi(\omega)\cdot\Gamma_{NN}(\omega)\cdot(H_W^C(\omega))^*\end{aligned} \tag{46}$$

and $$\begin{aligned}\Gamma_{\bar{L}L}^{C}(\omega)&=\Gamma_{\bar{L}L}(\omega)+\psi(\omega)\cdot\Gamma_{NN}(\omega)\cdot H_W^C(\omega)\\&=\Gamma_{SS}(\omega)\cdot H_L^*(\omega)\cdot H_R(\omega)\cdot H_W^C(\omega)+\\&\quad\psi(\omega)\cdot\Gamma_{NN}(\omega)\cdot H_W^C(\omega)\end{aligned} \tag{47}$$

Adding all the terms in (45), we get:

$$\Gamma_{EE}^{C}(\omega)=\Gamma_{EE}(\omega)+2\cdot\psi(\omega)\cdot\Gamma_{NN}(\omega)\cdot\mathrm{Re}\{H_W^C\} \tag{48}$$

$$=\Gamma_{NN}(\omega)\cdot\left(1+|H_W^C(\omega)|^2\right)+\Gamma_{SS}(\omega)\cdot|H_L(\omega)|^2+\Gamma_{SS}(\omega)\cdot|H_R(\omega)|^2\cdot|H_W^C(\omega)|^2+\Gamma_B(\omega) \tag{49}$$

where:

$$\Gamma_B(\omega)=-2\cdot\Gamma_{SS}(\omega)\cdot\mathrm{Re}(H_L^*(\omega)\cdot H_R(\omega)\cdot H_W^C(\omega))+2\cdot\psi(\omega)\cdot\Gamma_{NN}(\omega)\cdot\mathrm{Re}\{H_W^C(\omega)\} \tag{50}$$

Using the complex conjugate of (38) (i.e. $(H_W^C(\omega))^*$) and (40) in (50), (50) simplifies to:

$$\begin{aligned}\Gamma_B(\omega)&=-2\cdot\mathrm{Re}\{((H_W^C(\omega))^*\cdot\Gamma_{RR}(\omega)-\psi(\omega)\cdot\Gamma_{NN}(\omega))\cdot H_W^C(\omega)\}+\\&\quad 2\cdot\psi(\omega)\cdot\Gamma_{NN}(\omega)\cdot\mathrm{Re}\{H_W^C(\omega)\}\\&=2\cdot|H_W^C(\omega)|^2\cdot\Gamma_{RR}(\omega)\end{aligned} \tag{51}$$

Replacing (51) in (49) and using (3) and (4), $\Gamma_{EE}^{C}(\omega)$ becomes:

$$\Gamma_{EE}^{C}(\omega)=\Gamma_{LL}(\omega)-\Gamma_{RR}(\omega)\cdot|H_W^C(\omega)|^2 \tag{52}$$

We can see that the equality still holds that is: $\Gamma_{EE}^{C}(\omega)=\Gamma_{EE_1}^{C}(\omega)$.

To finalize, solving the quadratic equation in (44) and using $\Gamma_{EE}^{C}(\omega)$ instead of $\Gamma_{EE_1}^{C}(\omega)$, the noise PSD estimation for a diffuse noise field environment without neglecting the low frequency correlation is given by (53)-(55):

$$\Gamma_{NN}(\omega)=\frac{1}{2\cdot(1-\psi^2(\omega))}\begin{pmatrix}\Gamma_{LL}(\omega)+\Gamma_{RR}(\omega)-2\cdot\psi(\omega)\cdot\\\Gamma_{RR}(\omega)\cdot\mathrm{Re}\{H_W^C(\omega)\}-\Gamma_{root}(\omega)\end{pmatrix} \tag{53}$$

where:

-continued $$\Gamma_{root}(\omega) = \sqrt{\left(\begin{array}{c} -(\Gamma_{LL}(\omega) + \Gamma_{RR}(\omega)) + \\ 2 \cdot \psi(\omega) \cdot \Gamma_{RR}(\omega) \cdot \mathrm{Re}\{H_W^C(\omega)\} \end{array}\right)^2 - 4 \cdot (1 - \psi^2(\omega)) \cdot \Gamma_{EE}^C(\omega)\Gamma_{RR}(\omega)} \quad (54)$$

and $$\Gamma_{EE}^C(\omega) = F.T.(\gamma_{ee}(\tau)) = F.T.\{E(e(i+\tau) \cdot e(i))\} \quad (55)$$

From (38), the product $\Gamma_{RR}(\omega) \cdot \mathrm{Re}\{H_W{}^C(\omega)\}$ in (54) is equivalent to $\mathrm{Re}\{\Gamma_{LR}(\omega)\}$.

It should be noted that under highly reverberant environments, the speech components received at the two ears become also partly diffuse, and that the proposed PSD noise estimator would detect the reverberant (or diffuse) part of the speech as noise. This estimator could thus potentially be used by a speech enhancement algorithm to reduce the reverberation found in the received speech signal.

D. Case of Additional Directional Interferences

This paper focuses on noise PSD estimation for the case of a single directional target source combined with background diffuse noise. For more general cases where there would also be directional interferences (i.e. directional noise sources), the behavior of the proposed diffuse noise PSD estimator is briefly summarized below. The components on the left and right channels that remain fully or strongly cross-correlated are called here the "equivalent" left and right directional source signals, while the components on the left and right channel that have poor or zero cross-correlation are called here the "equivalent" left and right noise signals. Note that with this definition some of the equivalent noise signal components include original directional target and interference signal components that can no longer be predicted from the other channel, because predicting a sum of directional signals from another sum of directional signals no longer allows a perfect prediction (i.e. the cross-correlation between the two sums of signals is reduced). With these equivalent source and noise signals, the proposed noise PSD estimator remains the same as described in the paper, however some of the assumptions made in the development of the estimator may no longer be fully met: 1) the PSD of the left and right equivalent noise components may no longer be the same, and 2) the equivalent source and noise signals on each channel may no longer be fully uncorrelated. The PSD noise estimator may thus become biased in such cases. Nevertheless, it was found through several speech enhancement experiments under complex acoustic environments (including reverberation, diffuse noise, and several non-stationary directional interferences) that the proposed diffuse noise PSD estimator can still provide a useful estimate, and this will be presented and further discussed in a future paper on binaural speech enhancement.

Simulation Results

In the first subsection, various simulated hearing scenarios will be described where a target speaker is located anywhere around a binaural hearing aid user in a noisy environment. In the second subsection, the accuracy of the proposed binaural noise PSD estimation technique, fully elaborated in section III, will be compared with two advanced noise PSD estimation techniques, namely the noise PSD estimation approach based on minimum statistics in [1] and the cross-power spectral density method in [2]. The noise PSD estimation will be performed on the scenarios presented in the first subsection. The performance under highly non-stationary noise conditions will also be analyzed.

A. Simulation Setup and Hearing Situations

The following is the description of various simulated hearing scenarios where the noise PSD will be estimated. It should be noted that all data used in the simulations such as the binaural speech signals and the binaural noise signals were provided by a hearing aid manufacturer and obtained from "Behind The Ear" (BTE) hearing aids microphone recordings, with microphones installed at the left and the right ears of a KEMAR dummy head, with a 16 cm distance between the cars. For instance, the dummy head was rotated at different positions to receive the target source speech signal at diverse azimuths and the source speech signal was produced by a loudspeaker at 1.5 meters from the KEMAR. Also, the KEMAR had been installed in different noisy environments such as a university cafeteria, to collect real life noise-only data. Speech and noise sources were recorded separately. It should be noted that the target speech source used in the simulation was purposely recorded in a reverberant free environment to avoid an overestimation of the diffuse noise PSD due to the tail of reverberation. As briefly introduced at the end of section III, this overestimation can actually be beneficial since the proposed binaural estimator can also be used by a speech enhancement algorithm to reduce reverberation. The clarification is as the following:

Considering the case of a target speaker in a noise-free but highly reverberant environment, the received target speech signal for each channel will typically be the sum of several components such as components emerging from the direct sound path, from the early reflections and from the tail of reverberation. Considering the relation between the signal components received for the left channel, the direct signal will be highly correlated with its early reflections. Thus, the direct signal and its reflections can be regrouped together and referred to as "left source signals". By applying the same reasoning for the right channel, the combination of direct signal and its early reflections can be referred to as "right source signals". The "left source signals" can be then considered highly correlated to its corresponding "right source signals". It is stated in [12] that the left and right components emerging from the tail of reverberation will have diffuse characteristics instead, which by definition means that they will have equal energy and they will be mutually uncorrelated (except at low frequencies). Therefore, it can be implied that the components emerging from the tail of the reverberation will not be correlated (or only poorly correlated) with their left and right "source signals". As a result, the proposed binaural diffuse noise estimator will detect those uncorrelated components from the tail of reverberation as "diffuse noise". Moreover, de-noising experiment results that we performed have shown that the proposed diffuse noise PSD estimator can be effective at reducing the reverberation when combined with a speech enhancement algorithm. This is to be included and further discussed in a future paper.

If the reverberant environment already contains background diffuse noise such as babble-talk, the noise PSD estimate obtained from the proposed binaural estimator will be the sum of the diffuse babble-talk noise and the diffuse "noise" components emerging from the tail of reverberation. In this paper, for an appropriate comparison between the different noise PSD estimators, the target speech source in our simulation did not contain any reverberation, in order to only estimate the injected diffuse noise PSD from the babble talk and to allow a direct comparison with the original noise PSD.

Scenario a):

The target speaker is in front of the binaural hearing aid user (i.e. azimuth=) 0° and the additive corrupting binaural noise used in the simulation has been obtained from the binaural recordings in a university cafeteria (i.e. cafeteria babble-noise). The noise has the characteristics of a diffuse noise field as discussed in section IIa).

Scenario b):

The target speaker is at 90° to the right of the binaural hearing aid user (i.e. azimuth=90°) and located again in a diffuse noise field environment (i.e. cafeteria babble-noise)

Scenario c):

The target speaker is in front of the binaural hearing aid user (i.e. azimuth=0°) similar to scenario a). However, even though the original noise coming from a cafeteria is quite non-stationary, its power level will be purposely increased and decreased during selected time period to simulate highly non-stationary noise conditions. This scenario could be encountered for example if the user is entering or exiting a noisy cafeteria, etc.

B. Noise Estimation Techniques Evaluation

For simplicity, the proposed binaural noise estimation technique of section III will be given the acronym: PBNE. The cross-power spectral density method in [2] and the minimum statistics based approach in [1] will be given the acronyms: CPSM and MSA, respectively. For our proposed technique, a least-squares algorithm with 80 coefficients has been used to estimate the Wiener solution of (5), which performs a prediction of the left noisy speech signal from the right noisy speech signal as illustrated in FIG. 1. It should be noted that the least-squares solution of the Wiener filter also included a causality delay of 40 samples. It can easily be shown that for instance when no diffuse noise is present, the time domain Wiener solution of (5) is then the convolution between the left HRIR and the inverse of the right HRIR. The optimum inverse of the right-side HRIR will typically have some non-causal samples (i.e. non minimal phase HRIR) and therefore the least-squares estimate of the Wiener solution should include a causality delay. Furthermore, this causality delay allows the Wiener filter to be on either side of the binaural system to consider the largest possible ITD. A modified distance parameter of 32 cm (i.e. double of the actual distance between the ears of the KEMAR (i.e. $d=d_{LR}\times 2$) has been selected for the analytical diffuse noise model of (35). This model has also been multiplied by a factor of 0.8. This factor of 0.8 is actually a conservative value because from our empirical results, the practical coherence obtained from the binaural cafeteria recordings would vary between 1.0 and 0.85 at the very low frequencies (below 500 Hz). The lower bound factor of 0.8 was selected to prevent a potential overestimation of our noise PSD at the very low frequencies, but it still provides good low frequency compensation. FIG. 2 illustrates the practical coherence obtained from the binaural cafeteria babble-noise recordings and the corresponding modified analytical diffuse noise model of (35) used in our technique. It can be noticed that the first zero of the practical coherence graph is at about 500 Hz and frequencies above about 300 Hz exhibits a coherence of less than 0.5, as expected. Similar results have been reported in [8]. All the PSD calculations have been made using Welch's method with 50% overlap, and a Hanning window has been applied to each segment.

1) PBNE Versus CPSM

Figure 3:
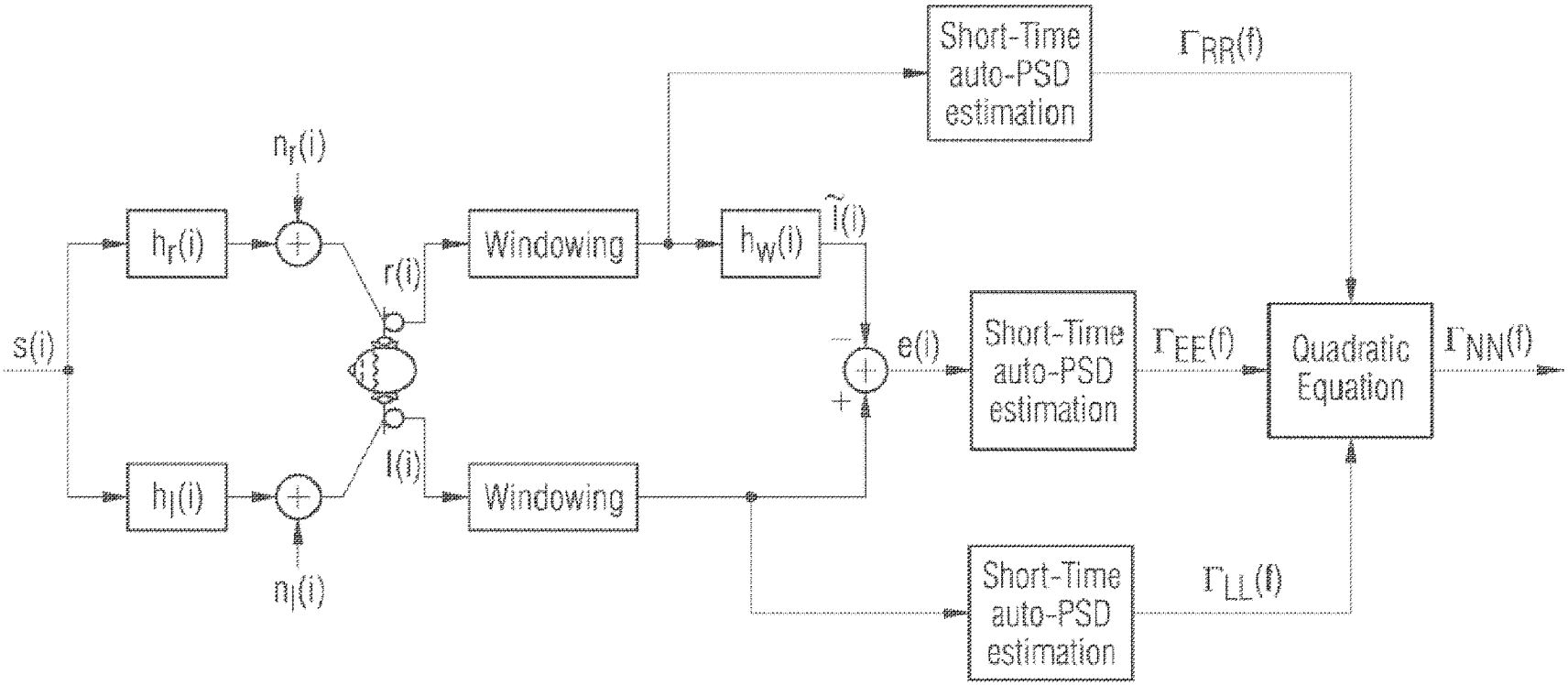
FIG. 3 is a diagram showing left and right noisy speech signals situation.
Figure 4:
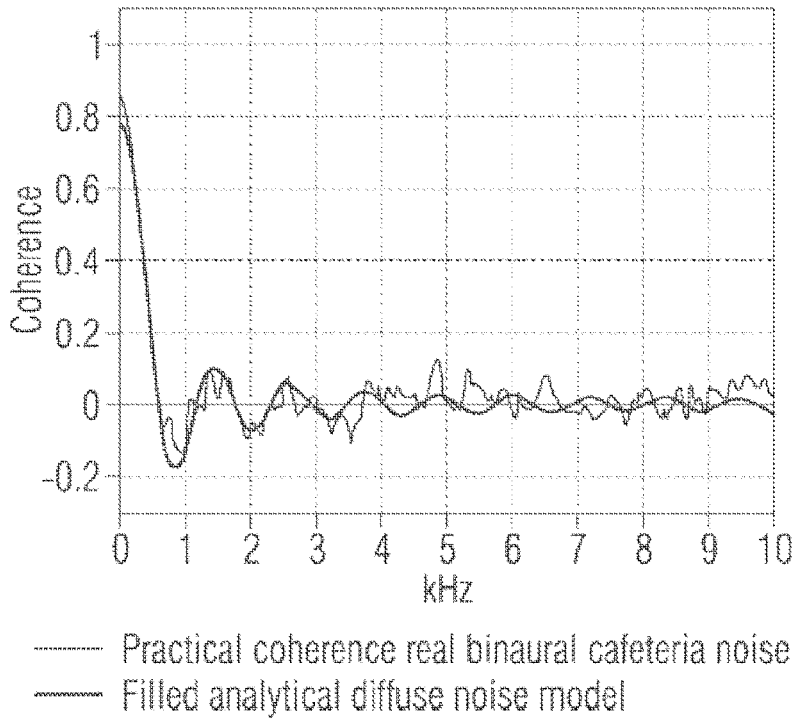
FIG. 4 shows left and right received and the left and right measured noise PSDs on the selected frame.
Figure 5:
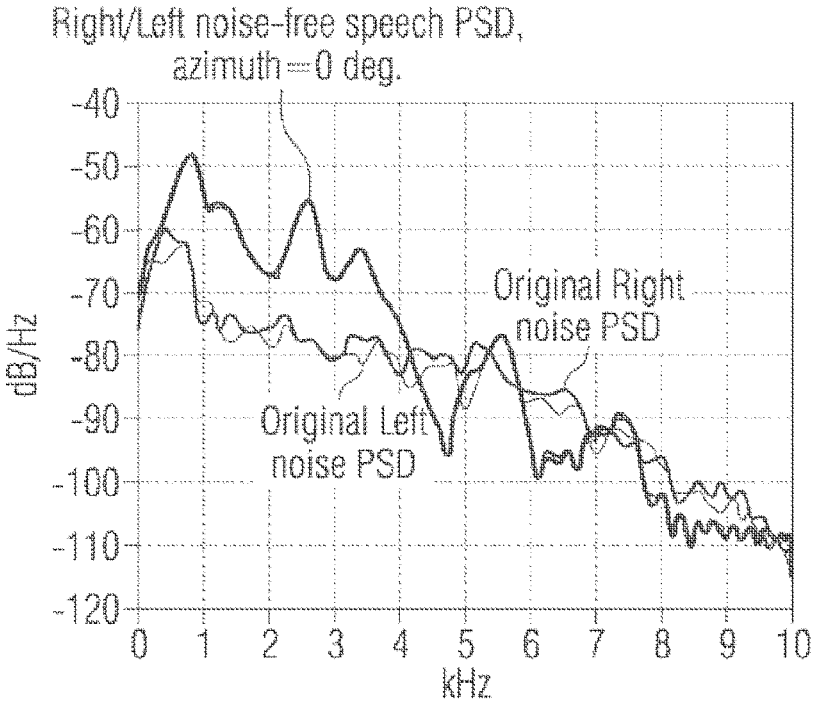
FIG. 5 shows a graph with the noise estimation results comparing the two techniques.
Figure 6:
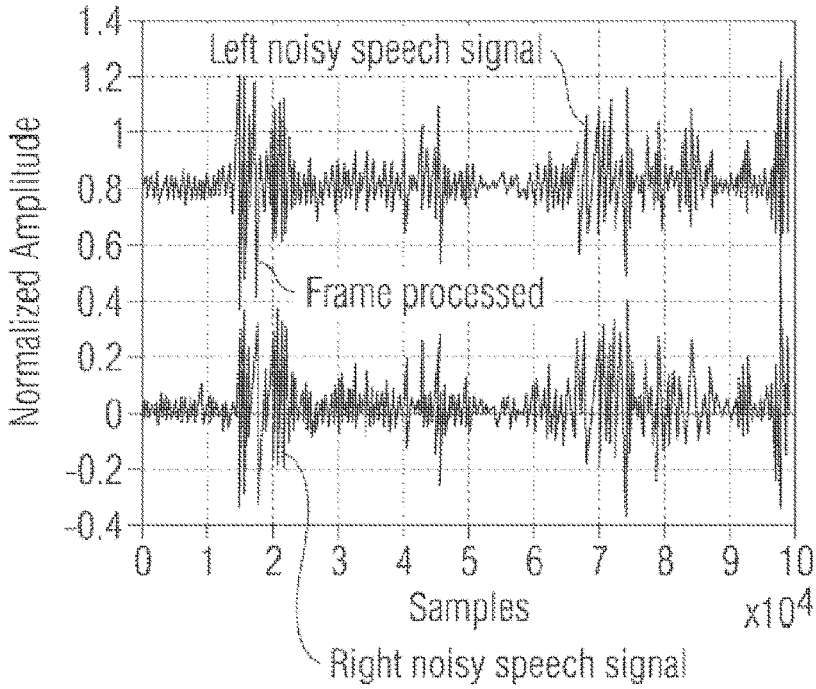
FIG. 6 shows the noise estimation results with various non-optimized head diameters and gain factors.
Figure 7:
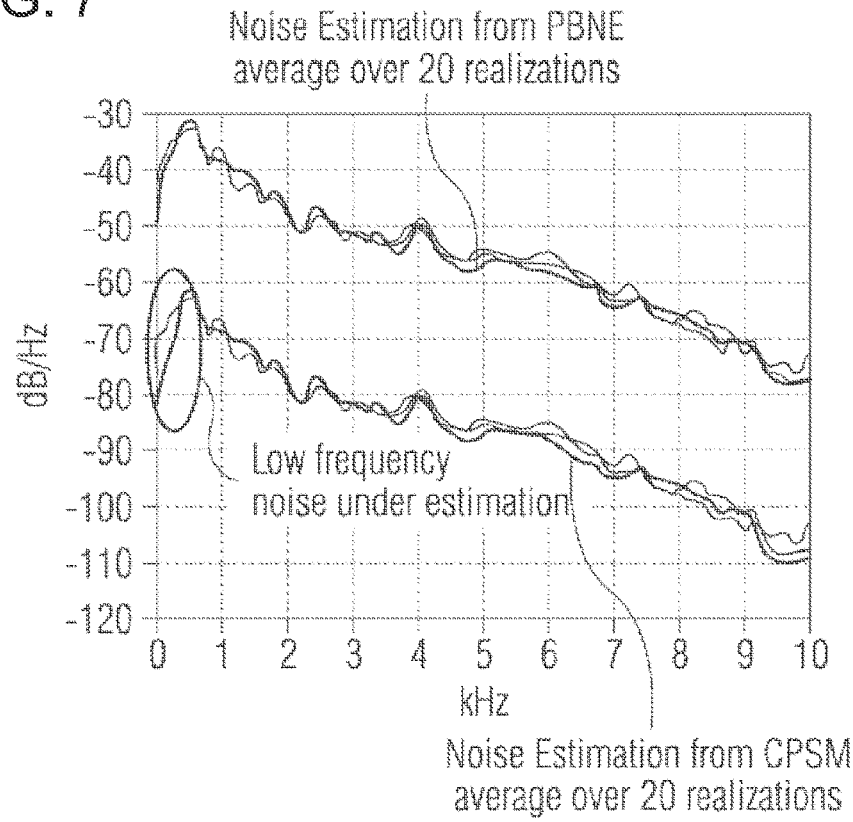
FIG. 7 follows with the corresponding error graphs of the PBNE noise PSD estimate for the various parameter settings.

Results for Scenario a):

the left and right noisy speech signals are shown in FIG. 3. The left and right SNRs are both equal to 5 dB since the speaker is in front of the hearing aid user. PBNE and CPSM have the advantage to estimate the noise on a frame-by-frame basis that is both techniques do not necessarily require the knowledge of previous frames to perform their noise PSD estimation. FIG. 3 also shows the frame where the noise PSD has been estimated. A frame length of 25.6 ms has been used at a sampling frequency of 20 kHz. Also, the selected frame purposely contained the presence of both speech and noise. The left and right received noise-free speech PSDs and the left and right measured noise PSDs on the selected frame are depicted in FIG. 4. It can be noticed that the measured noise obtained from the cafeteria has approximately the same left and right PSDs, which verifies one of the characteristics of a diffuse noise field as indicated in section IIb). Therefore, for convenience, the original left and right noise PSDs will be represented with the same font/style in all figures related to noise estimation results. The noise estimation results comparing the two techniques are given in FIG. 5. To better compare the results, instead of showing the results from only a single realization of the noise sequences, the results over an average of 20 realizations but still maintaining the same speech signal has been performed (i.e. by processing the same speech frame index with different noise sequences). For clarity, the results obtained with PBNE have been shifted vertically above the results from CPSM. From FIG. 5, it can be seen that both techniques provide a good noise PSD estimate, which closely tracks the original colored noise PSDs (i.e. cafeteria babble-noise). However, it can be noticed that CPSM suffers from an under estimation of the noise at low frequencies (here below about 500 Hz) as indicated in [3]. The underestimation is about 7 dB for this case. On the other hand, PBNE provides a good estimation even at low frequencies due to the compensation method developed in section IIIc). Even though the diameter of the head could be provided during the fitting stage for future high-end binaural hearing aids, the effect of the low frequency compensation by the PBNE approach was evaluated with different head diameters ($d_{LR}$) and gain factors, to evaluate the robustness of the approach in the case where the parameters selected for the modified diffuse noise model are not optimum. From the binaural cafeteria recordings provided by a hearing aids manufacturer, the experimental coherence obtained is as illustrated in FIG. 2. The optimum model parameters are $d_{LR}$=16 cm (which is multiplied by 2 in our modified analytical diffuse noise model for microphones not in free-field) and a factor=0.8. FIG. 6 shows the PBNE noise estimation results with various non-optimized head diameters and gain factors used with our approach, followed by the corresponding error graphs of the PBNE noise PSD estimate for the various parameter settings as depicted in FIG. 7. Each error graph was computed by taking the difference between the noise PSD estimate (in decibels) and the linear average of the original left and right noise PSDs converted in decibels. All the noise estimation results were obtained using equations (53-55), which incorporate the low frequency compensator. It can be seen that even with $d_{LR}$=14 cm (2 cm below the actual head diameter of the KEMAR) and a factor of 1.0, only a slight overestimation is noticeable at around 500 Hz. On the other hand, even with $d_{LR}$=20 cm (4 cm higher than the actual head diameter) where an underestimation result is expected at the low frequencies, the proposed method still provides a better noise PSD estimation than having no low frequency compensation for the lower frequencies (i.e. the result with $d_{LR}$=16 cm with factor=0.0).

Figure 8:
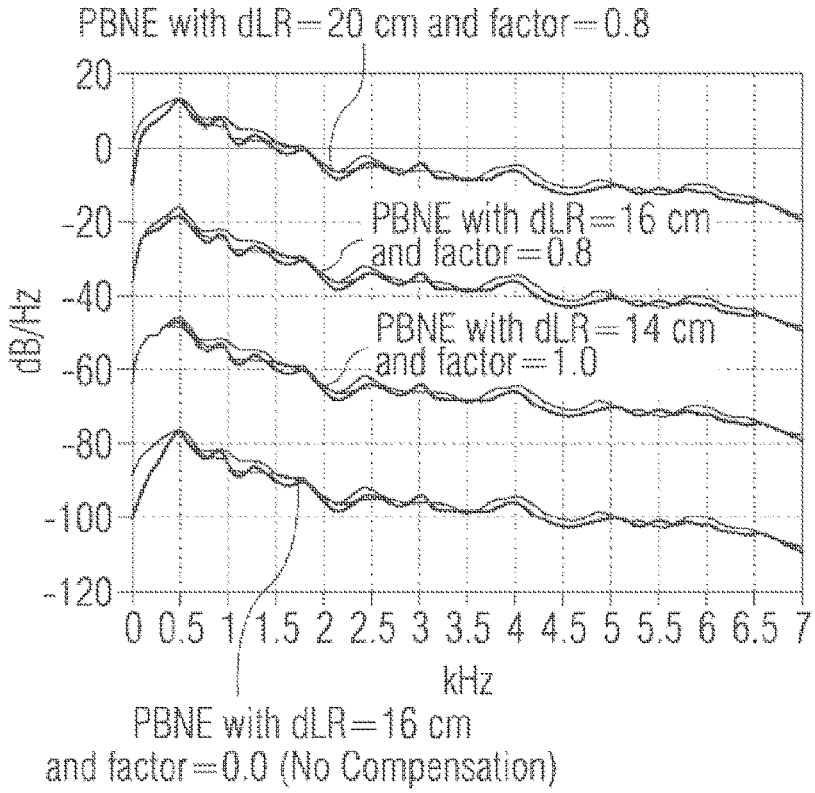
FIG. 8 shows that the received speech PSD levels in each frequency band are not comparable, which is shown for a speaker at 90° azimuth.
Figure 9:
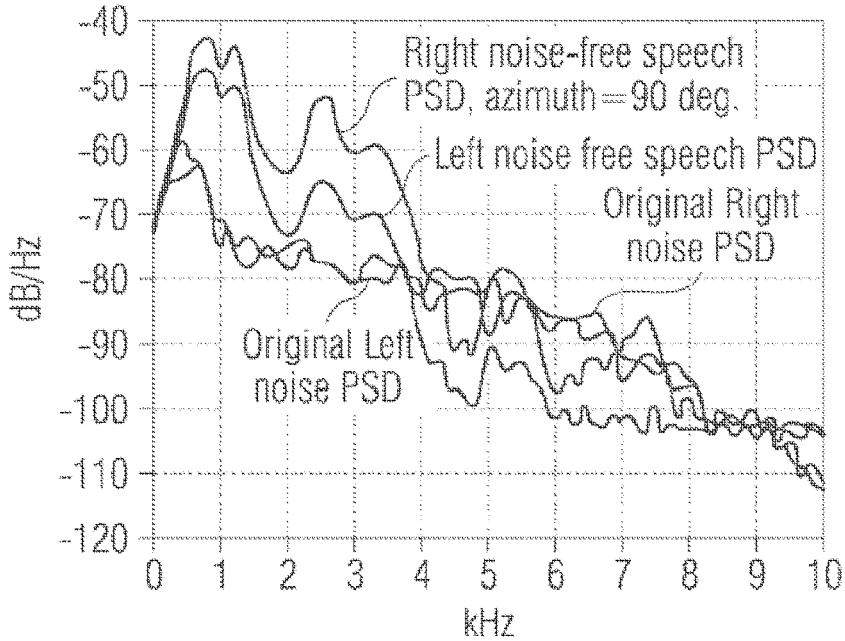
FIG. 9 shows the noise estimation results over an average of 20 realizations.

Results for Scenario b):

in contrast to scenario a), the location of the speaker has been changed from the front position to 90° on the right of the binaural hearing aid user. FIG. 8 illustrates the received signal PSDs for this configuration corresponding to the same frame time index as selected in FIG. 3. The noise estimation results over an average of 20 realizations are shown in FIG. 9. It can be seen that for this scenario, the noise estimation from PBNE clearly outperforms the one from CPSM. We can easily notice the bias occurring in the estimated noise PSD from CPSM, producing an overestimation. This is due to the fact that the technique in [2] assumes that the left and right source speech signals follow the same attenuation path before reaching the hearing aid microphones i.e. assuming equivalent left and right HRTFs. This situation only appends if the speaker is frontal (or at the back), implying that the received speech PSD levels in each frequency band should be comparable, which is definitely not the case as shown in FIG. 8 for a speaker at 90° azimuth. CPSM was not designed to provide an exact solution when the target source is not in front of the user. In broad terms, the larger the difference between the left and right SNRs at that particular frequency, the greater will be the overestimation for that frequency in CPSM. Finally, it can easily be observed that PBNE closely tracks the original noise PSDs, leading to a better estimation, independently of the direction of arrival of the target source signal.

2) PBNE Versus MSA

One of the drawbacks of MSA with respect to PBNE is that the technique requires knowledge of previous frames (i.e. previous noisy speech signal segments) in order to estimate the noise PSD on the current frame. Therefore, it requires an initialization period before the noise estimation can be considered reliable. Also, a larger number of parameters (such as various smoothing parameters and search window sizes etc.) belonging to the technique must be chosen prior to run time. These parameters have a direct effect on the noise estimation accuracy and tracking latency in case of non-stationary noise. Secondly, the target source must be only a speech signal, since the algorithm estimates the noise within syllables, speech pauses, etc., with the assumption that the power of the speech signal often decays to the noise power level [1]. On the other hand, PBNE can be applied to any type of target source, as long as there is a degree of correlation between the received left and right signals. It should be noted that for all the simulation results obtained using the MSA approach, the MSA noise PSD initial estimate was initialized to the real noise PSD level to avoid "the initialization period" required by the MSA approach.

Figure 10:
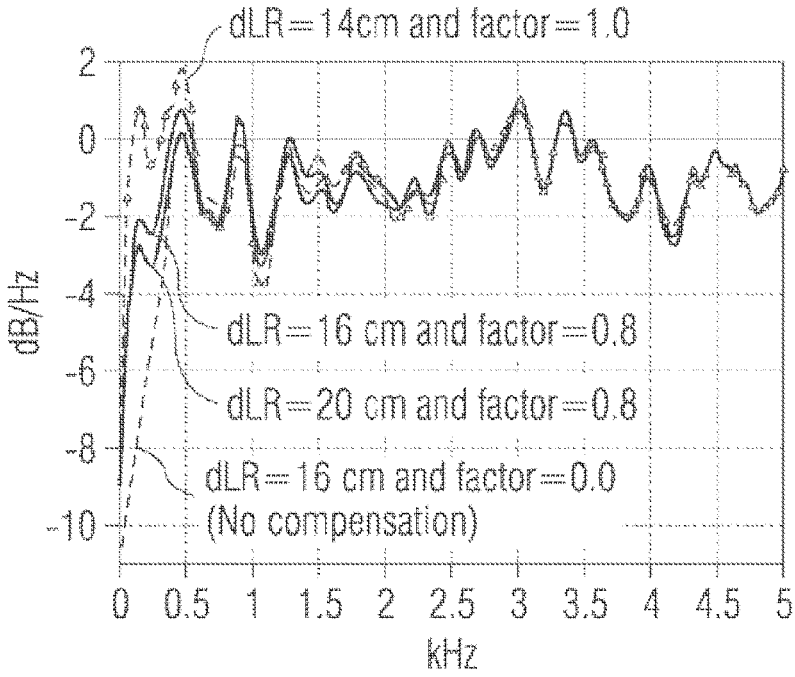
FIG. 10 illustrates the noise PSD estimation results from MSA versus PBNE, averaged over 585 subsequent frames.

Results for Scenario a):

since the MSA requires the knowledge of previous frames as opposed to PBNE or CPSM, the noise PSD estimation will not be compared on a frame-by-frame basis. MSA does not have an exact mathematical representation to estimate the noise PSD for a given frame only since it relies on the noise search over a range of past noisy speech signal frames. Unlike the preceding section where the noise estimation was obtained by averaging the results over multiple realizations (i.e. by processing the same speech frame index with different noise sequences), in this case it is not realistic to perform the same procedure because MSA can only find or update its noise estimation within a window of noisy speech frames as opposed to a single frame. Instead, to make an adequate comparison with PBNE, it is more suitable to make an average over the noise PSD estimates of consecutive frames. The received left and right noisy speech signals represented in FIG. 3 (i.e. the target speaker is in front of the hearing aid user) have been decomposed into a total of 585 frames of 25.6 ms with 50% for overlap at 20 kHz sampling frequency. It should be noted that all the PSD averaging has been done in the linear scale. The left and right SNRs are approximately equal to 5 dB. FIG. 10 illustrates the noise PSD estimation results from MSA versus PBNE, averaged over 585 subsequent frames. Only the noise estimation results on the right noisy speech signal are shown, since similar results were obtained for the left noisy signal. It can be observed that the accuracy of PBNE noise estimation is higher than the one from MSA. It was also observed (not shown here) that the PBNE performance is maintained for various input SNRs in contrast to MSA, where the accuracy is reduced at lower SNRs.

Figure 11:
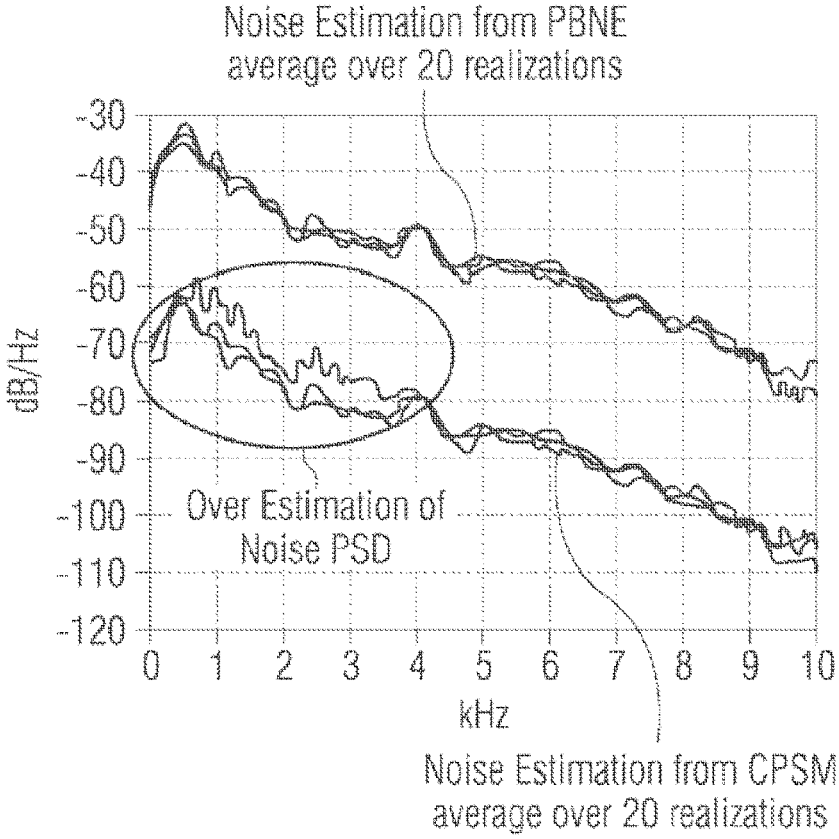
FIGS. 11 and 12 show the results for MSA and PBNE, respectively.
Figure 12:
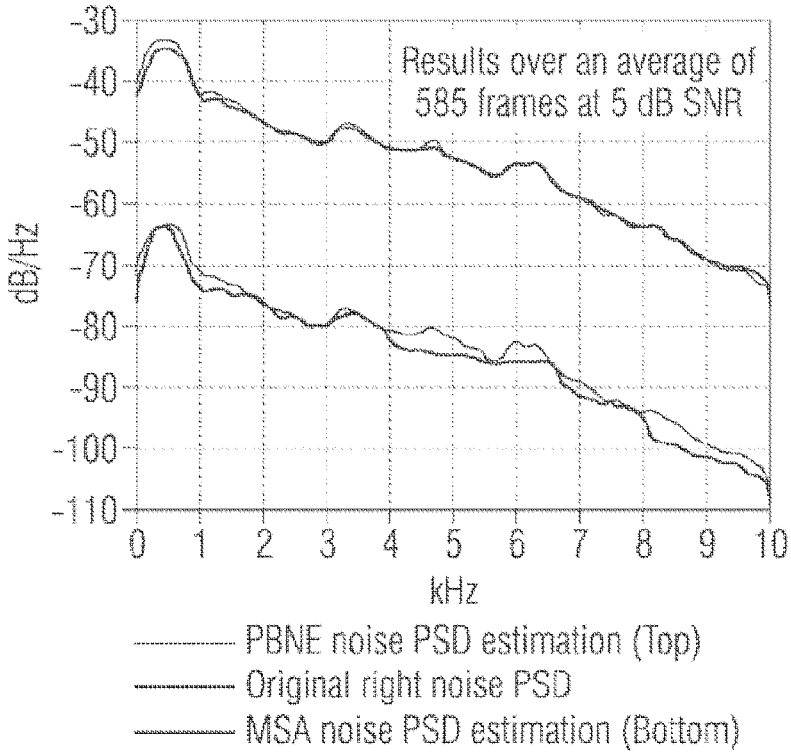
Figure 13:
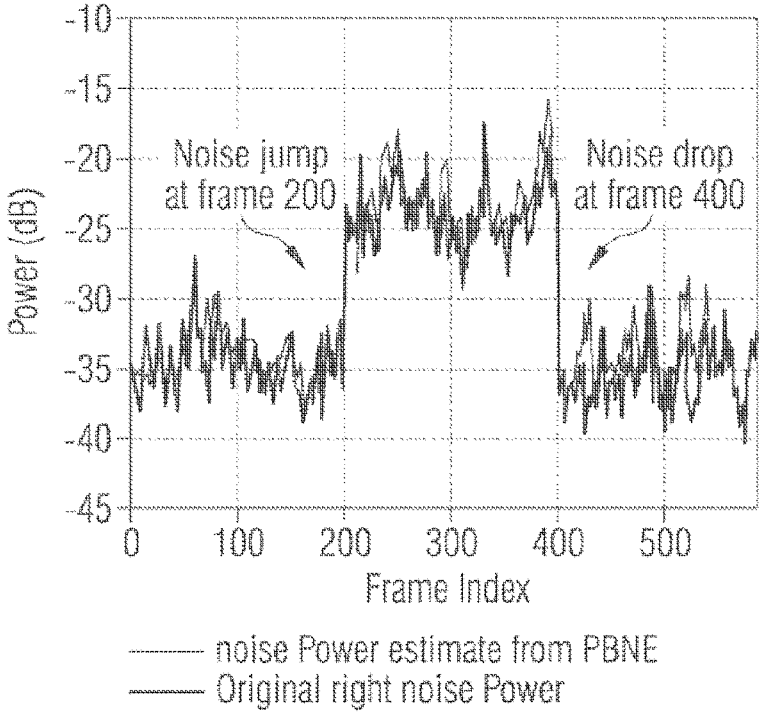
FIGS. 13 and 14 show a graph of power over frame index, and the frame latency, according to PBNE and MSA, respectively.
Figure 14:
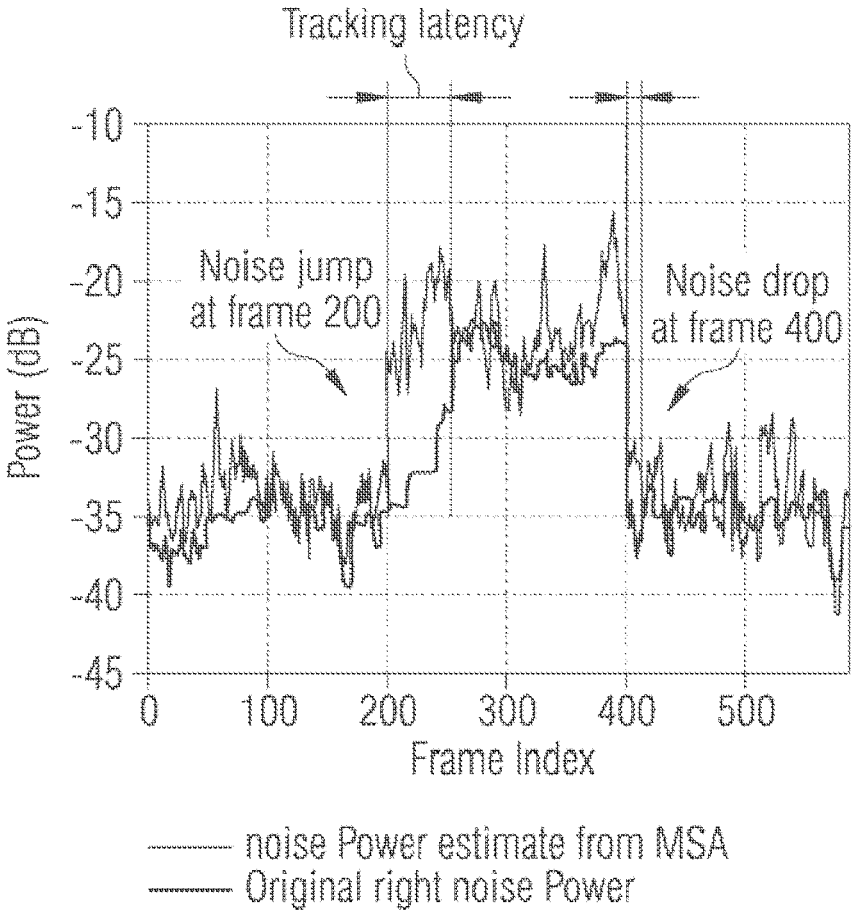
Figure 15:
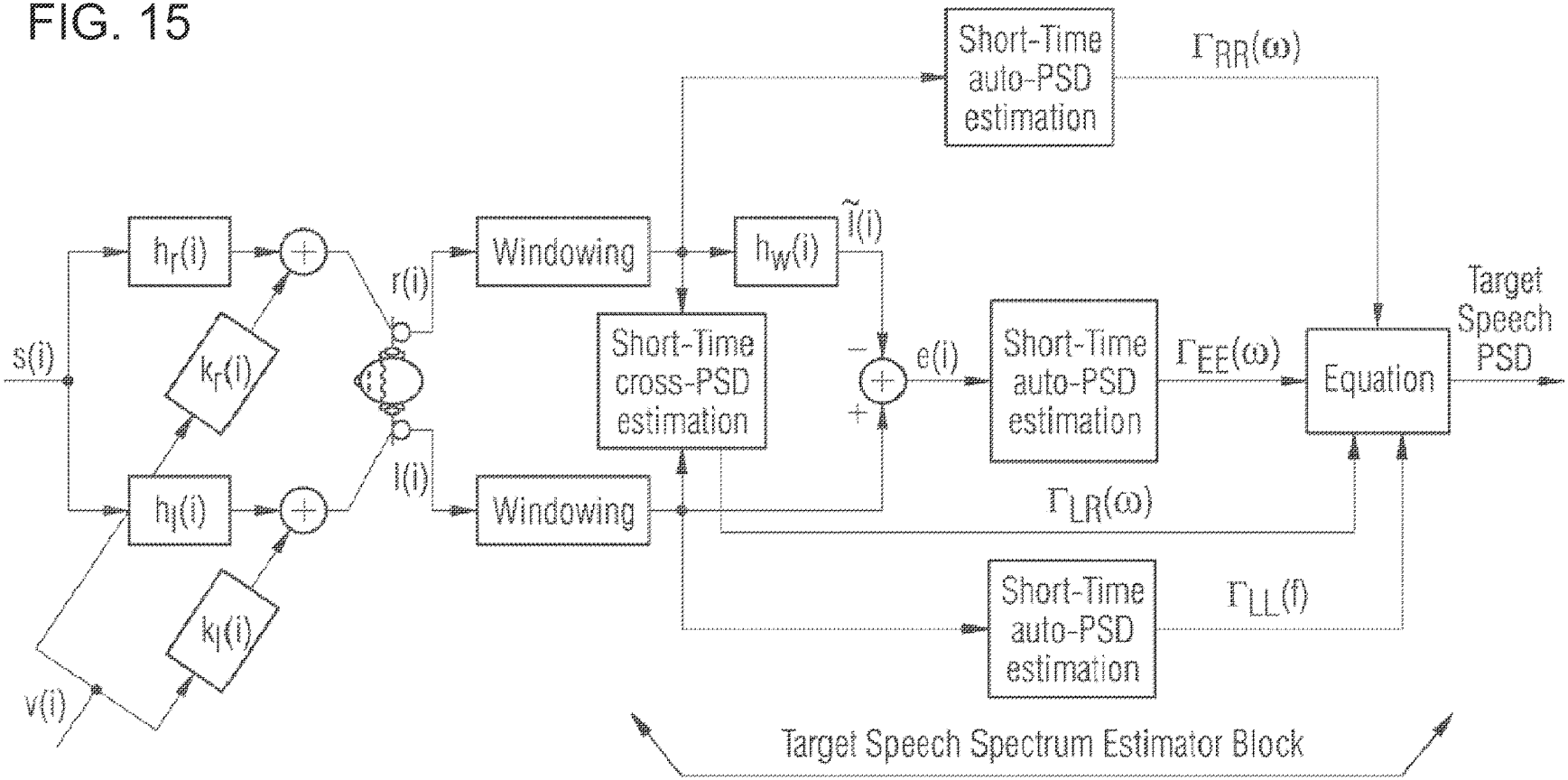
FIG. 15 is a view similar to FIG. 3 with a left and right noisy signal situation.

Results for Scenario c):

In this scenario, the noise tracking capability of MSA and PBNE is evaluated in the event of a jump or a drop of the noise power level, for instance if the hearing aid user is leaving or entering a crowded cafeteria, or just relocating to a less noisy area. To simulate those conditions, the original noise power has been increased by 12 dB at frame index 200 and then reduced again by 12 dB from frame index 400. To perform the comparison, the total noise power calculated for each frame has been compared with the corresponding total noise power estimates (evaluated by integrating the noise PSD estimates) at each frame. The results for MSA and PBNE are shown in FIGS. 11 and 12, respectively. Again, only the noise estimation results on the right noisy speech signal are shown, as the left channel signal produced similar results. As it can be noticed, MSA experiences some latency tracking the noise jump. In the literature, this latency is related to the tree search implementation in the MSA technique [1]. It is essentially governed by the selected number of sub-windows, U, and the number of frames, V, in each sub-window. In [1], the latency for a substantial noise jump is given as follows: Latency=U·V+V. For this scenario, U was assigned a value of 8 and V a value of 6, giving a latency of 56 frames, as demonstrated in FIG. 10. For a sudden noise drop, the latency is equal to a maximum of V frames [1]. Fortunately, the latency is much lower for a sudden noise decrease as it can be seen in FIG. 11 (having a long period of noise overestimation in a noise reduction scheme would greatly attenuate the target speech signal, therefore affecting its intelligibility). Of course, it is possible to reduce the latency of MSA by shrinking the search window length but the drawback is that the accuracy of MSA will be lowered as well. The search window length (i.e. U·V) must be large enough to bridge any speech activity, but short enough to track non-stationary noise fluctuations. It is a trade-off of MSA. On the other hand, as expected, PBNE can easily track the increase or the decrease of the noise power level, since the algorithm relies only on the current frame being processed.

Conclusion

An improved noise spectrum estimator in a diffuse noise field environment has been developed for future high-end binaural hearing aids. It performs a prediction on the left noisy signal from the right noisy signal via a Wiener filter, followed by an auto-PSD of the difference between the left noisy signal and the prediction. A second order system is obtained using a combination of the auto-PSDs from the difference signal, the left noisy signal and the right noisy signal. The solution is the power spectral density of the noise. The target speaker can be at any location around the binaural hearing aid user, as long as the speaker is at proximity of the hearing aid user in the noisy environment. Therefore, the direction of arrival of the source speech signal can be arbitrary. However, the proposed technique requires a binaural system which requires access to the left and right noisy speech signals. The target source signal can be other than a speech signal, as long as there is a high degree of correlation between the left and right noisy signals. The noise estimation is accurate even at high or low SNRsand it is performed on a frame-by-frame basis. It does not employ any voice activity detection algorithm, and the noise can be estimated during speech activity or not. It can track highly non-stationary noise conditions and any type of colored noise, provided that the noise has diffuse field characteristics. Moreover, in practice, if the noise is considered stationary over several frames, the noise estimation could be achieved by averaging the estimates obtained over consecutives frames, to further increase its accuracy. Finally, the proposed noise PSD estimator could be a good candidate for any noise reduction schemes that require an accurate diffuse noise PSD estimate to achieve a satisfactory de-noising performance.

Acknowledgment

This work was partly supported by a NSERC student scholarship and by a NSERC research grant.

REFERENCES

[1] R. Martin, "Noise Power Spectral Density Estimation Based on Optimal Smoothing and Minimum Statistics", *IEEE Transactions on Speech and Audio Processing*, vol. 9, no. 5, pp. 504-512, July 2001

[2] M. Doerbecker, and S. Ernst, "Combination of Two-Channel Spectral Subtraction and Adaptive Wiener Post-filtering for Noise Reduction and Dereverberation", *Proc. of 8th European Signal Processing Conference (EUSIPCO '96)*, Trieste, Italy, pp. 995-998, September 1996

[3] V. Hamacher, "Comparison of Advanced Monaural and Binaural Noise Reduction Algorithms for Hearing Aids", *Proc. of ICASSP* 2002, Orlando, Fla., vol. 4, pp. IV-4008-4011, Orlando, Fla., May 2002

[4] I. McCowan, and H. Bourland, "Microphone Array Post-Filter Based on Diffuse Noise Field", *IEEE Transactions on Speech and Audio Processing*, vol. 11, no. 6, pp. 709-716, November 2003

[5] A. Guerin, R. Le Bouquin-Jeannes, G. Faucon, "A two-Sensor Noise Reduction System: Applications for Hands-Free Car Kit", *Eurasip Journal on Applied Signal Processing*, pp. 1125-1134, January 2003

[6] J. Meyer and K. U. Simmer, "Multi-channel Speech Enhancement in a Car Environment Using Wiener Filtering and Spectral Subtraction", *Proc. of ICASSP* 1997, Munich, Germany, vol. 2, pp. 1167-1170, April 1997

[7] J. Bitzer, K. U. Simmer, and K. Kammeyer, "Theoretical Noise Reduction Limits of the Generalized Sidelobe Canceller (GSC) for Speech Enhancement", *Proc. of ICASSP* 1999, vol. 5, pp. 2965-2968, March 1999

[8] D. R. Campbell, P. W. Shiled, "Speech Enhancement Using Subband Adaptive Griffiths-Jim Signal Processing", *Speech Communication*, vol. 39, pp. 97-110, January 2003

[9] G. W. Elko, "Superdirectional Microphone Arrays", *Acoustical Signal Processing for Telecommunication*, Kluwer Academic Publisher, vol. 10, pp. 181-237, March 2000

[10]H. Abutalebi, H. Sheikhzadeh, L. Brennan, "A Hybrid Subband Adaptive System for Speech Enhancement in Diffuse Noise Fields", *IEEE Signal Processing Letters*, vol. 11, no. 1, pp. 44-47, January 2004

[11]R. K. Cook, R. V. Waterhouse, R. D. Berendt, S. Edelman, and M. C. Thompson Jr., "Measurement of Correlation Coefficients in Reverberant Sound Fields", *Journal of the Acoustical Society of America*, vol. 27, pp. 1072-1077, November 1955

[12]K. Meesawat, D. Hammershoi, "An investigation of the transition from early reflections to a reverberation tail in a BRIR", *Proc. of the* 2002 *International Conference on Auditory Display*, Kyoto, Japan, July 2002

Currently, it exists a variety of hearing aid models available in the marketplace, which may vary in terms of physical size, shape and effectiveness. For instance, hearing aid models such as In-The-Ear or In-The-Canal are smaller and more esthetically discrete as opposed to Behind-The-Ear models, but due to size constraints only a single microphone per hearing aid can be fitted. As a result, one of the drawbacks is that only single-channel monaural noise reduction schemes can be integrated in them. However, in the near future, new types of high-end hearing aids such as binaural hearing aids will be available. They will allow the use of information/signals received from both left and right hearing aid microphones (via a wireless link) to generate an output for the left and right ear. Having access to binaural signals for processing will allow overcoming a wider range of noise with highly fluctuating statistics encountered in real-life environments. This paper presents a novel instantaneous target speech power spectral density estimator for binaural hearing aids operating in a noisy environment composed of a background interfering talker or transient noise. It will be shown that incorporating the proposed estimator in a noise reduction scheme can substantially attenuate non-stationary as well as moving directional background noise, while still preserving the interaural cues of both the target speech and the noise.

Index Terms—binaural hearing aids, target speech power spectrum estimation, interaural cues preservation, lateral interferer, transient noise.

In the near future, new types of high-end hearing aids such as binaural hearing aids will be offered. As opposed to current bilateral hearing aids, with a hearing-impaired person wearing a monaural hearing aid on each ear and each monaural hearing aid processing only its own microphone input to generate an output for its corresponding ear, those new binaural hearing aids will allow the sharing and exchange of information or signals received from both left and right hearing aid microphones via a wireless link, and will also generate an output for the left and right ears [KAM'08]. As a result, working with a binaural system, new classes of noise reduction schemes as well noise estimation techniques can be explored. In [KAM'08], we introduced a binaural diffuse noise PSD estimator designed for binaural hearing aids operating in a diffuse noise field environment such as babble-talk in a crowded cafeteria. The binaural system was composed of one microphone per hearing aid on each side of the head and under the assumption of having a binaural link between the microphone signals. The binaural noise PSD estimator was proven to provide a greater accuracy and no noise tracking latency, compared to advanced monaural noise spectrum estimation schemes. However, other types of noise such as directional noise sources are frequently encountered in real-life listening situations and can reduce greatly the understanding of the target speech. For instance, directional noise sources can emerge from strong multi-talkers in addition to permanent diffuse noise in the background. This situation really degrades speech intelligibility since some other issues may arise such as informational masking (defined as the interfering speech carrying linguistic content, which can be confused with the content of the target speaker [HAW'04]), which has an even greater negative impact for a hearing impaired individual. Also, transient lateral noise may occur in the background such as hammering, dishes clattering etc. Those intermittent noises can create unpleasant auditory sensations even in a quiet environment i.e. without diffuse background noise.

In a monaural system where only a single channel is available for processing the use of spatial information is not feasible. Consequently it is very difficult for instance to distinguish between the speech coming from a target speaker or from interferers unless the characteristics of the lateral noise/interferers are known in advance, which is not realistic in real life situations. Also, most monaural noise estimation schemes such as the noise power spectral density (PSD) estimation using minimum statistics in [MAR'01] assume that the noise characteristics vary at a much slower pace that the target speech signal. Therefore, noise estimation schemes such as in [MAR'01] will not detect for instance lateral transient noise such as dishes clattering, hammering sounds etc.

As a solution to mitigate the impact of one dominant directional noise source, high-end monaural hearing aids incorporate advanced directional microphones where directivity is achieved for example by differential processing of two omnidirectional microphones placed on the hearing aid [HAM'05]. The directivity can also be adaptive that is it can constantly estimate the direction of the noise arrival and then steer a notch (in the beampattern) to match the main direction of the noise arrival. The use of an array of multiple microphones allows the suppression of more lateral noise sources. Two or three microphone array systems provide great benefits in today's hearing aids, however due to size constrains only certain models such as Behind-The-Ear (BTE) can accommodate two or even three microphones. Smaller models such as In-The-Canal (ITC) or In-The-Ear (ITE) only permits the fitting of a single microphone. Consequently beam-forming cannot be applied for such cases. Furthermore, it has been reported that a hearing impaired individual localize sounds better without their bilateral hearing aids (or by having the noise reduction program switched off) than with them. This is due to the fact that current noise reduction schemes implemented in bilateral hearing aids are not designed to preserve localizations cues. As a result, it creates an inconvenience for the hearing aid user and it should be pointed out that in some cases such as in street traffic, incorrect sound localization may be endangering.

Thus, all the reasons above provide a further motivation to place more importance towards a binaural system and to investigate the potential improvement of current noise reduction schemes against noise coming from lateral directions such as an interfering background talker or transient noise, and most importantly without altering the interaural cues of both the speech and the noise.

In a fairly recent binaural work such as in [BOG'07] (which complements the work in [KLA'06] and in several related publications such as [KLA'07][DOC'05]), a binaural Wiener filtering technique with a modified cost function was developed to reduce directional noise but also to have control over the distortion level of the binaural cues for both the speech and noise components. The results showed that the binaural cues can be maintained after processing but there was a tradeoff between the noise reduction and the preservation of the binaural cues. Another major drawback of the technique in [BOG'07] is that all the statistics for the design of the Wiener filter parameters were estimated off-line in their work and their estimations relied strongly on an ideal VAD. As a result, the directional background noise is restrained to be stationary or slowly fluctuating and the noise source should not relocate during speech activity since its characteristics are only computed during speech pauses. Furthermore, the case where the noise is a lateral interfering speech causes additional problems, because an ideal spatial classification is also needed to distinguish between lateral interfering speech and target speech segments. Regarding the preservation of the interaural cues, the technique in [BOG'07] requires the knowledge of the original interaural transfer functions (ITFs) for both the target speech and the directional noise, under the assumption that they are constant and that they could be directly measured with the microphone signals [BOG'07]. Unfortunately, in practice, the Wiener filter coefficients and the ITFs are not always easily computable especially when the binaural hearing aids user is in an environment with non-stationary and moving background noise or with the additional presence of stationary diffuse noise in the background. The occurrence of those complex but realistic environments in real-life hearing situations will decrease the performance of the technique in [BOG'07].

In this paper, the objective is to demonstrate that working with a binaural system, it is possible to significantly reduce non-stationary directional noise and still preserve interaural cues. First, an instantaneous binaural target speech PSD estimator is developed, where the target speech PSD is retrieved from the received binaural noisy signals corrupted by lateral interfering noise. In contrast to the work in [BOG'07] the proposed estimator does not require the knowledge of the direction of the noise source (i.e. computations of ITFs are not required). The noise can be highly non-stationary (i.e. fluctuating noise statistics) such as an interfering speech signal from a background talker or just transient noise (i.e. dishes clattering or door opening/closing in the background). Moreover, the estimator does not require a voice activity detector (VAD) or any classification, and it is performed on a frame-by-frame basis with no memory (which is the rationale for calling the proposed estimator "instantaneous"). Consequently, the background noise source can also be moving (or equivalently, switching from one main interfering noise source to another at a different direction). This paper will focus on the scenario where the target speaker is assumed to remain in front of the binaural hearing aid user, although it will be shown in Section III that the proposed target source PSD estimator can also be extended to non-frontal target source directions. In practice, a signal coming from the front is often considered to be the desired target signal direction, especially in the design of standard directional microphones implemented in hearing aids [HAM'05][PUD'06].

Secondly, by incorporating the proposed estimator into a simple binaural noise reduction scheme, it will be shown that non-stationary interfering noise can be efficiently attenuated without disturbing the interaural cues of the target speech and the residual noise after processing. Basically, the spatial impression of the environment remains unchanged. Therefore similar schemes could be implemented in the noise reduction stage of up-coming binaural hearing aids to increase robustness and performance in terms of speech intelligibly/quality against a wider of range of noise encountered in everyday environment. The paper is organized as follows: Section II will provide the binaural system description, with signal definitions and the acoustical environment where the target speech PSD is estimated. Section III will introduce the proposed binaural target speech PSD estimator in detail. Section IV will show how to incorporate this estimator into a selected binaural noise reduction scheme and how to preserve the interaural cues. Section V will briefly describe the binaural Wiener filtering with consideration of the interaural cues preservation presented in [BOG'07]. Section VI will present simulation results comparing the work in [BOG'07] with our proposed binaural noise reduction scheme, in terms of noise reduction performance. Finally, section VII will conclude this work.

Binaural System Description and Considered Acoustical Environment

A. Acoustical Environment: Lateral (Directional) Noise

The binaural hearing aids user is in front of the target speaker with a strong lateral interfering noise in the background. The interfering noise can be a background talker (i.e.

speech-like characteristic), which often occurs when chatting in a crowded cafeteria, or it can be dishes clattering, hammering sounds in the background etc., which are referred to as transient noise. Those types of noise are characterized as being highly non-stationary and may occur at random instants around the target speaker in real-life environments. Moreover, those noise signals are referred to as localized noise sources or directional noise. In the presence of a localized noise source as opposed to a diffuse noise field environment, the noise signals received by the left and right microphones are highly correlated. In the considered environment, the noise can originate anywhere around the binaural hearing aids user, implying that the direction of arrival of the noise is arbitrary, however it should differ from 0° (i.e. frontal direction) to provide a spatial separation between the target speech and the noise.

B. Binaural System Description

Let l(i), r(i) be the noisy signals received at the left and right hearing aid microphones, defined here in the temporal domain as:

$$l(i) = s(i) \otimes h_l(i) + v(i) \otimes k_l(i) = s_l(i) + v_l(i) \quad (1)$$

$$r(i) = s(i) \otimes h_r(i) + v(i) \otimes k_r(i) = s_r(i) + v_r(i) \quad (2)$$

where s(i) and v(i) are the target and interfering directional noise sources respectively, and $\hat{x}$ represents the linear convolution sum operator. It is assumed that the distance between the speaker and the two microphones (one placed on each ear) is such that they receive essentially speech through a direct path from the speaker. This implies that the received target speech left and right signals are highly correlated (i.e. the direct component dominates its reverberation components). The same reasoning applies for the interfering directional noise. The left and right received noise signals are then also highly correlated as opposed to diffuse noise, where left and right received signals would be poorly correlated over most of the frequency spectrum. Hence, in the context of binaural hearing, $h_l(i)$ and $h_r(i)$ are the left and right head-related impulse responses (HRIRs) between the target speaker and the left and right hearing aids microphones. $k_l(i)$ and $k_r(i)$ are the left and right head-related impulse responses between the interferer and the left and right hearing aids microphones. As a result, $s_l(i)$ is the received left target speech signal and $v_l(i)$ corresponds to the lateral interfering noise on the left channel. Similarly, $s_r(i)$ is the received right target speech signal and $v_r(i)$ corresponds to the lateral interfering noise received on the right channel.

Prior to estimating the target speech PSD, the following assumptions are made:

i) The target speech and the interfering noise are not correlated ii) The direction of arrival of the target source speech signal is approximately frontal that is:

$$h_l(i)=h_r(i)=h(i) \quad (3)$$

(the case of a non-frontal target source is discussed later in the paper)

iii) the noise source can be anywhere around the hearing aids user, that is the direction of arrival of the noise signal is arbitrary but not frontal (i.e. azimuthal angle ≠0° and $k_l(i) \neq k_r(i)$) otherwise it will be considered as a target source.

Using the assumptions above along with equations (1) and (2) the left and right auto power spectral densities, $\Gamma_{LL}(\omega)$ and $\Gamma_{RR}(\omega)$, can be expressed as the following:

$$\Gamma_{LL}(\omega)=F.T.\{\gamma_{ll}(\tau)\}=\Gamma_{SS}(\omega)|H(\omega)|^2+\Gamma_{VV}(\omega)|K_L(\omega)|^2 \quad (4)$$

$$\Gamma_{RR}(\omega)=F.T.\{\gamma_{rr}(\tau)\}=\Gamma_{SS}(\omega)|H(\omega)|^2+\Gamma_{VV}(\omega)|K_R(\omega)|^2 \quad (5)$$

where F.T.{.} is the Fourier Transform and $\gamma_{yx}(\tau)=E[y(i+\tau)\cdot x(i)]$ represents a statistical correlation function.

Proposed Binaural Target Speech Spectrum Estimation

In this section, a new binaural target speech spectrum estimation method is developed. Section IIIa) presents the overall diagram of the proposed target speech spectrum estimation. It is shown that the target speech spectrum estimate is found by initially applying a Wiener filter to perform a prediction of the left noisy speech signal from the right noisy speech signal, followed by taking the difference between the auto-power spectral density of left noisy signal and the auto-power spectral density of the prediction.

As a second step, an equation is formed by combining the PSD of this difference signal, the auto-power spectral densities of the left and right noisy speech signals and the cross-power spectral density between the left and right noisy signals. The solution of the equation represents the target speech PSD. In practice, similar to the implementation of the binaural diffuse noise power spectrum estimator in [KAM'08], the estimation of one of the variables used in the equation causes the target speech power spectrum estimation to be less accurate in some cases. However, there are two ways of computing this variable: an indirect form, which is obtained from a combination of several other variables, and a direct form, which is less intuitive. It was observed through empirical results that combining the two estimates (obtained using the direct and indirect computations) provides a better target speech power spectrum estimation. Therefore, Section IIIb) will present the alternate way (i.e. the direct form) of computing the estimate and finally Section IIIc) will show the effective combination of those two estimates (i.e. direct and indirect forms), finalizing the proposed target speech power spectrum estimation technique.

A. Target Speech PSD Estimation

FIG. 1 shows a diagram of the overall proposed estimation method. It includes a Wiener prediction filter and the final equation estimating the target speech power spectral density. In a first step, a filter, $h_w^r(i)$, is used to perform a linear prediction of the left noisy speech signal from the right noisy speech signal. Using a minimum mean square error criterion (MMSE), the optimum solution is the Wiener solution, defined here in the frequency domain as:

$$H_W^R(\omega)\beta\Gamma_{LR}(\omega)/\Gamma_{RR}(\omega) \quad (6)$$

where $\Gamma_{LR}(\omega)$ is the cross-power spectral density between the left and the right noisy signals. $\Gamma_{LR}(\omega)$ is obtained as follows:

$$\Gamma_{LR}(\omega) = F.T.\{\gamma_{lr}(\tau)\} = F.T.\{E[l(i+\tau)\cdot r(i)]\} \quad (7)$$

with:

$$\gamma_{lr}(\tau) = E\begin{pmatrix} [s(i+\tau)\otimes h_l(i) + v(i+\tau)\otimes k_l(i)]\cdot \\ [s(i)\otimes h_r(i) + v(i)\otimes k_r(i)] \end{pmatrix} = \gamma_{ss}(\tau)\otimes h_l(\tau)\otimes h_r(-\tau) + \gamma_{vv}(\tau)\otimes k_l(\tau)\otimes k_r(-\tau) + \gamma_{sv}(\tau)\otimes h_l(\tau)\otimes k_r(-\tau) + \gamma_{vs}(\tau)\otimes k_l(\tau)\otimes h_r(-\tau) \quad (8)$$

Using the previously defined assumptions in section IIb), (8) can then be simplified to:

$$\gamma_{lr}(\tau) = \gamma_{ss}(\tau) \otimes h_l(\tau) \otimes h_r(-\tau) + \gamma_{vv}(\tau) \otimes k_l(\tau) \otimes k_r(-\tau) \tag{9}$$

The cross-power spectral density expression then becomes:

$$\Gamma_{LR}(\omega) = \Gamma_{SS}(\omega) \cdot H_L(\omega) \cdot H_R^*(\omega) + \Gamma_{VV}(\omega) \cdot K_L(\omega) \cdot K_R^*(\omega) \tag{10}$$

$$= \Gamma_{SS}(\omega) \cdot |H(\omega)|^2 + \Gamma_{VV}(\omega) \cdot K_L(\omega) \cdot K_R^*(\omega) \tag{11}$$

Using (6), the squared magnitude response of the Wiener filter is computed as follows:

$$|H_W^R(\omega)|^2 = \frac{|\Gamma_{LR}(\omega)|^2}{\Gamma_{RR}^2(\omega)} = \frac{\Gamma_{LR}(\omega) \cdot \Gamma_{LR}^*(\omega)}{\Gamma_{RR}^2(\omega)} \tag{12}$$

Furthermore, Substituting (10) into (11) the squared magnitude response of the Wiener filter in (12) can also be expressed as:

$$|H_W^R(\omega)|^2 = \frac{1}{\Gamma_{RR}^2(\omega)} \left\{ \begin{pmatrix} \Gamma_{SS}(\omega) \cdot H_L(\omega) \cdot H_R^*(\omega) + \\ \Gamma_{VV}(\omega) \cdot K_L(\omega) \cdot K_R^*(\omega) \end{pmatrix} \cdot \begin{pmatrix} \Gamma_{SS}(\omega) \cdot H_L(\omega) \cdot H_R^*(\omega) + \\ \Gamma_{VV}(\omega) \cdot K_L(\omega) \cdot K_R^*(\omega) \end{pmatrix}^* \right\} \tag{13}$$

$$= \frac{1}{\Gamma_{RR}^2(\omega)} \left\{ \begin{matrix} \Gamma_{SS}^2(\omega) \cdot |H_L(\omega)|^2 \cdot |H_R(\omega)|^2 + \Gamma_{SS}(\omega) \cdot \Gamma_{VV}(\omega) \cdot \\ \begin{pmatrix} H_L^*(\omega) \cdot H_R(\omega) \cdot K_L(\omega) \cdot K_R^*(\omega) + \\ H_L(\omega) \cdot H_R^*(\omega) \cdot K_L^*(\omega) \cdot K_R(\omega) \end{pmatrix} + \\ \Gamma_{VV}^2(\omega) \cdot |K_L(\omega)|^2 \cdot |K_R(\omega)|^2 \end{matrix} \right\} \tag{14}$$

$$= \frac{1}{\Gamma_{RR}^2(\omega)} \left\{ \begin{matrix} (\Gamma_{SS}(\omega) \cdot |H(\omega)|^2)^2 + \Gamma_{SS}(\omega) \cdot \Gamma_{VV}(\omega) \cdot |H(\omega)|^2 \cdot \\ (K_L(\omega) \cdot K_R^*(\omega) + K_L^*(\omega) \cdot K_R(\omega)) + \\ (\Gamma_{VV}(\omega) \cdot |K_L(\omega)| \cdot |K_R(\omega)|)^2 \end{matrix} \right\} \tag{15}$$

In the previous equation, the left and right directional noise interferer HRTFs are still unknown parameters, however they can be substituted using (11) as well as its complex conjugate form into (15) as follows:

$$|H_W^R(\omega)|^2 = \frac{1}{\Gamma_{RR}^2(\omega)} \left\{ \begin{matrix} (\Gamma_{SS}(\omega) \cdot |H(\omega)|^2)^2 + \Gamma_{SS}(\omega) \cdot |H(\omega)|^2 \cdot \\ \begin{pmatrix} (\Gamma_{LR}(\omega) - \Gamma_{SS}(\omega) \cdot |H(\omega)|^2) + \\ (\Gamma_{LR}^*(\omega) - \Gamma_{SS}(\omega) \cdot |H(\omega)|^2) \end{pmatrix} + \\ \Gamma_{VV}^2(\omega) \cdot |K_L(\omega)|^2 \cdot |K_R(\omega)|^2 \end{matrix} \right\} \tag{16}$$

From (16), the remaining unknown parameters (such as in the left and right directional noise HRTFs magnitudes) can be substituted using (4) and (5) as follows:

$$|H_W^R(\omega)|^2 = \frac{1}{\Gamma_{RR}^2(\omega)} \left\{ \begin{matrix} (\Gamma_{SS}(\omega) \cdot |H(\omega)|^2)^2 + \Gamma_{SS}(\omega) \cdot |H(\omega)|^2 \cdot \\ \begin{pmatrix} (\Gamma_{LR}(\omega) - \Gamma_{SS}(\omega) \cdot |H(\omega)|^2) + \\ (\Gamma_{LR}^*(\omega) - \Gamma_{SS}(\omega) \cdot |H(\omega)|^2) \end{pmatrix} + \\ (\Gamma_{LL}(\omega) - \Gamma_{SS}(\omega) \cdot |H(\omega)|^2) \cdot \\ (\Gamma_{RR}(\omega) - \Gamma_{SS}(\omega) \cdot |H(\omega)|^2) \end{matrix} \right\} \tag{17}$$

After simplification and rearranging the terms in (17), the target speech PSD is found by solving the following equation:

$$\Gamma_{SS}(\omega) \cdot |H(\omega)|^2 = \frac{\Gamma_{RR}(\omega) \cdot \Gamma_{EE}^R(\omega)}{(\Gamma_{LL}(\omega) + \Gamma_{RR}(\omega)) - (\Gamma_{LR}(\omega) + \Gamma_{LR}^*(\omega))} = \Gamma_{SS}^R(\omega) \tag{18}$$

where $$\Gamma_{EE_1}^R(\omega) = \Gamma_{LL}(\omega) - \Gamma_{RR}(\omega) \cdot |H_W^R(\omega)|^2 \tag{19}$$

It should be noted that the Wiener filter coefficients used in (19) were computed using the right noisy speech signal as a reference input to predict the left channel, as illustrated in FIG. 1. However, to diminish the distortion on the interfering noise spatial cues, when audible residual interfering noise still remains in the estimated target speech spectrum, the target speech PSD should also be estimated by using the dual procedure, that is: using the left noisy speech signal input as a reference for the Wiener filter instead of the right. This configuration for the setup of the Wiener filter is referred to as $H_W^L(\omega)$ or as $h_w^l(\omega)$ in the time domain.

To sum up, the target speech PSD retrieved from the right channel is referred to as $\Gamma_{SS}^R(\omega)$ and is found using (18) and (19). Similarly, the target speech PSD retrieved from the left channel is referred to as $\Gamma_{SS}^L(\omega)$ and is found using the following equations:

$$\Gamma_{SS}^L(\omega) = \frac{\Gamma_{LL}(\omega) \cdot \Gamma_{EE}^L(\omega)}{(\Gamma_{LL}(\omega) + \Gamma_{RR}(\omega)) - (\Gamma_{LR}(\omega) + \Gamma_{LR}^*(\omega))} \tag{20}$$

where $$\Gamma_{EE_1}^L(\omega) = \Gamma_{RR}(\omega) - \Gamma_{LL}(\omega) \cdot |H_W^L(\omega)|^2 \tag{21}$$

and the Wiener filter coefficients in (21) are computed using the left noisy channel as a reference input to predict the right channel.

B. Direct Computation of the Target Speech PSD Estimator

As briefly introduced at the beginning of section III, the accuracy of the retrieved target speech PSD can be improved by adjusting the estimate of the variable $\Gamma_{EE_1}^R(\omega)$ and $\Gamma_{EE_1}^L(\omega)$ used in (18) and (20). For the remaining part of this section, we will focusing on $\Gamma_{EE_1}^R(\omega)$, but the same development applies to $\Gamma_{EE_1}^L(\omega)$. As shown in equation (19), $\Gamma_{EE_1}^R(\omega)$ is obtained by taking the difference between the auto-power spectral density of left noisy signal and the auto-power spectral density of the prediction. However, it will be shown in this section that $\Gamma_{EE_1}^R(\omega)$ is in fact the auto-power spectral density of the prediction residual (or error), e(i), shown in FIG. 1, which is somewhat less intuitive. The direct computation of this auto-power spectral density from the samples of e(i) is referred to as $\Gamma_{EE}^R(\omega)$ here, while the indirect computation using (19) is referred to as $\Gamma_{EE_1}^R(\omega)$. $\Gamma_{EE_1}^R(\omega)$ and $\Gamma_{EE}^R(\omega)$ are theoretically equivalent, however only estimates of those power spectral densities are available in practice to compute (5), (18) and (19). It was found through empirical results that the estimation of $\Gamma_{SS}^R(\omega)$ in (18) yields a more accurate result by using $\Gamma_{EE_1}^R(\omega)$ or $\Gamma_{EE}^R(\omega)$ in different cases, or sometimes by using a combination of both performs better. The next section will show the appropriate use of $\Gamma_{EE_1}^R(\omega)$ and $\Gamma_{EE}^R(\omega)$ for the estimation of $\Gamma_{SS}^R(\omega)$.

In [KAM'08], using a similar binaural system, the analytical equivalence between $\Gamma_{EE}^R(\omega)$ and $\Gamma_{EE_1}^R(\omega)$ was derived in details for the hearing scenario where the binaural hearing aids user is located in a diffuse background noise. This paper deals with directional background noise instead. Using similar derivation steps as in [KAM'08], it is possible to prove again that $\Gamma_{EE}^{R}(\omega)$ and $\Gamma_{EE_1}^{R}(\omega)$ are analytically equivalent.

Starting from the prediction residual error as shown in FIG. 1, which can be defined as:

$$e(i) = l(i) - \tilde{l}(i) = l(i) - r(i) \otimes h_w^r(i) \tag{22}$$

we have:

$$r_{EE}^{R}(\omega) = F.T.(\gamma_{ee}(\tau)) \tag{23}$$

where $$\begin{aligned}\gamma_{ee}(\tau) &= E(e(i+\tau)\cdot e(i)) = E(\left[l(i+\tau) - \tilde{l}(i+\tau)\right]\cdot\left[l(i) - \tilde{l}(i)\right]) = \\ &E[l(i+\tau)l(i)] - E\left[l(i+\tau)\tilde{l}(i)\right] - E\left[\tilde{l}(i+\tau)l(i)\right] + E\left[\tilde{l}(i+\tau)\tilde{l}(i)\right] = \\ &\gamma_{ll}(\tau) - \gamma_{l\tilde{l}}(\tau) - \gamma_{\tilde{l}l}(\tau) + \gamma_{\tilde{l}\tilde{l}}(\tau)\end{aligned} \tag{24}$$

As derived in (24), $\gamma_{ee}(\tau)$ is thus the sum of 4 terms, where the following temporal and frequency domain definitions for each term are:

$$\gamma_{ll}(\tau) = E\begin{pmatrix}[s(i+\tau)\otimes h_l(i) + v(i+\tau)\otimes k_l(i)]\cdot \\ [s(i)\otimes h_l(i) + v(i)\otimes k_l(i)]\end{pmatrix} \tag{25}$$

$$= \gamma_{ss}(\tau)\otimes h_l(\tau)\otimes h_l(-\tau) + \gamma_{vv}(\tau)\otimes k_l(\tau)\otimes k_l(-\tau) \tag{26}$$

$$\Gamma_{SS}(\omega)|H_L(\omega)|^2 + \Gamma_{VV}(\omega)|K_L(\omega)|^2 \tag{27}$$

$$\begin{aligned}\gamma_{l\tilde{l}}(\tau) = E\begin{pmatrix}[s(i+\tau)\otimes h_l(i) + v(i+\tau)\otimes k_l(i)]\cdot \\ [[s(i)\otimes h_r(i) + v(i)\otimes k_r(i)]\otimes h_w^r(i)]\end{pmatrix} = \\ \gamma_{ss}(\tau)\otimes h_l(\tau)\otimes h_r(-\tau)\otimes h_w^r(-\tau) + \\ \gamma_{vv}(\tau)\otimes k_l(\tau)\otimes k_r(-\tau)\otimes h_w^r(-\tau)\end{aligned} \tag{28}$$

$$\begin{aligned}&\Gamma_{L\tilde{L}}(\omega) = \\ &\Gamma_{SS}(\omega)H_L(\omega)H_R^*(\omega)(H_W^R(\omega))^* + \Gamma_{VV}(\omega)K_L(\omega)K_R^*(\omega)(H_W^R(\omega))^*\end{aligned} \tag{29}$$

$$\gamma_{\tilde{l}l}(\tau) = E\begin{pmatrix}([s(i+\tau)\otimes h_r(i) + v(i+\tau)\otimes k_r(i)]\otimes h_w^r(i))\cdot \\ [s(i)\otimes h_l(i) + v(i)\otimes k_l(i)]\end{pmatrix} = \gamma_{ss}(\tau)\otimes h_l(-\tau)\otimes h_r(\tau)\otimes h_w^r(\tau) + \gamma_{vv}(\tau)\otimes k_l(-\tau)\otimes k_r(\tau)\otimes h_w^r(\tau) \tag{30}$$

$$\Gamma_{\tilde{L}L}(\omega) = \Gamma_{SS}(\omega)H_L^*(\omega)H_R(\omega)H_W^R(\omega) + \Gamma_{VV}(\omega)K_L^*(\omega)K_R(\omega)H_W^R(\omega) \tag{31}$$

$$\gamma_{\tilde{l}\tilde{l}}(\tau) = E\begin{pmatrix}\left(\begin{bmatrix}s(i+\tau)\otimes h_r(i) + \\ v(i+\tau)\otimes k_r(i)\end{bmatrix}\otimes h_w^r(i)\right)\cdot \\ \left(\begin{bmatrix}s(i)\otimes h_r(i) + v(i+\tau) \\ \bigotimes k_r(i)\end{bmatrix}\otimes h_w^r(i)\right)\end{pmatrix} = \gamma_{ss}(\tau)\otimes h_r(\tau)\otimes h_r(-\tau)\otimes h_w^r(\tau)\otimes h_w^r(-\tau) + \gamma_{vv}(\tau)\otimes k_r(\tau)\otimes k_r(-\tau)\otimes h_w^r(\tau)\otimes h_w^r(-\tau) \tag{32}$$

$$\Gamma_{\tilde{L}\tilde{L}}(\omega) = \Gamma_{SS}(\omega)|H_R(\omega)|^2|H_W^R(\omega)|^2 + \Gamma_{VV}(\omega)|K_R(\omega)|^2|H_W^R(\omega)|^2 \tag{33}$$

From (24), we can write:

$$\Gamma_{\varepsilon\varepsilon}(\omega) = \Gamma_{LL}(\omega) - \Gamma_{L\tilde{L}}(\omega) - \Gamma_{\tilde{L}L}(\omega) + \Gamma_{\tilde{L}\tilde{L}}(\omega) \tag{34}$$

and substituting all the terms in their respective frequency domain forms (i.e. 27, 29, 31 and 33) into (34) yields:

$$\begin{aligned}\Gamma_{\varepsilon\varepsilon}(\omega) = &\Gamma_{SS}(\omega)\cdot|H_L(\omega)|^2 + \Gamma_{SS}(\omega)\cdot|H_L(\omega)|^2\cdot|H_W^R(\omega)|^2 + \\ &\Gamma_{SS}(\omega)\cdot|H_R(\omega)|^2\cdot|H_W^R(\omega)|^2 - 2\cdot\Gamma_{AA}(\omega) = \\ &\Gamma_{LL}(\omega) + \Gamma_{RR}(\omega)\cdot|H_R(\omega)|^2 - \Gamma_{AA}(\omega)\end{aligned} \tag{35}$$

where $$\begin{aligned}\Gamma_{AA}(\omega) = &\Gamma_{SS}(\omega)\cdot\begin{pmatrix}H_L(\omega)H_R^*(\omega)(H_W^R(\omega))^* + \\ H_L^*(\omega)H_R(\omega)H_W^R(\omega)\end{pmatrix} + \\ &\Gamma_{VV}(\omega)\cdot\begin{pmatrix}K_L(\omega)K_R^*(\omega)(H_W^R(\omega))^* + \\ K_L^*(\omega)K_R(\omega)H_W^R(\omega)\end{pmatrix} = \\ &2\cdot\mathrm{Re}\left\{\begin{pmatrix}\Gamma_{SS}(\omega)\cdot H_L^*(\omega)H_R(\omega) + \\ \Gamma_{VV}(\omega)\cdot K_L^*(\omega)K_R(\omega)\end{pmatrix}\cdot H_W^R(\omega)\right\}\end{aligned} \tag{36}$$

Substituting equations (6) and (10) into (36), $\Gamma_{AA}(\omega)$ is equal to:

$$\begin{aligned}&= 2\cdot\mathrm{Re}\left\{\frac{(\Gamma_{SS}(\omega)\cdot H_L^*(\omega)H_R(\omega) + \Gamma_{VV}(\omega)\cdot K_L^*(\omega)K_R(\omega))\cdot \Gamma_{SS}(\omega)\cdot H_L(\omega)H_R^*(\omega) + \Gamma_{VV}(\omega)\cdot K_L(\omega)K_R^*(\omega)}{\Gamma_{RR}(\omega)}\right\} \\ &= \frac{2}{\Gamma_{RR}(\omega)}\cdot\left\{\begin{matrix}(\Gamma_{SS}(\omega)\cdot|H_L(\omega)|\cdot|H_R(\omega)|)^2 + \Gamma_{SS}(\omega)\cdot\Gamma_{VV}(\omega)\cdot \\ H_L^*(\omega)H_R(\omega)K_L(\omega)K_R^*(\omega) + \\ \Gamma_{SS}(\omega)\cdot\Gamma_{VV}(\omega)\cdot H_L(\omega)H_R^*(\omega)K_L^*(\omega)K_R(\omega) + \\ (\Gamma_{VV}(\omega)\cdot|K_L(\omega)|\cdot|K_R(\omega)|)^2\end{matrix}\right\}\end{aligned} \tag{37}$$

Looking at equation (37) and matching the terms belonging to the squared magnitude response of the Wiener filter i.e. $|H_W^R(\omega)|^2$ equation (14), equation (37) can be simplified to the following:

$$\Gamma_{AA}(\omega) = 2\cdot\Gamma_{RR}(\omega)\cdot|H_W^R(\omega)|^2 \tag{38}$$

Replacing (38) into (35), we get:

$$\Gamma_{EE}(\omega) = \Gamma_{LL}(\omega) - \Gamma_{RR}(\omega)\cdot|H_W^R(\omega)|^2 \tag{39}$$

Equation (39) is identical to (19), and thus $\Gamma_{EE_1}^{R}(\omega)$ in (19), represents the auto-PSD of e(i). Consequently, $\Gamma_{EE}(\omega)$ and $\Gamma_{EE_1}^{R}(\omega)$ are then analytically equivalent. Similarly, $\Gamma_{EE_1}^{L}(\omega)$ in (21) is then also equivalent to $\Gamma_{EE}^{L}(\omega)$ found by directly taking the auto power spectral density of the prediction error defined as:

$$e(i) = r(i) - l(i)\otimes h_w^i \tag{40}$$

C. Finalizing the Target Speech PSD Estimator

This section will propose an effective combination of $\Gamma_{EE}^{R}(\omega)$ and $\Gamma_{EE_1}^{R}(\omega)$ to estimate $\Gamma_{SS}^{R}(\omega)$ (or the estimate of $\Gamma_{SS}^{L}(\omega)$ using the combination of $\Gamma_{EE}^{L}(\omega)$ and $\Gamma_{EE_1}^{L}(\omega)$ and therefore to finalize the target speech PSD estimator. Throughout the remaining of the paper, the effective combination of $\Gamma_{EE}^{j}(\omega)$ and $\Gamma_{EE_1}^{j}(\omega)$ will be referred to as $\Gamma_{EE_FF}^{j}(\omega)$ with j corresponding to either the left channel (i.e. j=L) or the right channel (i.e. j=R)

First, the magnitude of interaural offset in a dB scale between the left and right received noisy PSDs is computed as follows:

$$\mathrm{Offset_}dB(\omega) = |10\cdot\log(\Gamma_{LL}(\omega)) - 10\cdot og(\Gamma_{RR}(\omega))| \tag{41}$$

Secondly, the interval of frequencies (i.e. ω_int) where Offset_dB is greater than a selected threshold th_offset are found as follows:

$$\omega_int \text{ subject } to\text{: } \mathrm{Offset_}dB(\omega_int) > th_\mathrm{offset} \tag{42}$$

Considering for instance the target speech estimation on the right channel, if the offset is greater than th_offset, it implies that there is a strong presence of directional noise interference at that particular frequency (i.e. ω_int), under the assumption that the target speech is approximately frontal. Consequently, in the context of speech de-noising or enhancement, it is reasonable that the received input noisy speech PSD should be more attenuated at that frequency. Through empirical results, it was observed that for large offsets, the estimate of $\Gamma_{EE}^{R}(\omega)$ estimated via equation (23) yields a lower magnitude than the magnitude of $\Gamma_{EE_1}^{R}(\omega)$ estimated via equation (19). As a result, for large offsets, it is then more suitable to use $\Gamma_{EE}^{R}(\omega)$ instead of $\Gamma_{EE_1}^{R}(\omega)$ to compute the target speech PSD $\Gamma_{SS}^{S}(\omega)$ in (18). This will yield a greater attenuation of the original noisy speech PSD at that particular frequency i.e. ω_int, therefore more interference will be removed. Inversely, if the offset is not large enough (below th_offset) implying that the interference is not as strong, it was noticed empirically that $\Gamma_{EE_1}^{R}(\omega)$ should be used instead. Thus, from the above observations, in our work, the effective combination of the two estimates was taken as follows:

$$\Gamma_{EE_FF}^{j}(\omega) = \begin{cases} \Gamma_{EE_1}^{j}(\omega), & \text{for } \omega \neq \omega_\text{int} \\ \alpha \cdot \Gamma_{EE}^{j}(\omega) + (1-\alpha) \cdot \Gamma_{\varepsilon\varepsilon_1}^{j}(\omega), & \text{for } \omega = \omega_\text{int} \end{cases} \quad (43)$$

where ω_int is found using (42) and j corresponds again to either the left channel (i.e.j=L) or the right channel (i.e. j=R). The weighting coefficient α in (43) and th_offset in (43) were set to 0.8 and 3 dB respectively.

Finally, using (43), the proposed binaural target speech PSD estimator is defined as the following:

$$\Gamma_{SS}^{j}(\omega) = \frac{\Gamma_{jj}(\omega) \cdot \Gamma_{EE_FF}^{j}(\omega)}{(\Gamma_{LL}(\omega) + \Gamma_{RR}(\omega)) - (\Gamma_{LR}(\omega) + \Gamma_{LR}^{*}(\omega))} \quad (44)$$

D. Case of Non-Frontal Target Sources

In the previous sections, the target source PSD estimator was designed under the assumption that the target source was frontal and that a directional interference source was at any arbitrary (unknown) direction in the background. This is the focus and the scope of this paper. However, it is possible to slightly modify the solution found in (29) for a frontal target source, to take into account a non-frontal target source as follows:

First, if the direction of the non-frontal target source is known, or more specifically if the ratio between the left and right HRTFs for the target is known (from measurements or from a model based on the direction of arrival), then this ratio can be defined as:

$$\Delta_{LR}(\omega) = \frac{H_R(\omega)}{H_L(\omega)} \quad (45)$$

Secondly, to find for instance the right target speech PSD (i.e. $\Gamma_{SS}^{R}(\omega)$, the approach is to compensate or pre-adjust the left noisy signal to the direction of the right noisy signal, by using the HRFTs ratio of the target speech defined in (45). In the frequency domain, the left noisy input signal "pre-adjusted" can be then computed as follows:

$$Y_L^{AD}(\omega) = Y_L(\omega) \cdot \Delta_{LR}(\omega) \quad (46)$$

where $Y_1(\omega)$ is the Fourier transform of original left noisy input signal as defined in (1) (i.e. $Y_L(\omega)$=F.T(l(i))).

For simplicity, the corresponding time domain "pre-adjusted" representation of $Y_L^{AD}(\omega)$ is referred to as: $l^{ad}(i)$.

Finally, by performing this pre-adjustment, the solution developed in (44) for a frontal target can be applied again (i.e. the solution remains valid) but all the required parameters should then be computed using pd $l^{ad}(i)$ instead of l(i). The final result of (44) will yield the estimation of the right target speech PSD i.e. $\Gamma_{SS}^{R}(\omega)$.

Reciprocally, to find the left target PSD i.e. $\Gamma_{SS}^{R}(\omega)$, the original left noisy input signal i.e. l(i) remains unchanged but the right noisy input signal i.e. r(i) in (2) should be at first pre-adjusted by using the inverse of (45). Consequently, $\Gamma_{SS}^{L}(\omega)$ is found by using l(i) and the pre-adjusted right noisy input signal referred to as $r^{ad}(i)$ instead of r(i), to be used in (44).

It should be noted that by pre-adjusting the left or right input noisy signals to compute the left or right target PSDs, the residual directional noise remaining in the left and right target PSD estimations will also be shifted. Consequently, the interaural cues of the noise would not be preserved. However, it will be shown in section IVc), how to fully preserve all the interaural cues for both the target speech and noise, regardless of the direction of the target source. However, in the remaining sections of this paper, a frontal target is assumed.

Integration of Target Speech Psd Estimator into Noise Reduction Scheme and Interaural Cues Preservation As a state of the art recently proposed method, the binaural multichannel Wiener filtering algorithm [BOG'07] was selected to be the initial basis of a binaural noise reduction scheme to be modified to include the proposed target speech PSD estimator. Section IVa) will first briefly describe the general binaural multichannel Wiener filtering. Section IVb) will demonstrate the integration of the proposed target speech PSD estimator developed in Section III. Finally, Section IVc) will explain how to adjust this scheme to preserve the interaural cues of both the target speech and the directional interfering noise.

A. Binaural Wiener Filtering Noise Reduction Scheme

From the binaural system and signal definitions defined in section Hb), the left and right received noisy signal can be represented in the frequency domain as the following:

$$Y_L(\omega) = S_L(\omega) + V_L(\omega) \quad (47)$$

$$Y_R(\omega) = S_R(\omega) + V_R(\omega) \quad (48)$$

Each of these signals can be seen as the result of a Fourier transform obtained from a single measured frame of the respective time signals. Combining (47) and (48) into a vector form referred to as the binaural noisy input vector yields:

$$Y(\omega) = \begin{bmatrix} Y_L(\omega) \\ Y_R(\omega) \end{bmatrix} = S(\omega) + V(\omega) \quad (49)$$

where $$S(\omega) = \begin{bmatrix} S_L(\omega) \\ S_R(\omega) \end{bmatrix}$$

is the binaural speech input vector and $$V(\omega) = \begin{bmatrix} V_L(\omega) \\ V_R(\omega) \end{bmatrix}$$

is binaural noise input vector.

The output signals for the left and right hearing aids referred to as $Z_L(\omega)$ and $Z_R(\omega)$ are expressed as:

$$\begin{aligned} Z_L(\omega) &= W_L^H(\omega) \cdot Y(\omega) \\ &= W_L^H(\omega) \cdot S(\omega) + W_L^H(\omega) \cdot V(\omega) \end{aligned} \tag{50}$$

$$\begin{aligned} Z_R(\omega) &= W_R^H(\omega) \cdot Y(\omega) \\ &= W_R^H(\omega) \cdot S(\omega) + W_R^H(\omega) \cdot V(\omega) \end{aligned} \tag{51}$$

where $W_L(\omega)$ and $W_R(\omega)$ are M-dimensional complex weighting vectors for the left and right channels. In this paper, the binaural system is composed of only a single microphone per hearing aid (i.e. one for each car). Therefore, the total number of available channels for processing is M=2.

$W_L(\omega)$ and $W_R(\omega)$ are also regrouped into a 2M complex vector as the following:

$$W(\omega) = \begin{bmatrix} W_L(\omega) \\ W_R(\omega) \end{bmatrix} \tag{52}$$

The objective is to find the filter coefficients $w_L(\Omega)$ and $W_R(\omega)$ used in (50) and (51), which would produce an estimate of the target speech $S_L(\omega)$ for the left ear and $S_R(\omega)$ for the right ear.

Similar to [BOG'07], using a mean square error (MSE) cost function defined as:

$$J(W(\omega)) = E\left\{ \left\| \begin{bmatrix} S_L(\omega) - W_L^H(\omega) \cdot Y(\omega) \\ S_R(\omega) - W_R^H(\omega) \cdot Y(\omega) \end{bmatrix} \right\|^2 \right\} \tag{53}$$

The optimum solution for J in a minimum MSE (MMSE) sense is the multichannel Wiener solution defined as [KLA'06]:

$$W_{OP}(\omega) = R^1(\omega) \cdot r_{cross}(\omega) \text{ where} \tag{54}$$

$$R(\omega) = \begin{bmatrix} R_{YY}(\omega) & 0_{M\times M} \\ 0_{M\times M} & R_{YY}(\omega) \end{bmatrix} \text{ and} \tag{55}$$

$$r_{cross}(\omega) = \begin{bmatrix} r_{YS_L}(\omega) \\ r_{YS_R}(\omega) \end{bmatrix} \tag{56}$$

Also, $R_{YY}(\omega)$ is defined as the M×M-dimensional statistical correlation matrix of the binaural input signals:

$$R_{YY}(\omega)=E\{Y(\omega)\cdot Y^H(\omega)\} \tag{57}$$

$r_{YS_L}(\omega)$ is the M×1 statistical cross-correlation vector between the binaural noisy inputs and the left target speech signal and similarly $r_{YS_R}(\omega)$ is the statistical cross-correlation vector between the binaural noisy input and the right target speech signal defined respectively as:

$$r_{YS_L}(\omega)=E\{Y(\omega)\cdot S_L^*(\omega)\} \tag{58}$$

$$r_{YS_s}(\omega)=E\{Y(\omega)\cdot S_R^*(\omega)\} \tag{58}$$

B. Integration of the Target Speech PSD Estimator

From the binaural Wiener filtering solution described in section IVa), it can seen that the optimum solution expressed in (54)-(59) requires the knowledge of the statistics of the actual left and right target speech signals i.e. $S_L(\omega)$ and $S_R(\omega)$ respectively, required more specifically in equations (58) and (59). Obviously, those two signals are not directly available in practice. However, using the target speech PSD estimator developed in Section III, it is possible to find an estimate of the target speech magnitude spectrum under the assumption that the target speaker is approximately frontal. First, using the proposed target speech estimator expressed in (44), the left and right target speech magnitude spectrum estimates can be computed as:

$$\left|\hat{S}_1(k)\right| = \left|\hat{S}_i(\omega)\right|\Big|_{\omega=\frac{2\pi\cdot k}{N}} = \sqrt{\Gamma_{SS}^i(k)\cdot N} \tag{60}$$

where i corresponds again to either the left channel (i.e. i=L) or the right channel (i.e. i=R) channel, N is the number of frequency bins in the DFT and k is the discrete frequency bin frequency.

Secondly, it is known that the noise found in the phase component of the degraded speech signal is perceptually unimportant in contrast to the noise affecting the speech magnitude [SHA'06]. Consequently, the unaltered noisy left and right input phases will be used in the computations of cross-correlations vectors in (58) and (59). However, as mentioned in section III, one of the key elements of the target speech PSD estimator is that the target speech magnitude can be estimated on a frame-by-frame basis without the need of a voice activity detector. Hence, we can compute the instantaneous estimates (i.e. estimation on a frame-by-frame basis) of the cross-correlation vectors defined in (58) and (51) as the following:

$$\hat{r}_{YS_1}(k) = \hat{r}_{YS_1}(\omega)\Big|_{\omega=\frac{2\pi\cdot k}{N}} = Y(k)\cdot\left|\hat{S}_1(k)\right|\cdot e^{j\angle Y_1^*(k)} \tag{61}$$

Similarly, the instantaneous correlation matrix of the binaural input signals can be computed as:

$$\hat{R}_{YY}(k) = \hat{R}_{YY}(\omega)\Big|_{\omega=\frac{2\pi\cdot k}{N}} = Y(k)\cdot Y^H(k) \tag{62}$$

As a result, the proposed instantaneous (or adaptive) binaural Wiener filter incorporating the target speech PSD estimator is then found as follows:

$$\hat{W}_{inst}(k) = \begin{bmatrix} \hat{W}_L^{inst}(k) \\ \hat{W}_R^{inst}(k) \end{bmatrix} = \hat{R}^{-1}(k)\cdot\hat{r}_{cross}(k) \text{ where} \tag{63}$$

$$\hat{R}(k) = \begin{bmatrix} \hat{R}_{YY}(k) & 0_{M\times M} \\ 0_{M\times M} & \hat{R}_{YY}(k) \end{bmatrix} \text{ and} \tag{64}$$

$$\hat{r}_{cross}(k) = \begin{bmatrix} \hat{r}_{YS_L}(k) \\ \hat{r}_{YS_R}(k) \end{bmatrix} \tag{65}$$

It will be shown in the simulation results that the effect of having an instantaneous estimate for the binaural Wiener filter becomes very advantageous when the background noise is transient and/or moving, without relying on a VAD or any signal content classifier.

C. Modification to Preserve Interaural Cues

Using the proposed instantaneous binaural Wiener filters computed using (63)-(65), the enhanced left and right output signals are then found by multiplying the noisy binaural input vector with its corresponding Wiener filter as follows:

$$Z_i^{inst}(k)=(W_i^{inst}(k)^H\cdot Y(k) \tag{66}$$

However, similar to the work in [LOT'06], to preserve the original interaural cues for both the target speech and the noise after enhancement, it is beneficial to determine a single real-valued enhancement gain per frequency to be applied to both left and right noisy input spectral coefficients. This will guaranty that the interaural time and level differences (ILDs and ITDs) of the enhanced binaural output signals will match the ITDs and ILDs of the original unprocessed binaural input signals.

First, using (66), the left and right real-valued spectral enhancement gains are computed as the following:

$$\begin{aligned} G_L(k) &= \min(|Z_L^{inst}(k)|/|Y_L(k)|,\ 1) \\ &= \min\left(\left|(W_L^{inst}(k))^H\cdot Y(k)\right|/|Y_L(k)|,\ 1\right) \end{aligned} \tag{67}$$

$$\begin{aligned} G_R(k) &= \min(|Z_R^{inst}(k)|/|Y_R(k)|,\ 1) \\ &= \min\left(\left|(W_R^{inst}(k))^H\cdot Y(k)\right|/|Y_R(k)|,\ 1\right) \end{aligned} \tag{68}$$

It should be noted that the spectral gains in (67) and (68) are upper-limited to one to prevent amplification due to the division operator.

Secondly, (67) and (68) are then combined into a single real-valued spectral enhancement gain as follows:

$$G_{ENH}(k)=\sqrt{G_L(k)\cdot G_R(k)} \tag{69}$$

Finally, using (69), the left and right output enhanced signals with interaural cues preservation are then estimated as the following:

$$\hat{S}_L(k)=G_{ENH}(k)\cdot Y_L(k) \tag{70}$$

$$\hat{S}_R(k)=G_{ENH}(k)\cdot Y_R(k) \tag{71}$$

Description of Binaural Noise Reduction in [BOG'07] with Cues Preservation Tradeoff In section IVa), the standard binaural Multichannel Wiener filtering was described. The binaural Wiener filter coefficients were found using equations (54) to (59). However, to compute those coefficients, the statistical cross-correlation vectors (i.e. equations (58),(59)) between the binaural noisy input signals and the binaural target speech signals are required. In practice, those cross-correlation vectors are not directly accessible. To resolve the latter, in section IVb), our proposed target speech PSD estimator was integrated and it was demonstrated how to obtain instead an instantaneous estimate of those cross-correlation vectors, which gave an instantaneous Wiener filter. In addition, in section IVe), the procedure to guaranty interaural cues preservation was shown, by converting the left and right Wiener filter gains into a single real-value spectral gain to be applied to the left and right noisy signals.

In [BOG'07], the binaural noise reduction scheme is first based on the standard binaural Wiener filters as described in section IVa). But the approach for computing all the parameters of the Wiener filters (such as the unknown statistical cross-correlation vectors) strongly relies on a robust VAD (an ideal VAD was used for the results presented in [BOG'07]), and on the following assumptions:

i) the target speech and noise are statistically independent, therefore equation (57) can be rewritten as:

$$R_{YY}(\omega)=R_{SS}(\omega)+R_{VV}(\omega) \tag{72}$$

where $R_{SS}(\omega)$ is the statistical cross-correlation matrix of the binaural target speech input signals defined as:

$$\begin{aligned} R_{SS}(\omega) &= E\{S(\omega)\cdot S^H(\omega)\} = E\left\{\begin{bmatrix} S_L(\omega) \\ S_R(\omega)\end{bmatrix}\cdot\begin{bmatrix} S_L(\omega) \\ S_R(\omega)\end{bmatrix}^H\right\} \\ &= [\,r_{SS_L}(\omega)\quad r_{SS_R}(\omega)\,] \end{aligned} \tag{73}$$

and $R_{VV}(\omega)$ is the statistical correlation matrix of the binaural noise signals defined as:

$$\begin{aligned} R_{VV}(\omega) &= E\{V(\omega)\cdot V^H(\omega)\} \\ &= E\left\{\begin{bmatrix} V_L(\omega) \\ V_R(\omega)\end{bmatrix}\cdot\begin{bmatrix} V_L(\omega) \\ V_R(\omega)\end{bmatrix}^H\right\} \end{aligned} \tag{74}$$

Using the assumption i), the statistical cross-correlation vectors in (58-59) can be then simplified to:

$$\begin{aligned} r_{YS_L}(\omega) &= E\{Y(\omega)\cdot S_L^*(\omega)\} \approx E\{S(\omega)\cdot S_L^*(\omega)\} \\ &= r_{SS_L}(\omega) \end{aligned} \tag{75}$$

$$\begin{aligned} r_{YS_R}(\omega) &= E\{Y(\omega)\cdot S_R^*(\omega)\} \approx E\{S(\omega)\cdot S_R^*(\omega)\} \\ &= r_{SS_R}(\omega) \end{aligned} \tag{76}$$

And using (75) and (76), equation (56) reduces to:

$$\begin{aligned} r_{cross}(\omega) &= \begin{bmatrix} r_{SS_L}(\omega) \\ r_{SS_R}(\omega)\end{bmatrix} \\ &= r_X(\omega) \end{aligned} \tag{77}$$

ii) The noise signal is considered short-term stationary implying that $R_{VV}(\omega)$ is equivalent whether it is calculated during noise-only periods or during target speech+noise periods.

In [BOG'07][KLA'07][DOC'05], from assumption ii) and having access to an ideal VAD, $R_{VV}(\omega)$ could then be estimated using an average over "noise-only" periods resulting in $\tilde{R}_{VV}(\omega)$, and $R_{YY}(\omega)$ could be estimated using "speech+noise" periods giving $\tilde{R}_{YY}(\omega)$. Consequently, an estimate of $R_{SS}(\omega)$ could be found by using (72) as follows:

$$\tilde{R}_{SS}(\omega) = \tilde{R}_{YY}(\omega) - \tilde{R}_{VV}(\omega) = \lfloor \tilde{r}_{SS_L}(\omega)\ \tilde{r}_{SS_R}(\omega)\rfloor \tag{78}$$

The latter result could then be used to approximate $r_x$ (w) in equation (77) yielding $\tilde{r}_x(\omega)$.

The second part of the work in [BOG'07] was to find an approach to control the level of interaural cues distortion for both the target speech and noise while reducing the noise. It was found that by extending the cost function defined in (53) to include two extra terms involving the interaural transfer functions of the target speech and the noise (referred to as $ITF_S$ and $ITF_V$ respectively), it is possible to control the interaural cues distortion level as well as the noise reduction strength. Solving this extended cost function yields the extended binaural Wiener filter as follows:

$$W_{BWF_ITF}(\omega) = \begin{pmatrix} R_{Rv}(\omega) + \mu \cdot R_{Rv}(\omega) + \\ \alpha \cdot R_{Rsc}(\omega) + \beta \cdot R_{Rvc}(\omega) \end{pmatrix}^{-1} \cdot r_X(\omega) \text{ where} \tag{79}$$

$$R_{Rs}(\omega) = \begin{bmatrix} R_{SS}(\omega) & 0_{M\times M} \\ 0_{M\times M} & R_{SS}(\omega) \end{bmatrix} \tag{80}$$

$$R_{Rv}(\omega) = \begin{bmatrix} R_{VV}(\omega) & 0_{M\times M} \\ 0_{M\times M} & R_{VV}(\omega) \end{bmatrix} \tag{81}$$

and the extra two components are:

$$R_{Rsc}(\omega) = \begin{bmatrix} R_{SS}(\omega) & -ITF_S^* \cdot R_{SS}(\omega) \\ -ITF_S \cdot R_{SS}(\omega) & |ITF_S|^2 \cdot R_{SS}(\omega) \end{bmatrix} \tag{82}$$

$$R_{Rvc}(\omega) = \begin{bmatrix} R_{VV}(\omega) & -ITF_V^* \cdot R_{VV}(\omega) \\ -ITF_V \cdot R_{VV}(\omega) & |ITF_V|^2 \cdot R_{VV}(\omega) \end{bmatrix} \tag{83}$$

Also, in (79), the variable μ provides a tradeoff between noise reduction and speech distortion a controls the speech cues distortion and β controls the noise cues distortion. For instance, placing more emphasis on cues preservation (i.e. increasing α and β) will decrease the noise reduction performance. Basically it becomes a tradeoff. More detailed analysis on the interaction of those variables can be found in [BOG'07].

Furthermore, it can be noticed that the solution of the extended Wiener filter in (79) requires the original interaural transfer functions of the target speech and the noise defined as follows:

$$ITF_S(\omega) = E\left\{\frac{S_L(\omega)\cdot S_R^*(\omega)}{S_R(\omega)\cdot S_R^*(\omega)}\right\} \tag{84}$$

$$ITF_V(\omega) = E\left\{\frac{V_L(\omega)\cdot V_R^*(\omega)}{V_R(\omega)\cdot V_R^*(\omega)}\right\} \tag{85}$$

However to estimate (84) and (85), another assumption made in [BOG'07] is that the speech and noise are stationary (i.e. they do not relocate or move) and they can be computed using the received binaural noisy signals.

Simulation Results

In the first subsection, various simulated hearing scenarios will be described. The second subsection will briefly explain the various performance measures used to evaluate our proposed binaural noise reduction scheme detailed in section IV with the integration of the target speech PSD estimator developed in section III, versus the binaural noise reduction scheme in [BOG'07] described in Section V. Finally, the last subsection will present the results.

A. Simulation Setup and Hearing Situations

The following is the description of various simulated hearing scenarios. It should be noted that all data used in the simulations such as the binaural speech signals and the binaural noise signals were provided by a hearing aid manufacturer and obtained from "Behind The Ear" (BTE) hearing aids microphone recordings, with hearing aids installed at the left and the right cars of a KEMAR dummy head. For instance, the dummy head was rotated at different positions to receive speech signals at diverse azimuths and the source speech signal was produced by a loudspeaker at 1.5 meters from the KEMAR. Also, the KEMAR had been installed in different noisy environments to collect real life noise-only data. Speech and noise sources were recorded separately. The target speech source and directional interfering noise recordings used in the simulations were purposely taken in a reverberant free environment to avoid the addition of diffuse noise on top of the directional noise. In a reverberant environment, the noise and target speech signals received are the sum of several components such as components emerging from the direct sound path, from the early reflections and from the tail of the reverberation [KAM'08][MEE'02]. However, the components emerging from the tail of the reverberation have diffuse characteristics and consequently are no longer considered directional. By integrating in a noise reduction scheme both the proposed binaural target speech PSD estimator from this paper and the binaural diffuse noise PSD estimator developed in [KAM'08], speech enhancement experiments in complex acoustic scenes composed of time-varying diffuse noise, multiple directional noises and highly reverberant environments have shown that it becomes possible to effectively diminish those combined diverse noise sources. However, the resulting algorithm and combination of estimates is outside the scope of this paper and it will be the subject of a separate paper. The scope of this paper is therefore to demonstrate the efficiency of the proposed target source PSD estimator in the presence of an interfering directional noise, using a state of the art algorithm for such a scenario (i.e. binaural Wiener filter).

Scenario a):

The target speaker is in front of the binaural hearing aid user (i.e. azimuth=) 0° and a background lateral interfering talker is at azimuth=90° in the background.

Scenario b):

The target speaker is in front of the binaural hearing aid user with a lateral interfering talker (at 90° azimuth) and transient noises (at 210° azimuth) both occurring in the background.

For simplicity, the proposed binaural noise reduction incorporating the target speech spectrum estimator technique (i.e. sections III and IV) will be given the acronym: PBTE_NR (Proposed Binaural Target Estimator—Noise Reduction). The extended binaural noise reduction scheme in [BOG'07] will be given the acronym: EBMW (Extended Binaural Multichannel Wiener).

For the simulations, the results were obtained on a frame-by-frame basis with 25.6 ms of frame length and 50% overlap. A Hanning window was applied to each binaural input frames with a FFT-size of N=512 at a sampling frequency offs=20 kHz. After processing each frame, the enhanced signals were reconstructed using the Overlap-and-Add method.

The PBTE_NR defined in equations (70),(71) was configured as follows: for each binaural frame received, the proposed target speech PSD estimator is evaluated using (44). A least-squares algorithm with 150 coefficients is used to estimate the Wiener solution of (5), which performs a prediction of the left noisy speech signal from the right noisy speech signal as illustrated in FIG. 1. It should be noted that the least-squares solution of the Wiener filter also included a causality delay of 60 samples. It can easily be shown that for instance when only directional noise is present without frontal target speech activity, the time domain Wiener solution of (5) is then the convolution between the left HRIR and the inverse of the right HRIR. The optimum inverse of the right-side HRIR will typically have some non-causal samples (i.e. non minimal phase HRIR) and therefore the least-squares estimate of the Wiener solution should include a causality delay. Furthermore, this causality delay allows the Wiener filter to be on either side of the binaural system to consider the largest possible ITD. Once the target speech spectrum is estimated, the result is incorporated in (63), to get our so-called instantaneous (i.e. adapted on frame-by-frame basis) binaural Wiener filter, $\hat{W}_{just}(\omega)$. Moreover, the results obtained with PBTE_NR neither requires the use of a VAD (or any classifier) nor a training period.

The EBMW algorithm defined in (79) was configured as follows: First, the estimates of the noise and noisy input speech correlation matrices (i.e. $\tilde{R}_{VV}(\omega)$ and $R_{YY}(\omega)$ respectively) are obtained to compute $\tilde{R}_{SS}(\omega)$ in (78). In [BOG'07] the enhancement results were obtained for an environment with stationary directional background noise and all the estimates were calculated off-line using an ideal VAD. However, in this paper, the scenarios described earlier involve interfering speech and/or transient directional noise in the background, which makes it more complex to obtain those estimates. For instance, each binaural frame received can be classified into one of those four following categories: i) "speech-only" frame (i.e. target speech activity only), ii) "noisy" frame (i.e. target speech activity+noise activity), iii) "noise-only" frame (i.e. noise activity only) and iv) "silent" frame (i.e. without any activities). Consequently, a frame classifier combined with the ideal VAD is also required since $\tilde{R}_{YY}(\omega)$ has to be estimated using frames belonging to category ii) only and $\tilde{R}_{VV}(\omega)$ has to be estimated using frames belonging to category iii) only. Also, this classifier required for the method from [BOG'07] is assumed ideal and capable of perfectly distinguishing between target speech and interfering speech. To obtain all the required estimates, the EBMW also requires a training period. In the simulations, the estimates were obtained offline using three different training periods: a) estimations resulting from 3 seconds of category ii) and 3 seconds of category iii); b) estimations resulting from 6 seconds of category ii) and 6 seconds of category iii); and finally c) estimations resulting from 9 seconds of category ii) and 9 seconds of category iii). The noise reduction results for each training period will be presented in section VIc). Furthermore, for the EBMW $\mu$ was set to 1 (similar to [BOG'07]) and $\alpha$ and $\beta$ were set to 0 to purposely get the maximum noise reduction possible. Thus interaural cues distortion will not be considered by the EBMW algorithm. This setup was chosen so that it becomes possible to demonstrate that even under the ideal conditions for the EBMW from a noise reduction and speech distortion perspective (with a perfect VAD and classifier, and with the algorithm focusing only on noise reduction and speech distortion), the proposed PBTE_NR which does not rely on any VAD or classifier and which guarantees that the interaural cues are preserved can still outperform the EBMW in most practical cases. It should be mentioned again that unlike the proposed PBTE_NR, the EBMW could only minimize the interaural cues distortion (i.e. not fully preserving the cues) at the cost of achieving less noise reduction.

B. Objective Performance Measures

Three types of objective measures namely WB-PESQ, PSM and CSII were used to evaluate the noise reduction performance obtained using the PBTE_NR and EBMW algorithms.

WB-PESQ: PESQ (Perceptual Evaluation of Speech Quality) was originally recommended by ITU-T standard under P862.1 for speech quality assessment. It is designed to predict the subjective Mean Opinion Score (MOS) of narrowband (3.1 kHz) handset telephony and narrowband speech coders [ITU'01]. Recently, ITU-T standardized the WB-PESQ (Wideband PESQ) under P.862.2, which is the extension of the model used in PESQ for wideband speech signals and operates at a sampling rate of 16 kHz [ITU'07]. In [HU'08], a study was conducted to evaluate several quality measures for speech enhancement (i.e. PESQ, segmental SNR, frequency weighted SNR, Log-likelihood ratio, Itakura-Saito distance etc.). PESQ provided the highest correlation with subjective evaluations in terms of overall quality and signal distortion. PESQ scores based on the MOS scale which is defined as follows: 5—Excellent, 4—Good, 3—Fair, 2—Poor, 1—Bad.

PSM: The quality measure PSM (Perceptual Similarity Measure) from the PEMO-Q [HUB'06] estimates the perceptual similarity between the processed signal and the clean speech signal, in a way similar to PESQ. PESQ was optimized for speech quality, however, PSM is also applicable to processed music and transients, providing a prediction of perceived quality degradation for wideband audio signals [HUB'06] [ROH'05]. PSM has demonstrated high correlations between objective and subjective data and it has been used for quality assessment of noise reductions algorithms in [ROH'07][ROH'05]. In terms of noise reduction evaluation, PSM is first obtained using the unprocessed noisy signal with the original clean signal, then using the processed "enhanced" signal with the original clean signal. The difference between the two PSM results (referred to as APSM) provides a noise reduction performance measure. A positive APSM value indicates a higher quality obtained from the processed signal compared to the unprocessed one, whereas a negative value implies signal deterioration.

CSII: The Coherence Speech Intelligibility Index (CSII) [KAT'05] is the extension of the speech intelligibility index (SII), which estimates speech intelligibility under conditions of additive stationary noise or bandwidth reduction. CSII further extends the SII concept to also estimate intelligibility in the occurrence of non-linear distortions such as broadband peak-clipping and center-clipping. To relate to our work, the non-linear distortion can also be caused by the result of denoising or speech enhancement algorithms. The method first partitions the speech input signal into three amplitude regions (low-, mid- and high-level regions). The CSII calculation is performed on each region (referred to as the three-level CSII) as follows: each region is divided into short overlapping time segments of 16 ms to better consider fluctuating noise conditions. Then, the signal-to-distortion ratio (SDR) of each segment is estimated as opposed to the standard SNR estimate in the SII computation. The SDR is obtained using the mean-squared coherence function. The CSII result for each region is based on the weighed sum of the SDRs across the frequencies similar to the frequency weighted SNR in the SII computation. Finally, the intelligibility is estimated from a linear weighted combination of the CSII results gathered from each region. It is stated in [KAT'05] that applying the three-level CSII approach and the fact that the SNR is replaced by the SDR provide much more information about the effects of the distortion on the speech signal. CSII provides a score between 0 and 1. A score of "1" represents a perfect intelligibility and a score of "0" represents a completely unintelligible signal.

The WB-PESQ and PSM measures will provide feedback regarding the overall quality and signal distortion, whereas the CSII measure will indicate the potential speech intelligibility improvement of the processed speech versus the noisy unprocessed speech signal.

It should be noted here that the objective measures specific for the evaluation of interaural cues distortion such as in [BOG'07] were not used in this paper, since the proposed PBTE_NR algorithm guaranties cues preservation. There is a tradeoff between noise reduction strength and cues preservation in the reference EBMW algorithm but, as mentioned earlier, in this paper only the resulting noise reduction and speech distortion aspects of the EBMW algorithm were taken into account to compare with the proposed PBTE_NR algorithm (i.e. this represents an "ideal" scenario for the reference EBMW algorithm, in terms of the noise reduction that it can provide).

C. Results and Discussion

The noise reduction results for scenario a) are represented in Table 1 for the left ear and in Table 2 for the right ear, respectively. Similarly, the results for scenario b) are found in Table 3 for the left ear and Table 4 for the right ear, respectively.

The performance measures for the PBTE_NR and EBMW algorithms were obtained over eight seconds of data (i.e. eight seconds of enhanced binaural signal corresponding to each scenario). However, as mentioned in section VIa), the reference EBMW algorithm requires a training period to estimate the noise and the noisy input speech correlation matrices (i.e. $\tilde{R}_{VV}(\omega)$ and $\tilde{R}_{YY}(\omega)$ respectively) before processing. In all the tables, the notation 'x secs+x secs' represents the number of seconds of category ii) and iii) signals that were used off-line (in addition to the eight seconds of data used to evaluate the de-noising performance) to obtain those estimates. As defined in the previous section, category ii) represents the "noisy" frames required for the computation of $\tilde{R}_{YY}(\omega)$ and category iii) represents the "noise-only" frames required for the computation of $\tilde{R}_{VV}(\omega)$. Similar to [BOG'07], all the parameters estimation for the reference EBMW algorithm were performed offline assuming a perfect VAD but also assuming a perfect classifier as well, to distinguish between the interfering speech and the target speech. For the training period of the reference EBMW algorithm, it should be noted that in order to attain the longest training period represented by "9 secs+9 secs", the actual off-line training data required was well over 18 seconds, since the degraded speech data is additionally composed of the two other remaining categories, such as the "speech-only" frames (i.e. category i) and "silent" frames (i.e. category iv) respectively. For instance, the longest training period took close to 40 seconds of data to obtain the appropriate periods of data belonging to categories ii) and iii). The eight seconds of data used for the evaluation of the de-noising performance was also included in the data used for the off-line estimation of the parameters in the EBMW algorithm, which could also be considered as a favorable case. At the opposite, the proposed PBTE_NR algorithm did not make use any prior training period.

The resulting binaural original and enhanced speech files for scenarios a) and b) and for the different algorithms under different setups are available for download at the address: http://www.site.uottawa.ca/~akamkar/XXXXXX Looking at the performance results for scenario a) for the simple case where a single interfering talker is in the background at a fixed direction, the EBMW algorithm begins to reach the performance level of the PBTE_NR algorithm only with the longest training period i.e. "9 secs+9 secs". It can be seen that both algorithms obtain comparable intelligibility measures (i.e. from the CSII measure), however in terms of quality and distortion improvement (i.e. from the WB-PESQ and ΔPSM measures), the results from the PBTE_NR algorithm are still superior than the results obtained with the EBMW algorithm.

It can be noticed that the proposed PBTE_NR algorithm outperformed the reference EBMW algorithm even under an ideal setup for this algorithm (i.e. long training period, perfect VAD and classifier, and without it taking into account any preservation of interaural cues). In [BOG'07][KLA'07][KLA'06][DOC'05], the EBMW algorithm strongly relied on the assumption that the noise signal is considered short-term stationary, that is, $\tilde{R}_{VV}(\omega)$ is equivalent whether it is calculated during noise-only periods (i.e. category iii) or during target speech+noise periods (i.e. category ii). This implies that $\tilde{R}_{VV}(\omega)$ should be equivalent to the averaged noise correlation matrix found in $\tilde{R}_{YY}(\omega)$, since as shown in (72) $\tilde{R}_{YY}(\omega)$ can be decomposed into the sum of the noise and the binaural target speech correlation matrices. However, when the background noise is a speech signal and due to the non-stationary nature of speech, it was found that this equivalence is only achievable on average over a long training period (i.e. long term average). Moreover, to maintain the same performance once a selected adequate training period is completed, the background noise should not move or relocate, otherwise the estimated statistics required for the computation of the Wiener filter coefficients will become again suboptimal. In practice, those estimates should be frequently updated in order to follow the environment changes, but this implies a shorter training period. However, as shown in the performance results for scenario a), even under ideal conditions (i.e. perfect VAD and classifier, with the interferer remaining at a fixed direction and no emphasis on the preservation of the interaural cues), a non-negligible training period of 6 seconds (i.e. 3 secs+3 secs) still yields a much lower performance result than the one obtained with the proposed PBTE_NR algorithm. The reason is that the PBTE_NR algorithm provides binaural enhancement gains that are continuously updated using the proposed instantaneous target speech PSD estimator. More specifically, since a new target speech PSD estimate is available on frame-by-frame basis (in this simulation, every 25 ms corresponding to the frame length), the coefficients of the binaural Wiener filter are also updated at the same rate (i.e. referred to as the "instantaneous binaural Wiener" expressed in (63)). The binaural Wiener filter is then better suited for the reduction of transient non-stationary noise. Furthermore, it should be reminded that another important advantage of the PBTE_NR algorithm is that the interaural cues of both the speech and noise will not be distorted at all since in the PBTE_NR algorithm, the left and right (i.e. binaural) instantaneous Wiener filters are combined into a single real-valued spectral enhancement gain as developed in section IVc). This gain is then applied to both the left and right noisy input signals, to produce the left and right enhanced hearing aid signals as shown in (70)-(71). As a result, this enhancement approach guaranties interaural cues preservation.

In scenario b), the interference is coming from a talker and from some dishes clattering in the background. Since those two noise sources are originating at different directions (90° and 210° azimuths respectively) and the noise coming from the dishes clattering is transient, scenario b) can also be described as a single moving noise source, which quickly alternates between those two different directions. It is clear that this type of scenario will decrease the performance of the reference EBMW algorithm, since the overall background noise is even more fluctuating. However, to make the reference EBMW algorithm work even under this scenario, the background transient noise i.e. the dishes clattering was designed to occur periodically in the background over the entire noisy data. Consequently, this helped acquiring better estimates for $\tilde{R}_{YY}(\omega)$ and $\tilde{R}_{VV}(\omega)$ during the offline training period. Otherwise, if the transient noise was occurring at random times, $\hat{R}_{YY}(\omega)$ and $\hat{R}_{VV}(\omega)$ should be estimated online to be able to adapt to this sudden apparition of noise. However, as it can be observed from Tables 3 and 4, even with a training period of "3 secs+3 secs" which is still not a negligible length in practice (i.e. it takes longer than 3 seconds to obtain 3 seconds of data for each required class, as explained earlier), the reference EBMW algorithm yielded poor performance results. The quality and distortion measures returned by the WB-PESQ even indicated that the left output signal deteriorated and also decreased in intelligibility. Therefore, it is not feasible to have online parameters estimations for a hearing situation as described in scenario b) using the reference EBMW algorithm.

Comparatively, the proposed PBTE_NR algorithm still produced a good performance for the second scenario, which can be verified by the increase of all the objective measures. This is due again to the fact that the adaptation is on a frame-by-frame basis, which allows to quickly adapt to the sudden change of noise direction even when the noise is just a burst (i.e. transient) such as dishes clattering. Moreover, using the proposed PBTE_NR algorithm, the interaural cues for the two background noises and the target speaker are not affected due to its single real-valued spectral gain. As a result, the spatial impression of the environment remains unchanged. Informal listening tests showed that using the reference EBMW algorithm without the compensation for interaural cues tends to produce a perceived same direction for the two noises i.e. losing their spatial separation due to interaural cues distortion.

Conclusion

An instantaneous speech target spectrum estimator has been developed for future high-end binaural hearing aids. It allows the instantaneous target speech spectrum retrieval in a noisy environment composed of a background interfering talker or transient noise. It was demonstrated that incorporating the proposed estimator in a binaural Wiener filtering algorithm, referred to as the instantaneous binaural Wiener filter, can efficiently reduce non-stationary as well moving directional background noise. Most importantly, the proposed technique does not employ any voice activity detection, it does not require any training period (it is "instantaneous" on a frame by frame basis), and it fully preserves both the target speech and noise interaural cues.

A future paper will present the integration in a noise reduction scheme of both the proposed binaural target speech PSD estimator from this paper and the binaural diffuse noise PSD estimator developed in [KAM'08], for complex acoustic scenes composed of time-varying diffuse noise, multiple directional noises and highly reverberant environments. The case of non-frontal target speech sources is also to be considered as future work.

TABLE 1

Scenario a) - Results for the Left channel

| Left Channel | WB-PESQ | ΔPSM | CSII |
|---|---|---|---|
| Original | 2.40 | — | 0.80 |
| EBMW (3 secs + 3 secs) | 2.66 | 0.0021 | 0.85 |

TABLE 1-continued

Scenario a) - Results for the Left channel

| Left Channel | WB-PESQ | ΔPSM | CSII |
|---|---|---|---|
| EBMW (6 secs + 6 secs) | 2.89 | 0.0033 | 0.89 |
| EBMW (9 secs + 9 secs) | 3.18 | 0.0174 | 0.93 |
| PBTE_NR | 3.50 | 0.0236 | 0.93 |

TABLE 2

Scenario a) - Results for the Right channel

| Right Channel | WB-PESQ | ΔPSM | CSII |
|---|---|---|---|
| Original | 1.90 | — | 0.59 |
| EBMW (3 secs + 3 secs) | 2.08 | −0.0010 | 0.68 |
| EBMW (6 secs + 6 secs) | 2.27 | 0.0051 | 0.73 |
| EBMW (9 secs + 9 secs) | 2.63 | 0.0253 | 0.83 |
| PBTE_NR | 3.06 | 0.0382 | 0.87 |

TABLE 3

Scenario b) - Results for the left channel

| Left Channel | WB-PESQ | ΔPSM | CSII |
|---|---|---|---|
| Original | 1.33 | — | 0.63 |
| EBMW (3 secs + 3 secs) | 1.28 | 0.0735 | 0.50 |
| EBMW (6 secs + 6 secs) | 1.68 | 0.1531 | 0.66 |
| EBMW (9 secs + 9 secs) | 1.85 | 0.1586 | 0.71 |
| PBTE_NR | 2.11 | 0.1641 | 0.76 |

TABLE 4

Scenario b) - Results for the Right channel

| Right Channel | WB-PESQ | ΔPSM | CSII |
|---|---|---|---|
| Original | 1.37 | — | 0.41 |
| EBMW (3 secs + 3 secs) | 1.36 | 0.0485 | 0.42 |
| EBMW (6 secs + 6 secs) | 1.78 | 0.1206 | 0.66 |
| EBMW (9 secs + 9 secs) | 1.88 | 0.1295 | 0.70 |
| PBTE_NR | 2.31 | 0.1422 | 0.77 |

REFERENCES

[BOG'07] T. Bogaert, S. Doclo, M. Moonen, "Binaural cue preservation for hearing aids using an interaural transfer function multichannel Wiener filter," in *Proc. IEEE ICASSP*, vol. 4, pp. 565-568, April 2007

[DOC'05 2nd] S. Doclo, M. Moonen, "Multimicrophone Noise Reduction Using Recursive GSVD-Based Optimal Filtering with ANC Postprocessing Stage", *IEEE Trans. on Audio, Speech and Audio Processing*, vol. 13, no. 1 pp. 53-69, January 2005

[DOC'05] S. Doclo, T. Klasen, J. Wouters, S. Haykin, M. Moonen, "Extension of the Multi-Channel Wiener Filter with ITD cues for Noise Reduction in Binaural Hearing Aids," in *Proc. IEEE WASPAA*, pp. 70-73, October 2005

[HAM'05] V. Hamacher, J. Chalupper, J. Eggers, E. Fisher, U. Kornagel, H. Puder, and U. Rass, "Signal Processing in High-End Hearing Aids: State of the Art, Challenges, and Future Trends", *EURASIP Journal on Applied Signal Processing*, vol. 2005, no. 18, pp. 2915-2929, 2005

[HU'08] Y. Hu and P. C. Loizou, "Evaluation of Objective Quality Measures for Speech Enhancement", *IEEE Trans. Audio Speech Language Processing*, vol. 16, no. 1, pp. 229-238, January 2008.

[HUB'06] R. Huber and B. Kollmeier, "PEMO-Q—A New Method for Objective Audioquality Assessment using a Model of Auditory Perception." *IEEE Trans. on Audio, Speech and Language Processing*, vol. 14, no. 6, pp. 1902-1911, November 2006

[ITU'01] ITU-T, "Perceptual evaluation of speech quality (PESQ), an objective method for end-to-end speech quality assessment of narrowband telephone networks and speech codecs", *Series P: Telephone Transmission Quality Recommendation P.*862, *International Telecommunications Union*, February 2001

[ITU'07] ITU-T. "Wideband Extension to Recommendation p. 862 for the Assessment of Wideband Telephone Networks and Speech Codecs. *Recommendation P.*862.2, *International Telecommunication Union*, November 2007

[KAM'08] A. H. Kamkar-Parsi, M. Bouchard, "Improved Noise Power Spectrum Density Estimation For Binaural Hearing Aids Operating in a Diffuse Noise Field Environment", accepted for publication in *IEEE Transactions on Audio, Speech and Language Processing*, August 2008

[KAT'05] J. M. Kates and K. H. Arehart. Coherence and the Speech Intelligibility Index, *J. Acoust. Soc. Am.*, vol. 117, no. 4, pp. 2224-2237, April 2005

[KLA'06] T. J. Klasen, S. Doclo, T. Bogaert, M. Moonen, J. Wouters, "Binaural multi-channel Wiener filtering for Hearing Aids: Preserving Interaural Time and Level Differences," in *Proc. IEEE ICASSP*, vol. 5, pp. 145-148, May 2006

[KLA'07] T. J. Klasen, T. Bogaert, M. Moonen, "Binaural noise reduction algorithms for hearing aids that preserve interaural time delay cues," *IEEE Trans. Signal Processing*, vol. 55, no. 4, pp. 1579-1585, April 2007

[LOT'06] T. Lotter and P. Vary, "Dual-channel Speech Enhancement by Superdirective Beamforming," *EURASIP Journal on Applied Signal Processing*, vol. 2006, pp. 1-14, 2006

[MAR'01] R. Martin, "Noise Power Spectral Density Estimation Based on Optimal Smoothing and Minimum Statistics", *IEEE Transactions on Speech and Audio Processing*, vol. 9, no. 5, pp. 504-512, July 2001

[MEE'02] K. Meesawat, D. Hammershoi, "An investigation of the transition from early reflections to a reverberation tail in a BRIR", *Proc. of the* 2002 *International Conference on Auditory Display*, Kyoto, Japan, July 2002

[PUD'06] H. Puder, "Adaptive Signal Processing for Interference Cancellation in Hearing Aids", *Signal Processing*, vol. 86, no. 6, pp. 1239-1253, June 2006

[ROH'05] T. Rohdenburg, V. Hohmann, and B. Kollmeier, "Objective Perceptual Quality measures for the Evaluation of Noise Reduction Schemes", in *9th International Workshop on Acoustic Echo and Noise Control*, Eindhoven, pp. 169-172, 2005

[ROH'07] T. Rohenburg, V. Hohmann, B. Koilmeir, "Robustness Analysis of Binaural Hearing Aid Beamformer Algorithms By Means of Objective Perceptual Quality Measures", *IEEE Workshop on Applications of Signal Processing to Audio and Acoustics*, pp. 315-318, NY, Oct. 21, 2007

[SHA'06] B. J. Shannon and K. K. Paliwal, "Role of Phase Estimation in Speech Enhancement", *Interspeech* 2006, ICLSP, Pennsylvania, Sep. 17, 2006

What is claimed is:

1. A method for a multi microphone noise reduction in a complex noisy environment, comprising:

estimating a left and a right noise power spectral density for a left and a right noise input frame by a power spectral density estimator;

computing a diffuse noise gain from the estimated power spectral density;

extracting a target speech power spectral density from the noise input frame by a target speech power spectral density estimator;

generating a directional noise gain from the target speech power spectral density and the noise power spectral density;

calculating a pre-enhanced side frame from the diffuse noise gain and the directional noise gain;

calculating auto regressive coefficients from the side frame for a Kalman filtering method;

filtering the noisy input frame by the Kalman filtering method;

generating a Kalman based gain from the Kalman filtered noisy frame and the noise power spectral density; and generating a spectral enhancement gain by combining the diffuse noise gain, the directional noise gain, and the Kalman based gain.

2. The method as claimed in claim 1, wherein the diffuse noise gain, the directional noise gain, and the Kalman based gain are combined with a weighting rule.

3. The method as claimed in claim 1, wherein the diffuse noise gain and the directional noise gain are combined and applied to a Fourier transform of the noisy input frame.

4. The method as claimed in claim 3, wherein the pre-enhanced side frame is calculated by transforming the Fourier transform of the noisy input frame back into the time-domain.

5. The method as claimed in claim 1, wherein a Wiener filter is applied to perform a prediction of the left noisy input frame from the right noisy input frame.

6. The method as claimed in claim 5, wherein a quadratic equation is formed by combing an auto-power spectral density of a difference between the prediction and the left noisy input frame with auto-power spectral densities of the left and the right noisy input frames.

7. The method as claimed in claim 6, wherein the noise power spectral density is estimated by the quadratic equation.

8. The method as claimed in claim 5, wherein an equation is formed by combining an auto-power spectral density of a difference between the prediction and the left noisy, input frame, auto-power spectral densities of the left and the right noisy input frames, and cross-power spectral density between the left and right noisy input frames.

9. The method as claimed in claim 8, wherein the target speech power spectral density is estimated by the equation.

10. The method as claimed in claim 1, wherein the complex noisy environment comprises time varying diffuse noise, multiple directional non-stationary noises and reverberant conditions.

11. The method as claimed in claim 1, wherein the method is used for the multi microphone noise reduction in a hearing aid.

12. A hearing aid, comprising:

a power spectral density estimator for estimating a left and a right noise power spectral density for a left and a right noise input frame;

a target speech power spectral density estimator for extracting a target speech power spectral density from the noise input frame; and a processing device for:

computing a diffuse noise gain from the estimated power spectral density, generating a directional noise gain from the target speech power spectral density and the noise power spectral density, calculating a pre-enhanced side frame from the diffuse noise gain and the directional noise gain, calculating auto regressive coefficients from the side frame for a Kalman filtering method, filtering the noisy input frame by the Kalman filtering method, generating a Kalman based gain from the Kalman filtered noisy frame and the noise power spectral density, and generating a spectral enhancement gain by combining the diffuse noise gain, the directional noise gain, and the Kalman based gain.

13. The hearing aid as claimed in claim 12, wherein the hearing aid is used in a complex noisy environment comprising time varying diffuse noise, multiple directional non-stationary noises and reverberant conditions.

* * * * *